US006851779B2

(12) United States Patent
Okazaki et al.

(10) Patent No.: US 6,851,779 B2
(45) Date of Patent: Feb. 8, 2005

(54) LIQUID EJECTION METHOD AND LIQUID EJECTION HEAD THEREFOR

(75) Inventors: Takeshi Okazaki, Kanagawa-Ken (JP); Toshio Kashino, Kanagawa-Ken (JP); Aya Yoshihira, Kanagawa-Ken (JP); Kiyomitsu Kudo, Kanagawa-Ken (JP); Yoshie Asakawa, Nagano-Ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 65 days.

(21) Appl. No.: 10/656,379

(22) Filed: Sep. 8, 2003

(65) Prior Publication Data

US 2004/0056929 A1 Mar. 25, 2004

Related U.S. Application Data

(62) Division of application No. 08/717,072, filed on Sep. 20, 1996, now Pat. No. 6,709,090.

(30) Foreign Application Priority Data

| | | |
|---|---|---|
| Sep. 22, 1995 | (JP) | 7-244989 |
| Sep. 28, 1995 | (JP) | 7-251602 |
| Oct. 13, 1995 | (JP) | 7-265886 |
| Dec. 22, 1995 | (JP) | 7-335505 |
| Jun. 7, 1996 | (JP) | 8-146319 |

(51) Int. Cl.[7] ..... B42J 29/38; B41J 2/05
(52) U.S. Cl. ..... 347/11; 347/65
(58) Field of Search ..... 347/10, 11, 56, 347/65

(56) References Cited

U.S. PATENT DOCUMENTS

| | | | | |
|---|---|---|---|---|
| 4,409,596 A | * | 10/1983 | Ishii | 347/11 |
| 4,480,259 A | | 10/1984 | Kruger et al. | |
| 4,496,960 A | | 1/1985 | Fischbeck | |

(List continued on next page.)

FOREIGN PATENT DOCUMENTS

| | | |
|---|---|---|
| EP | 326 428 A | 8/1989 |
| EP | 0 436 047 | 7/1991 |
| EP | 443 801 A | 8/1991 |
| EP | 448 967 A | 10/1991 |
| EP | 657 290 A | 6/1995 |
| EP | 668 165 A | 8/1995 |
| JP | 55-81172 | 6/1980 |
| JP | 61-69467 | 4/1986 |
| JP | 61-110557 | 5/1986 |
| JP | 62-156969 | 7/1987 |
| JP | 63-197652 | 8/1988 |
| JP | 63-199972 | 8/1988 |
| JP | 3-81155 | 4/1991 |
| JP | 5-124189 | 5/1993 |
| JP | 6-87214 | 3/1994 |

*Primary Examiner*—Michael S. Brooke
(74) *Attorney, Agent, or Firm*—Fitzpatrick, Cella, Harper & Scinto

(57) ABSTRACT

A Liquid ejecting method for ejecting liquid using a bubble, includes using a liquid ejecting head having an ejection outlet for ejecting the liquid, a bubble generating region where a bubble is generated in the liquid, a movable member which is disposed faced to the bubble generating region, and which is displaceable between a first position and a second position farther from the bubble generating region than the first position and which has a free end at a downstream side thereof; displacing the movable member from the first position to the second position by pressure based on generation of the bubble in the bubble generating region, wherein the bubble expands more to the downstream side than to the upstream side with respect to a direction toward the ejection outlet by the displacement of the movable member, thus directing the bubble toward the ejection outlet to eject the liquid through the ejection outlet; and imparting an operation to the liquid ejecting head to normalize a state of the liquid in a liquid flow path for the liquid at least before liquid ejection start or at the time of non-ejection of the liquid.

3 Claims, 46 Drawing Sheets

U.S. PATENT DOCUMENTS 4,723,129 A 2/1988 Endo et al.
4,965,608 A 10/1990 Shinohara et al.
4,994,825 A 2/1991 Saito et al.
5,095,321 A 3/1992 Saito et al.
5,109,233 A 4/1992 Nishikawa
5,124,716 A * 6/1992 Roy et al. ..... 347/11
5,208,604 A 5/1993 Watanabe et al.
5,278,585 A 1/1994 Karz et al.
5,302,971 A 4/1994 Ohba et al.
5,389,957 A 2/1995 Kimura et al.
5,548,312 A 8/1996 Asai
5,821,962 A 10/1998 Kudo et al.
5,861,895 A 1/1999 Tajika et al.
6,007,187 A 12/1999 Kashino et al.
6,062,680 A 5/2000 Yoshihira et al.
6,074,543 A 6/2000 Yoshihira et al.
6,205,508 B1 3/2001 Asakawa et al.
6,270,199 B1 8/2001 Kimura et al.
6,305,789 B1 10/2001 Nakata et al.
6,312,111 B1 11/2001 Kimura et al.
6,331,050 B1 12/2001 Nakata et al.
6,334,669 B1 1/2002 Kudo et al.

* cited by examiner (a)

(b)

(a)

(b)

(a)

(b)

(a)

(b)

$h_1 > h_2$ f(t,T) TABLE

| HD TEMP T (°C) \ NON-PRINT PERIOD t (HOUR) | ≧0, <12 | ≧12, <24 | ≧24, <36 | ≧36, <48 | |
|---|---|---|---|---|---|
| ≧−10, <0 | 2.0 | 2.5 | 3.0 | 3.5 | |
| ≧0, <10 | 1.5 | 2.0 | 2.5 | 3.0 | |
| ≧10, <20 | 1.0 | 1.5 | 2.0 | 2.5 | |
| ≧20, <30 | 0.8 | 1.3 | 1.8 | 2.3 | |
| ≧30, <40 | 0.6 | 1.1 | 1.6 | 2.1 | |

FIG. 67

LIQUID EJECTION METHOD AND LIQUID EJECTION HEAD THEREFOR

This is a divisional application of application Ser. No. 08/717,072, filed on Sep. 20, 1996 now U.S. Pat. No. 6,709,090.

FIELD OF THE INVENTION AND RELATED ART

The present invention relates to a liquid ejecting head for ejecting desired liquid by generation of bubble by application of thermal energy thereto, a head cartridge using the liquid ejecting head, a liquid ejecting apparatus and a liquid ejecting method.

More particularly, the present invention relates to a liquid ejecting method, a liquid ejecting head, a head cartridge using the liquid ejecting head, and a liquid ejecting apparatus, using a movable member which displaces by generation of a bubble.

The present invention is applicable to equipment such as a printer, a copying machine, a facsimile machine having a communication system, a word processor having a printer portion or the like, and an industrial recording device combined with various processing device or processing devices, in which the recording is effected on a recording material such as paper, thread, fiber, textile, leather, metal, plastic resin material, glass, wood, ceramic and so on.

In this specification, "recording" means not only forming an image of letter, figure or the like having specific meanings, but also includes forming an image of a pattern not having a specific meaning.

An ink jet recording method of so-called bubble jet type is known in which an instantaneous state change resulting in an instantaneous volume change (bubble generation) is caused by application of energy such as heat to the ink, so as to eject the ink through the ejection outlet by the force resulted from the state change by which the ink is ejected to and deposited on the recording material to form an image formation. As disclosed in U.S. Pat. No. 4,723,129, a recording device using the bubble jet recording method comprises an ejection outlet for ejecting the ink, an ink flow path in fluid communication with the ejection outlet, and an electrothermal transducer as energy generating means disposed in the ink flow path.

With such a recording method is advantageous in that, a high quality image, can be recorded at high speed and with low noise, and a plurality of such ejection outlets can be posited at high density, and therefore, small size recording apparatus capable of providing a high resolution can be provided, and color images can be easily formed. Therefore, the bubble jet recording method is now widely used in printers, copying machines, facsimile machines or another office equipment, and for industrial systems such as textile printing device or the like.

With the increase of the wide needs for the bubble jet technique, various demands are imposed thereon, recently.

For example, an improvement in energy use efficiency is demanded. To meet the demand, the optimization of the heat generating element such as adjustment of the thickness of the protecting film is investigated. This method is effective in that a propagation efficiency of the generated heat to the liquid is improved.

In order to provide high image quality images, driving conditions have been proposed by which the ink ejection speed is increased, and/or the bubble generation is stabilized to accomplish better ink ejection. As another example, from the standpoint of increasing the recording speed, flow passage configuration improvements have been proposed by which the speed of liquid filling (refilling) into the liquid flow path is increased.

Japanese Laid Open Patent Application No. SHO-63-199972 and so on discloses a flow passage structure shown in FIG. 34, (a), (b).

On the other hand, in the bubble jet recording method, the heating is repeated with the heat generating element contacted with the ink, and therefore, a burnt material is deposited on the surface of the heat generating element due to burnt deposit of the ink. However, the amount of the deposition may be large depending on the materials of the ink. If this occurs, the ink ejection becomes unstable. Additionally, even when the liquid to be ejected is the one easily deteriorated by heat or even when the liquid is the one with which the bubble generation is not sufficient, the liquid is desired to be ejected in good order without property change.

Japanese Laid Open Patent Application No. SHO-61-69467, Japanese Laid Open Patent Application No. SHO-55-81172 and U.S. Pat. No. 4,480,259 disclose that different liquids are used for the liquid generating the bubble by the heat (bubble generating liquid) and for the liquid to be ejected (ejection liquid). In these publications, the ink as the ejection liquid and the bubble generation liquid are completely separated by a flexible film of silicone rubber or the like so as to prevent direct contact of the ejection liquid to the heat generating element while propagating the pressure resulting from the bubble generation of the bubble generation liquid to the ejection liquid by the deformation of the flexible film. The prevention of the deposition of the material on the surface of the heat generating element and the increase of the selection latitude of the ejection liquid are accomplished, by such a structure.

However, with this structure in which the ejection liquid and the bubble generation liquid are completely separated, the pressure by the bubble generation is propagated to the ejection liquid through the expansion-contraction deformation of the flexible film, and therefore, the pressure is absorbed by the flexible film to a quite high degree. In addition, the deformation of the flexible film is not so large, and therefore, the energy use efficiency and the ejection force are deteriorated although the some effect is provided by the provision between the ejection liquid and the bubble generation liquid.

SUMMARY OF THE INVENTION

Accordingly, it is a principal object of the present invention to provide a liquid ejecting head and device wherein the state of the liquid to be ejected is changed at least upon the start of the recording operation, while maintaining the high ejection power and the high ejection efficiency, by which ejection performance and the property for the recording material are improved or normalized to stabilize and improve the image quality.

It is another object of the present invention to provide a liquid ejecting head and a device, wherein ejection liquid and/or the bubble generation liquid is discharged at the latest upon the record start, and the density of the ejection liquid is stabilized to improve or stabilize the image quality.

It is a further object of the present invention to provide a liquid ejecting head, a driving method therefor, and a device, wherein selection latitude of the liquid to be ejected is enhanced, while maintaining the stability of the ejection property and the high recorded image quality.

According to an aspect of the present invention, there is provided a Liquid ejecting method for ejecting liquid using a bubble, comprising the steps of: using a liquid ejecting head having an ejection outlet for ejecting the liquid, a bubble generating region where a bubble is generated in the liquid, a movable member which is disposed faced to said bubble generating region, and which is displaceable between a first position and a second position farther from the bubble generating region than the first position and which has a free end at a downstream side thereof;

displacing the movable member from said first position to said second position by pressure based on generation of the bubble in said bubble generating region, wherein said bubble expands more to the downstream side than to the upstream side with respect to a direction toward said ejection outlet by the displacement of said movable member, thus directing said bubble toward said ejection outlet to eject the liquid through the ejection outlet; and imparting an operation to said liquid ejecting head to normalize a state of the liquid in a liquid flow path for the liquid at least before liquid ejection start or at the time of non-ejection of the liquid.

According to another aspect of the present invention, there is provided a liquid ejection apparatus, using a liquid ejection head having an ejection outlet for ejecting the liquid, a bubble generating region where a bubble is generated in the liquid, a movable member which is disposed faced to said bubble generating region, and which is displaceable between a first position and a second position farther from the bubble generating region than the first position and which has a free end at a downstream side thereof;

wherein the movable member is displaced from said first position to said second position by pressure based on generation of the bubble in said bubble generating region, wherein said bubble expands more to the downstream side than to the upstream side with respect to a direction toward said ejection outlet by the displacement of said movable member, thus directing said bubble toward said ejection outlet to eject the liquid through the ejection outlet; the improvement comprising:

driving means for imparting an operation to said liquid ejecting head to normalize a state of the liquid in a liquid flow path for the liquid at least before liquid ejection start or at the time of non-ejection of the liquid.

According to a further aspect of the present invention, there is provided a liquid ejecting head for ejecting liquid using a bubble, comprising:

an ejection outlet for ejecting the liquid:

a bubble generating region for generating the bubble in the liquid:

a movable member which is disposed faced to said bubble generating region, and which is displaceable between a first position and a second position farther from the bubble generating region than the first position and which has a free end at a downstream side thereof;

wherein the movable member is displaced from said first position to said second position by pressure based on generation of the bubble in said bubble generating region, wherein said bubble expands more to the downstream side than to the upstream side with respect to a direction toward said ejection outlet by the displacement of said movable member, thus directing said bubble toward said ejection outlet to eject the liquid through the ejection outlet; and means for changing a state of said liquid by changing a temperature of said liquid.

According to a further aspcet of the present invention, there is provided a liquid ejecting head for ejecting liquid using a bubble, comprising:

an ejection outlet for ejecting the liquid:

a bubble generating region for generating the bubble in the liquid:

a movable member which is disposed faced to said bubble generating region, and which is displaceable between a first position and a second position farther from the bubble generating region than the first position and which has a free end at a downstream side thereof;

wherein the movable member is displaced from said first position to said second position by pressure based on generation of the bubble in said bubble generating region, wherein said bubble expands more to the downstream side than to the upstream side with respect to a direction toward said ejection outlet by the displacement of said movable member, thus directing said bubble toward said ejection outlet to eject the liquid through the ejection outlet; and liquid moving means for changing a state of said liquid by moving said liquid without ejecting said liquid.

According to a further aspect of the present invention, there is provided a liquid ejection apparatus for ejecting liquid, comprising:

a liquid ejecting head having an ejection outlet for ejecting the liquid, a bubble generating region where a bubble is generated in the liquid, a movable member which is disposed faced to said bubble generating region, and which is displaceable between a first position and a second position farther from the bubble generating region than the first position and which has a free end at a downstream side thereof;

wherein the movable member is displaced from said first position to said second position by pressure based on generation of the bubble in said bubble generating region, wherein said bubble expands more to the downstream side than to the upstream side with respect to a direction toward said ejection outlet by the displacement of said movable member, thus directing said bubble toward said ejection outlet to eject the liquid through the ejection outlet; and energy increasing means for making larger bubble generation energy for ejecting at least during a predetermined period from ejection start than thereafter.

According to a further aspect of the present invention, there is provided a liquid ejecting method for ejecting liquid using a bubble, comprising:

using a liquid ejecting head having an ejection outlet for ejecting the liquid, a bubble generating region where a bubble is generated in the liquid, a movable member which is disposed faced to said bubble generating region, and which is displaceable between a first position and a second position farther from the bubble generating region than the first position and which has a free end at a downstream side thereof;

wherein the movable member is displaced from said first position to said second position by pressure based on generation of the bubble in said bubble generating region, wherein said bubble expands more to the downstream side than to the upstream side with respect to a direction toward said ejection outlet by the displacement of said movable member, thus directing said bubble toward said ejection outlet to eject the liquid through the ejection outlet; and making larger bubble generation energy for ejecting at least during a predetermined period from ejection start than thereafter.

According to a further aspect of the present invention, there is provided a liquid ejecting apparatus for effecting recording by ejecting liquid, comprising:

a liquid ejecting head having an ejection outlet for ejecting the liquid, a bubble generating region where a bubble is generated in the liquid, a movable member which is disposed faced to said bubble generating region, and which is displaceable between a first position and a second position farther from the bubble generating region than the first position and which has a free end at a downstream side thereof;

wherein the movable member is displaced from said first position to said second position by pressure based on generation of the bubble in said bubble generating region, wherein said bubble expands more to the downstream side than to the upstream side with respect to a direction toward said ejection outlet by the displacement of said movable member, thus directing said bubble toward said ejection outlet to eject the liquid through the ejection outlet; and discharging means for discharging said liquid from the liquid flow path for the liquid to be ejected during a predetermined period in a non-ejection period at least before ejection start, using means partly constituting said liquid ejecting head.

means for changing a state of said liquid by changing a temperature of said liquid.

liquid moving means for changing a state of said liquid by moving said liquid without ejecting said liquid; and energy increasing means for making larger bubble generation energy for ejecting at least during a predetermined period from ejection start than thereafter.

In this specification, "upstream" and "downstream" are defined with respect to a general liquid flow from a liquid supply source to the ejection outlet through the bubble generation region (movable member).

As regards the bubble per se, the "downstream" is defined as toward the ejection outlet side of the bubble which directly function to eject the liquid droplet. More particularly, it generally means a downstream from the center of the bubble with respect to the direction of the general liquid flow, or a downstream from the center of the area of the heat generating element with respect to the same.

In this specification, "substantially sealed" generally means a sealed state in such a degree that when the bubble grows, the bubble does not escape through a gap (slit) around the movable member before motion of the movable member.

In this specification, "separation wall" may mean a wall (which may include the movable member) interposed to separate the region in direct fluid communication with the ejection outlet from the bubble generation region, and more specifically means a wall separating the flow path including the bubble generation region from the liquid flow path in direct fluid communication with the ejection outlet, thus preventing mixture of the liquids in the liquid flow paths.

In this specification, "upon 'non-ejection', 'non-printing' or 'non-recording'", means "when the liquid is not ejected for a period longer than a minimum ejection period (a reciprocal of the maximum ejection frequency) of repeated liquid ejections by bubble generations for the recording operation, in a nozzle. For example, it occurs in the not recording range in one line recording in a serial printer, in the sheet advancing period between lines, in the sheet feeding period between pages, in a temporary rest period waiting for recording instructions from a host computer, or in the off-state of the voltage source. Thus, it may mean a short or long period.

In this specification, "upon 'ejection start', 'print start', or 'record start'", covers a short period from start or resumption of the ejection, printing or recording after the non-ejection of a certain period.

While the invention has been described with reference to the structures disclosed herein, it is not confined to the details set forth and this application is intended to cover such modifications or changes as may come within the purposes of the improvements or the scope of the following claims.

BRIEF DESCRIPTION OF THE DRAWINGS

FIG. 25 is a flow chart of a recovery sequence of the process steps of FIG. 24, at the time of soft power ON.

FIG. 67 schematically shows a content of a table usable with the process shown in FIG. 66.

DESCRIPTION OF THE PREFERRED EMBODIMENTS (Ejection Fundamentals and Head Structure)

The description will be made as to fundamentals on the ejection of the liquid and the structure of the head. First, the description will be made as to an improvement in an ejection force and/or an ejection efficiency by controlling a direction of propagation of pressure resulting from generation of a bubble for ejecting the liquid and controlling a direction of growth of the bubble.

Figure 2:
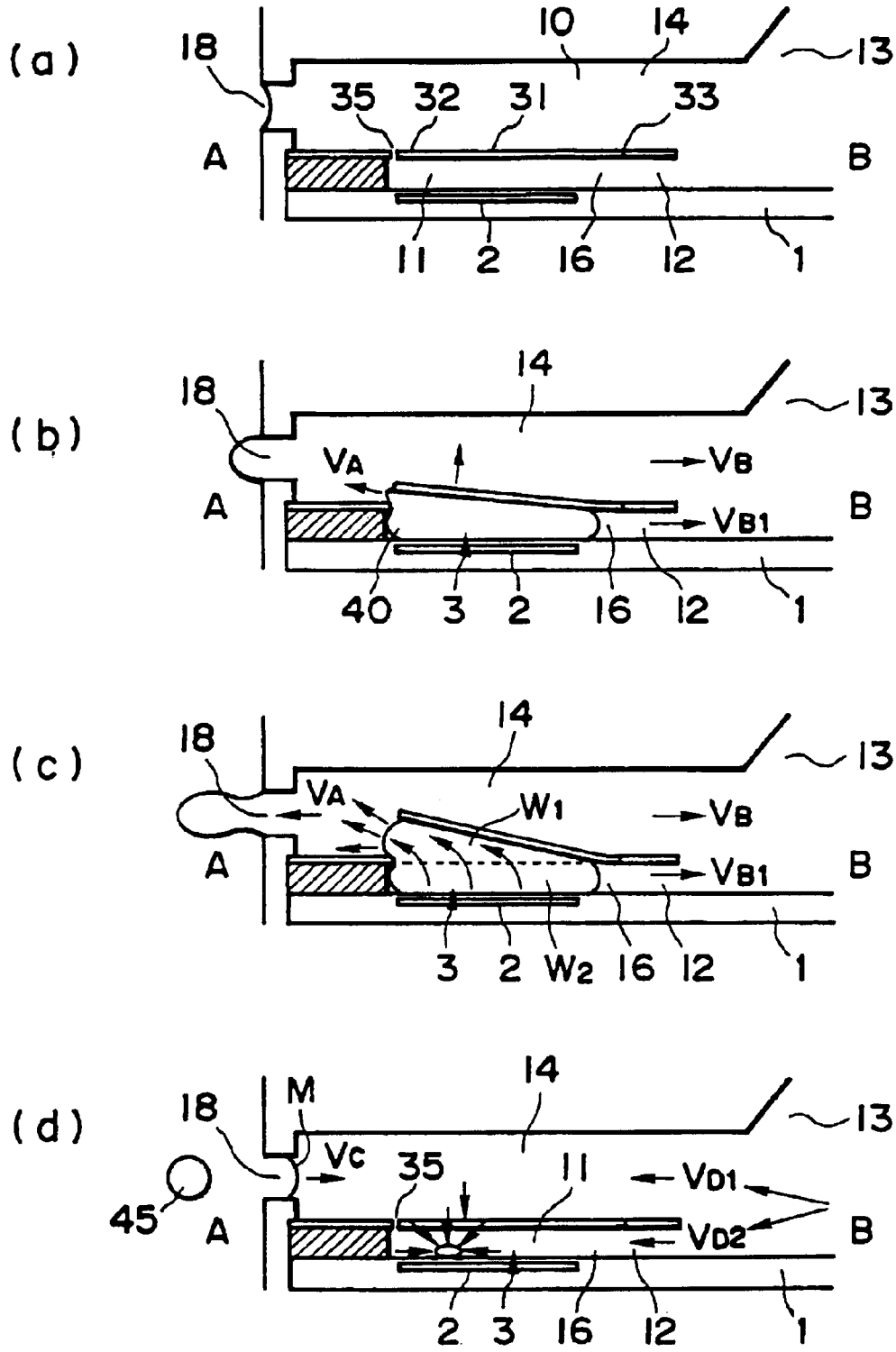
FIG. 2, consisting of FIGS. 2(*a*)–2(*d*), is a schematic sectional view showing an example of a liquid ejecting head using the liquid ejection principle applied to the present invention.
Figure 3:
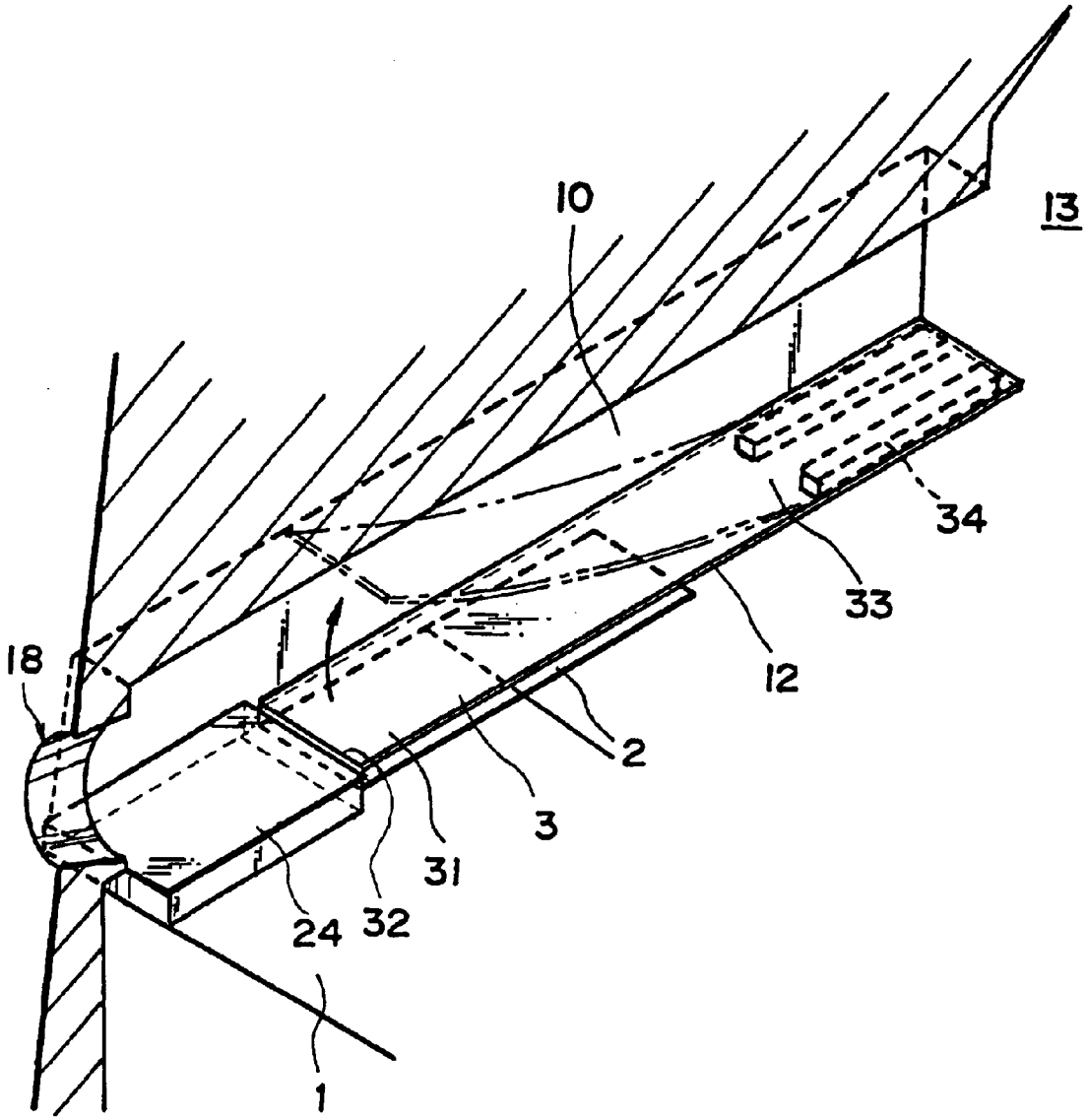
FIG. 3 is a partial partly broken perspective view of a liquid ejecting head using the liquid ejection principle applied to the present invention.

FIG. 2 is a schematic sectional view of a liquid ejecting head taken along a liquid flow path according to this embodiment, and FIG. 3 is a partly broken perspective view of the liquid ejecting head.

The liquid ejecting head of this embodiment comprises a heat generating element 2 (a heat generating resistor of 40 μm×105 μm in this embodiment) as the ejection energy generating element for supplying thermal energy to the liquid to eject the liquid, an element substrate 1 on which said heat generating element 2 is provided, and a liquid flow path 10 formed above the element substrate correspondingly to the heat generating element 2. The liquid flow path 10 is in fluid communication with a common liquid chamber 13 for supplying the liquid to a plurality of such liquid flow paths 10 which is in fluid communication with a plurality of the ejection outlets 18.

Above the element substrate in the liquid flow path 10, a movable member or plate 31 in the form of a cantilever of an elastic material such as metal is provided faced to the heat generating element 2. One end of the movable member is fixed to a foundation (supporting member) 34 or the like provided by patterning of photosensitivity resin material on the wall of the liquid flow path 10 or the element substrate. By this structure, the movable member is supported, and a fulcrum (fulcrum portion) is constituted.

The movable member 31 is so positioned that it has a fulcrum (fulcrum portion which is a fixed end) 33 in an upstream side with respect to a general flow of the liquid from the common liquid chamber 13 toward the ejection outlet 18 through the movable member 31 caused by the ejecting operation and that it has a free end (free end portion) 32 in a downstream side of the fulcrum 33. The movable member 31 is faced to the heat generating element 2 with a gap of 15 μm approx. as if it covers the heat generating element 2. A bubble generation region is constituted between the heat generating element and movable member. The type, configuration or position of the heat generating element or the movable member is not limited to the ones described above, but may be changed as long as the growth of the bubble and the propagation of the pressure can be controlled. For the purpose of easy understanding of the flow of the liquid which will be described hereinafter, the liquid flow path 10 is divided by the movable member 31 into a first liquid flow path 14 which is directly in communication with the ejection outlet 18 and a second liquid flow path 16 having the bubble generation region 11 and the liquid supply port 12.

By causing heat generation of the heat generating element 2, the heat is applied to the liquid in the bubble generation region 11 between the movable member 31 and the heat generating element 2, by which a bubble is generated by the film boiling phenomenon as disclosed in U.S. Pat. No. 4,723,129. The bubble and the pressure caused by the generation of the bubble act mainly on the movable member, so that the movable member 31 moves or displaces to widely open toward the ejection outlet side about the fulcrum 33, as shown in FIG. 2, (*b*) and (*c*) or in FIG. 3. By the displacement of the movable member 31 or the state after the displacement, the propagation of the pressure caused by the generation of the bubble and the growth of the bubble per se are directed toward the ejection outlet.

Here, one of the fundamental ejection principles according to the present invention will be described. One of important principles of this invention is that the movable member disposed faced to the bubble is displaced from the normal first position to the displaced second position on the basis of the pressure of the bubble generation or the bubble per se, and the displacing or displaced movable member 31 is effective to direct the pressure produced by the generation of the bubble and/or the growth of the bubble per se toward the ejection outlet 18 (downstream side).

Figure 4:
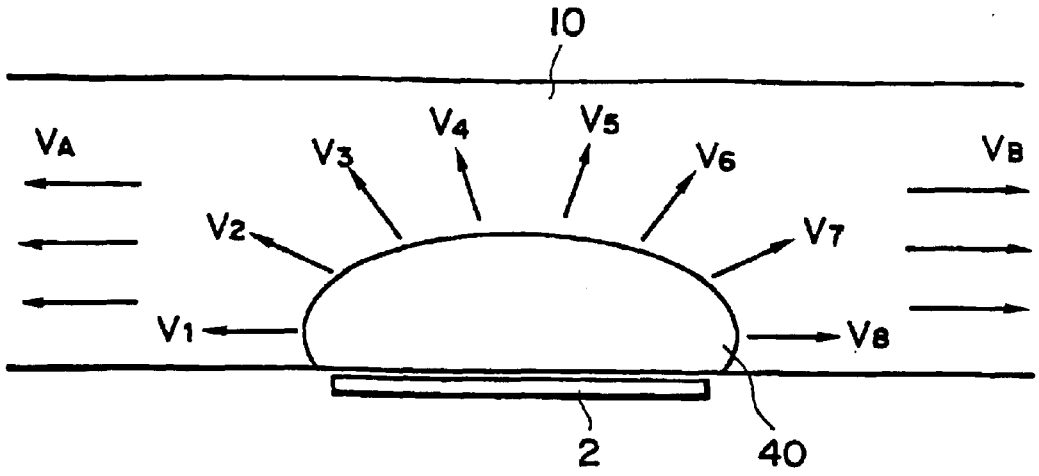
FIG. 4 is a schematic view showing pressure propagation from a bubble in a conventional liquid ejecting head.
Figure 5:
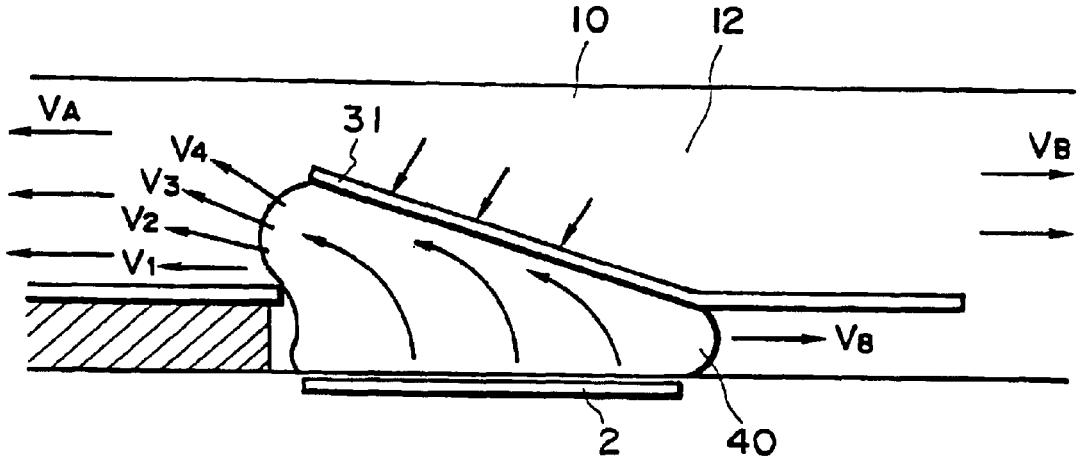
FIG. 5 is a schematic view showing pressure propagation of a bubble in a liquid ejecting head using the liquid ejection principle applied to the present invention.

More detailed description will be made with comparison between the conventional liquid flow passage structure not using the movable member (FIG. 4) and the present invention (FIG. 5). Here, the direction of propagation of the pressure toward the ejection outlet is indicated by $V_A$, and the direction of propagation of the pressure toward the upstream is indicated by $V_B$.

In a conventional head as shown in FIG. 4, there is not any structural element effective to regulate the direction of the propagation of the pressure produced by the bubble 40 generation. Therefore, the direction of the pressure propagation of the is normal to the surface of the bubble as indicated by V1–V8, and therefore, is widely directed in the passage. Among these directions, those of the pressure propagation from the half portion of the bubble closer to the ejection outlet (V1–V4) have the pressure components in the $V_A$ direction which is most effective for the liquid ejection. this portion is important since it directly contributable to the liquid ejection efficiency, the liquid ejection pressure and the ejection speed. Furthermore, the component V1 is closest to the direction of $V_A$ which is the ejection direction, and therefore, is most effective, and the V4 has a relatively small component in the direction $V_A$.

On the other hand, in the case of the present invention, shown in FIG. 5, the movable member 31 is effective to direct, to the downstream (ejection outlet side), the pressure propagation directions V1–V4 of the bubble which otherwise are toward various directions. Thus, the pressure propagations of bubble 40 are concentrated, so that the pressure of the bubble 40 is directly and efficiently contributable to the ejection.

The growth direction per se of the bubble is directed downstream similarly to to the pressure propagation directions V1–V4, and grow more in the downstream side than in the upstream side. Thus, the growth direction per se of the bubble is controlled by the movable member, and the pressure propagation direction from the bubble is controlled thereby, so that the ejection efficiency, ejection force and ejection speed or the like are fundamentally improved.

Referring back to FIG. 2, the ejecting operation of the liquid ejecting head in this embodiment will be described in detail.

FIG. 2, (*a*) shows a state before the energy such as electric energy is applied to the heat generating element 2, and therefore, no heat has yet been generated. It should be noted that the movable member 31 is so positioned as to be faced at least to the downstream portion of the bubble generated by the heat generation of the heat generating element. In other words, in order that the downstream portion of the bubble acts on the movable member, the liquid flow passage structure is such that the movable member 31 extends at least to the position downstream (downstream of a line passing through the center 3 of the area of the heat generating element and perpendicular to the length of the flow path) of the center 3 of the area of the heat generating element.

FIG. 2, (*b*) shows a state wherein the heat generation of heat generating element 2 occurs by the application of the electric energy to the heat generating element 2, and a part of of the liquid filled in the bubble generation region 11 is heated by the thus generated heat so that a bubble is generated through the film boiling.

At this time, the movable member 31 is displaced from the first position to the second position by the pressure produced by the generation of the bubble 40 so as to guide the propagation of the pressure toward the ejection outlet. It should be noted that, as described hereinbefore, the free end 32 of the movable member 31 is disposed in the downstream side (ejection outlet side), and the fulcrum 33 is disposed in the upstream side (common liquid chamber side), so that at least a part of the movable member is faced to the downstream portion of the bubble, that is, the downstream portion of the heat generating element.

FIG. 2, (*c*) shows a state in which the bubble 40 has further grown. By the pressure resulting from the bubble 40 generation, the movable member 31 is displaced further. The generated bubble grows more downstream than upstream, and it expands greatly beyond a first position (broken line position) of the movable member. Thus, it is understood that in accordance with the growth of the bubble 40, the movable member 31 gradually displaces, by which the pressure propagation direction of the bubble 40, the direction in which the volume movement is easy, namely, the growth direction of the bubble, are directed uniformly toward the ejection outlet, so that the ejection efficiency is increased. When the movable member guides the bubble and the bubble generation pressure toward the ejection outlet, it hardly obstructs propagation and growth, and can efficiently control the propagation direction of the pressure and the growth direction of the bubble in accordance with the degree of the pressure.

FIG. 2, (*d*) shows a state wherein the bubble 40 contracts and disappears by the decrease of the pressure in the bubble, peculiar to the film boiling phenomenon.

The movable member 31 having been displaced to the second position returns to the initial position (first position) of FIG. 2, (*a*) by the restoring force provided by the spring property of the movable member per se and the negative pressure due to the contraction of the bubble. Upon the collapse of bubble, the liquid flows back from the common liquid chamber side as indicated by $V_{D1}$ and $V_{D2}$ and from the ejection outlet side as indicated by $V_C$ so as to compensate for the volume reduction of the bubble in the bubble generation region 11 and to compensate for the volume of the ejected liquid.

In the foregoing, the description has been made as to the operation of the movable member with the generation of the bubble and the ejecting operation of the liquid. Now, the description will be made as to the refilling of the liquid in the liquid ejecting head of the present invention.

Referring to FIG. 2, liquid supply mechanism will be described.

When the bubble 40 enters the bubble collapsing process after the maximum volume thereof (FIG. 2, (*c*)), a volume of the liquid enough to compensate for the collapsing bubbling volume flows into the bubble generation region from the ejection outlet 18 side of the first liquid flow path 14 and from the bubble generation region of the second liquid flow path 16. In the case of conventional liquid flow passage structure not having the movable member 31, the amount of the liquid from the ejection outlet side to the bubble collapse position and the amount of the liquid from the common liquid chamber thereinto, are influenced by the flow resistances of the portion closer to the ejection outlet than the bubble generation region and the portion closer to the common liquid chamber (flow path resistance and the inertia of the liquid).

Therefore, when the flow resistance at the supply port side is smaller than the other side, a large amount of the liquid flows into the bubble collapse position from the ejection outlet side with the result that the meniscus retraction is large. With the reduction of the flow resistance in the ejection outlet for the purpose of increasing the ejection efficiency, the meniscus M retraction increases upon the collapse of bubble with the result of longer refilling time period, thus making high speed printing difficult.

According to this embodiment, because of the provision of the movable member 31, the meniscus retraction stops at the time when the movable member returns to the initial position upon the collapse of bubble, and thereafter, the supply of the liquid to fill a volume W2 is accomplished by the flow $V_{D2}$ through the second flow path 16 (W1 is a volume of an upper side of the bubble volume W beyond the first position of the movable member 31, and W2 is a volume of a bubble generation region 11 side thereof). In the prior art, a half of the volume of the bubble volume W is the volume of the meniscus retraction, but according to this embodiment, only about one half (W1) is the volume of the meniscus retraction.

Additionally, the liquid supply for the volume W2 is forced to be effected mainly from the upstream ($V_{D2}$) of the second liquid flow path along the surface of the heat generating element side of the movable member 31 using the pressure upon the collapse of bubble, and therefore, more speedy refilling action is accomplished.

When the refilling using the pressure upon the collapse of bubble is carried out in a conventional head, the vibration of the meniscus is expanded with the result of the deterioration of the image quality. However, according to this embodiment, the flows of the liquid in the first liquid flow path 14 at the ejection outlet side and the ejection outlet side of the bubble generation region 11 are suppressed, so that the vibration of the meniscus is reduced.

Thus, according to this embodiment, the high speed refilling is accomplished by the forced refilling to the bubble generation region through the liquid supply passage 12 of the second flow path 16 and by the suppression of the meniscus retraction and vibration. Therefore, the stabilization of ejection and high speed repeated ejections are accomplished, and when the embodiment is used in the field of recording, the improvement in the image quality and in the recording speed can be accomplished.

The embodiment provides the following effective function. It is a suppression of the propagation of the pressure to the upstream side (back wave) produced by the generation of the bubble. The pressure due to the common liquid chamber 13 side (upstream) of the bubble generated on the heat generating element 2 mostly has resulted in force which pushes the liquid back to the upstream side (back wave). The back wave deteriorates the refilling of the liquid into the liquid flow path by the pressure at the upstream side, the resulting motion of the liquid and the resulting inertia force. In this embodiment, these actions to the upstream side are suppressed by the movable member 31, so that the refilling performance is further improved.

The description will be made as to a further characterizing feature and the advantageous effect.

The second liquid flow path 16 of this embodiment has a liquid supply passage 12 having an internal wall substantially flush with the heat generating element 2 (the surface of the heat generating element is not greatly stepped down) at the upstream side of the heat generating element 2. With this structure, the supply of the liquid to the surface of the heat generating element 2 and the bubble generation region 11 occurs along the surface of the movable member 31 at the position closer to the bubble generation region 11 as indicated by $V_{D2}$. Accordingly, stagnation of the liquid on the surface of the heat generating element 2 is suppressed, so that precipitation of the gas dissolved in the liquid is suppressed, and the residual bubbles not disappeared are removed without difficulty, and in addition, the heat accumulation in the liquid is not too much. Therefore, the stabilized bubble generation can be repeated at a high speed. In this embodiment, the liquid supply passage 12 has a substantially flat internal wall, but this is not limiting, and the liquid supply passage is satisfactory if it has an internal wall with such a configuration smoothly extended from the surface of the heat generating element that the stagnation of the liquid occurs on the heat generating element, and eddy flow is not significantly caused in the supply of the liquid.

The supply of the liquid into the bubble generation region may occur through a gap at a side portion of the movable member (slit 35) as indicated by $V_{D1}$. In order to direct the pressure upon the bubble generation further effectively to the ejection outlet, a large movable member covering the entirety of the bubble generation region (covering the surface of the heat generating element) may be used, as shown in FIG. 2. Then, the flow resistance for the liquid between the bubble generation region 11 and the region of the first liquid flow path 14 close to the ejection outlet is increased by the restoration of the movable member to the first position, so that the flow of the liquid to the bubble generation region 11 along $V_{D1}$ can be suppressed. However, according to the head structure of this embodiment, there is a flow effective to supply the liquid to the bubble generation region, the supply performance of the liquid is greatly increased, and therefore, even if the movable member 31 covers the bubble generation region 11 to improve the ejection efficiency, the supply performance of the liquid is not deteriorated.

Figure 6:
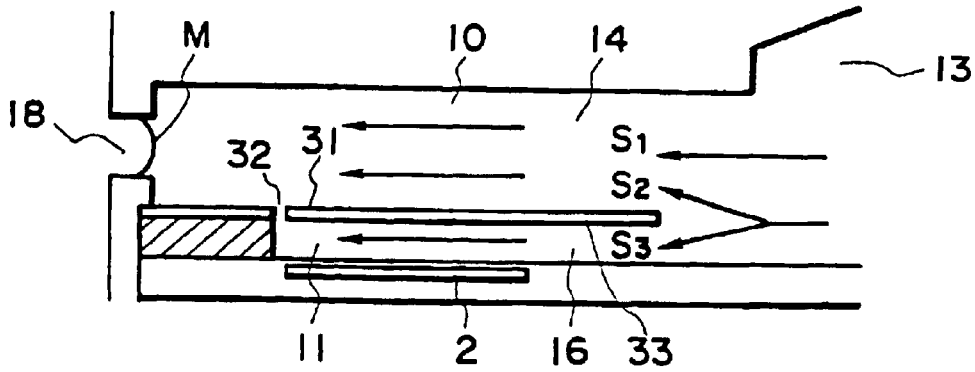
FIG. 6 shows flow of liquid in liquid ejecting head using the liquid ejection principle applied to the present invention.

The positional relation between the free end 32 and the fulcrum 33 of the movable member 31 is such that the free end is at a downstream position of the fulcrum as indicated by 6 in the Figure, for example. With this structure, the function and effect of guiding the pressure propagation direction and the direction of the growth of the bubble to the ejection outlet side or the like can be efficiently assured upon the bubble generation. Additionally, the positional relation is effective to accomplish not only the function or effect relating to the ejection but also the reduction of the flow resistance through the liquid flow path 10 upon the supply of the liquid thus permitting the high speed refilling. When the meniscus M retracted b the ejection as shown in FIG. 6, returns to the ejection outlet 18 by capillary force or when the liquid supply is effected to compensate for the collapse of bubble, the positions of the free end and the fulcrum 33 are such that the flows $S_1$, $S_2$ and $S_3$ through the liquid flow path 10 including the first liquid flow path 14 and the second liquid flow path 16, are not impeded.

More particularly, in this embodiment, as described hereinbefore, the free end 32 of the movable member 3 is faced to a downstream position of the center 3 of the area which divides the heat generating element 2 into an upstream region and a downstream region (the line passing through the center (central portion) of the area of the heat generating element and perpendicular to a direction of the length of the liquid flow path). The movable member 31 receives the pressure and the bubble which are greatly contributable to the ejection of the liquid at the downstream side of the area center position 3 of the heat generating element, and it guides the force to the ejection outlet side, thus fundamentally improving the ejection efficiency or the ejection force.

Further advantageous effects are provided using the upstream side of the bubble, as described hereinbefore.

Furthermore, it is considered that in the structure of this embodiment, the instantaneous mechanical movement of the free end of the movable member 31, contributes to the ejection of the liquid.

Figure 7:
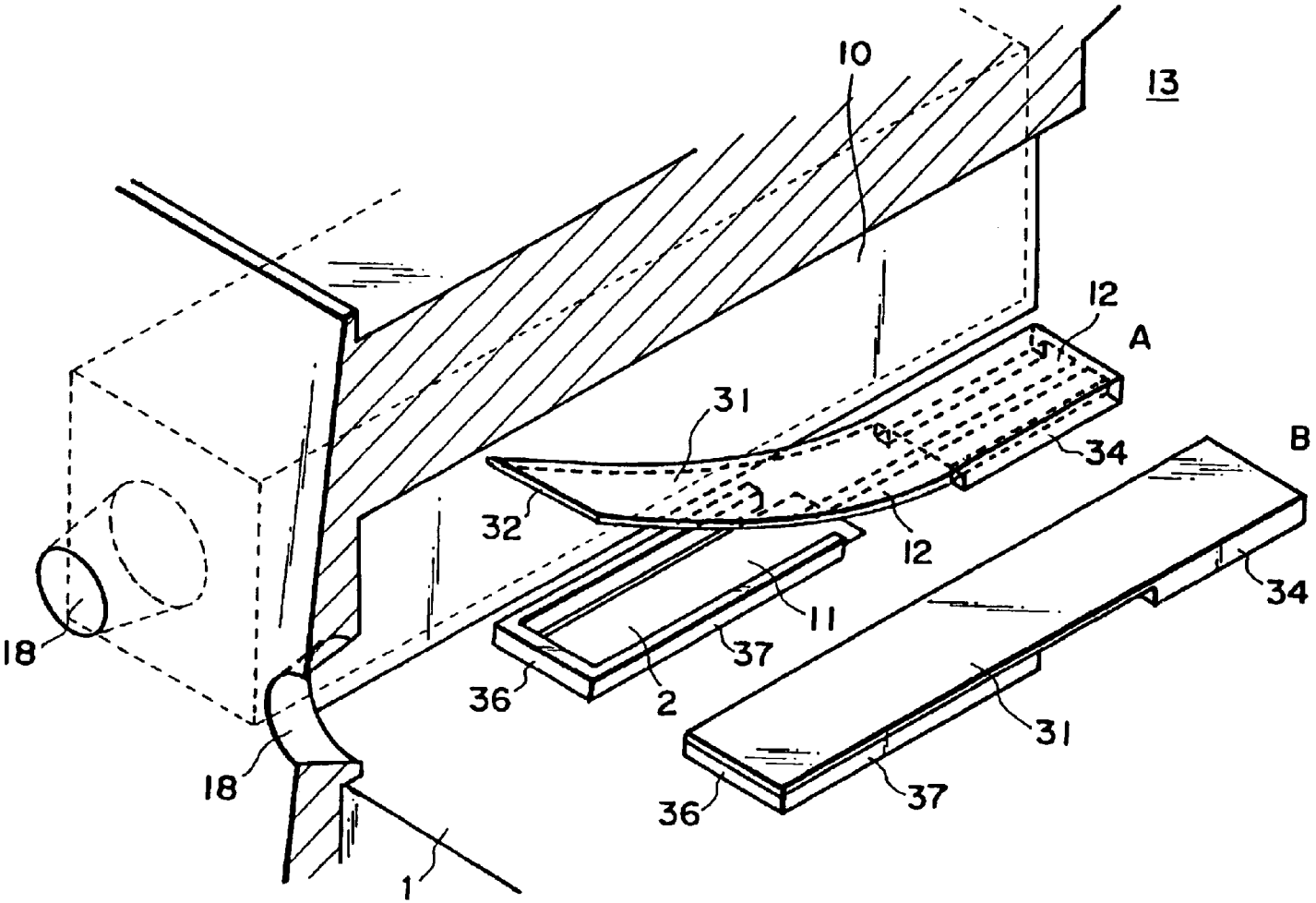
FIG. 7 is a partial partly broken perspective view showing a second example of a liquid ejecting head using the liquid ejection principle applied to the present invention.

FIG. 7 shows a second embodiment. In FIG. 7, A shows a displaced movable member although bubble is not shown, and B shows the movable member in the initial position (first position) wherein the bubble generation region 11 is substantially sealed relative to the ejection outlet 18. Although not shown, there is a flow passage wall between A and B to separate the flow paths.

A foundation 34 is provided at each side, and between them, a liquid supply passage 12 is constituted. With this structure, the liquid can be supplied along a surface of the movable member faced to the heat generating element side and from the liquid supply passage having a surface substantially flush with the surface of the heat generating element or smoothly continuous therewith.

When the movable member 31 is at the initial position (first position), the movable member 31 is close to or closely contacted to a downstream wall 36 disposed downstream of the heat generating element 2 and heat generating element side walls 37 disposed at the sides of the heat generating element, so that the ejection outlet 18 side of the bubble generation region 11 is substantially sealed. Thus, the pressure produced by the bubble at the time of the bubble generation and particularly the pressure downstream of the bubble, can be concentrated on the free end side side of the movable member, without releasing the pressure.

In the process of the collapse of bubble, the movable member 31 returns to the first position, and the ejection outlet side of the bubble generation region 31 is substantially sealed, and therefore, the meniscus retraction is suppressed, and the liquid supply to the heat generating element is carried out with the advantages described hereinbefore. As regards the refilling, the same advantageous effects can be provided as in the foregoing embodiment.

In this embodiment, the foundation 34 for supporting and fixing the movable member 31 is provided at an upstream position away from the heat generating element 2, as shown in FIG. 3 and FIG. 7, and the foundation 34 has a width smaller than the liquid flow path 10 to supply the liquid to the liquid supply passage 12. The configuration of the foundation 34 is not limited to this structure, but may be anyone if smooth refilling is accomplished.

In this embodiment, the clearance between the movable member 31 and the clearance is 15 $\mu$m approx., but the distance may be changed as long as the pressure produced by the bubble generation is sufficiently propagated to the movable member.

Figure 8:
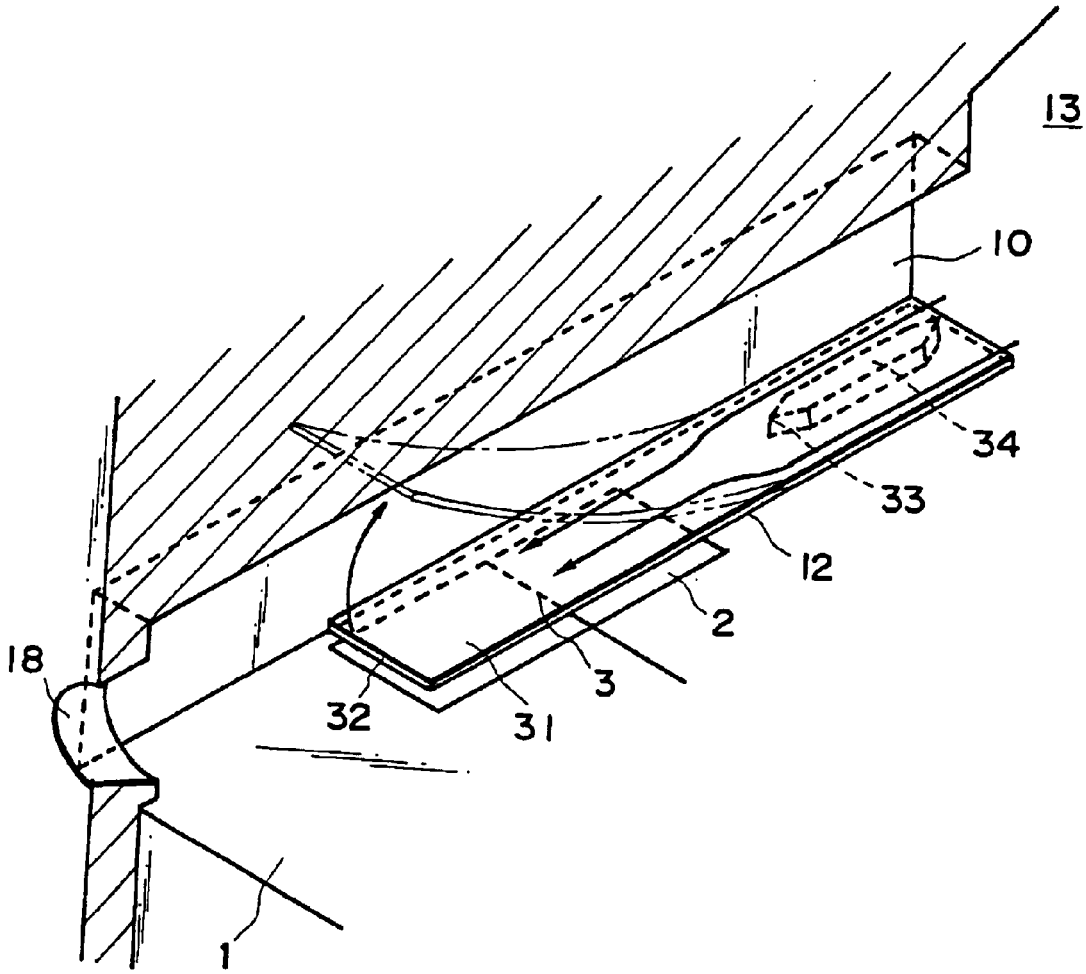
FIG. 8 is a partial partly broken perspective view showing a third example of a liquid ejecting head using the liquid ejection principle applied to the present invention.

FIG. 8 shows one of the fundamental aspects of the present invention. FIG. 8 shows a positional relation among a bubble generation region, bubble and the movable member in one liquid flow path to further describe the liquid ejecting method and the refilling method according to an aspect of the present invention.

In the above described embodiment, the pressure by the generated bubble is concentrated on the free end of the movable member to accomplish the quick movement of the movable member and the concentration of the movement of the bubble to the ejection outlet side. In this embodiment, the bubble is relatively free, while a downstream portion of the bubble which is at the ejection outlet side directly contributable to the droplet ejection, is regulated by the free end side of the movable member.

More particularly, the projection (hatched portion) functioning as a barrier provided on the heat generating element substrate 1 of FIG. 3 is not provided in this embodiment. The free end region and opposite lateral end regions of the movable member do not substantially seal the bubble generation region relative to the ejection outlet region, but it opens the bubble generation region to the ejection outlet region, in this embodiment.

In this example, the growth of the bubble is permitted at the downstream leading end portion of the downstream portions having direct function for the liquid droplet ejection, and therefore, the pressure component is effectively used for the ejection. Additionally, the upward pressure in this downstream portion (component forces $V_{B2}$, $V_{B3}$ and $V_{B4}$) acts such that the free end side portion of the movable member is added to the growth of the bubble at the leading end portion. Therefore, the ejection efficiency is improved similarly to the foregoing embodiments. As compared with the embodiment, this embodiment is better in the responsivity to the driving of the heat generating element.

The structure of this embodiment is simple, and therefore, the manufacturing is easy.

The fulcrum portion of the movable member 31 of this embodiment is fixed on one foundation 34 having a width smaller than that of the surface of the movable member. Therefore, the liquid supply to the bubble generation region 11 upon the collapse of bubble occurs along both of the lateral sides of the foundation (indicated by an arrow). The foundation may be in another form if the liquid supply performance is assured.

In the case of this embodiment, the existence of the movable member is effective to control the flow into the bubble generation region from the upper part upon the collapse of bubble, the refilling for the supply of the liquid is better than the conventional bubble generating structure having only the heat generating element. The retraction of the meniscus is also decreased thereby.

In a preferable modified embodiment of the third embodiment, both of the lateral sides (or only one lateral side) are substantially sealed for the bubble generation region 11. With such a structure, the pressure toward the lateral side of the movable member is also directed to the ejection outlet side end portion, so that the ejection efficiency is further improved.

The description will be made as to another example.

The ejection principle for the liquid in this embodiment is the same as in the foregoing embodiment. The liquid flow path has a multi-passage structure, and the liquid (bubble generation liquid) for bubble generation by the heat, and the liquid (ejection liquid) mainly ejected, are separated.

Figure 9:
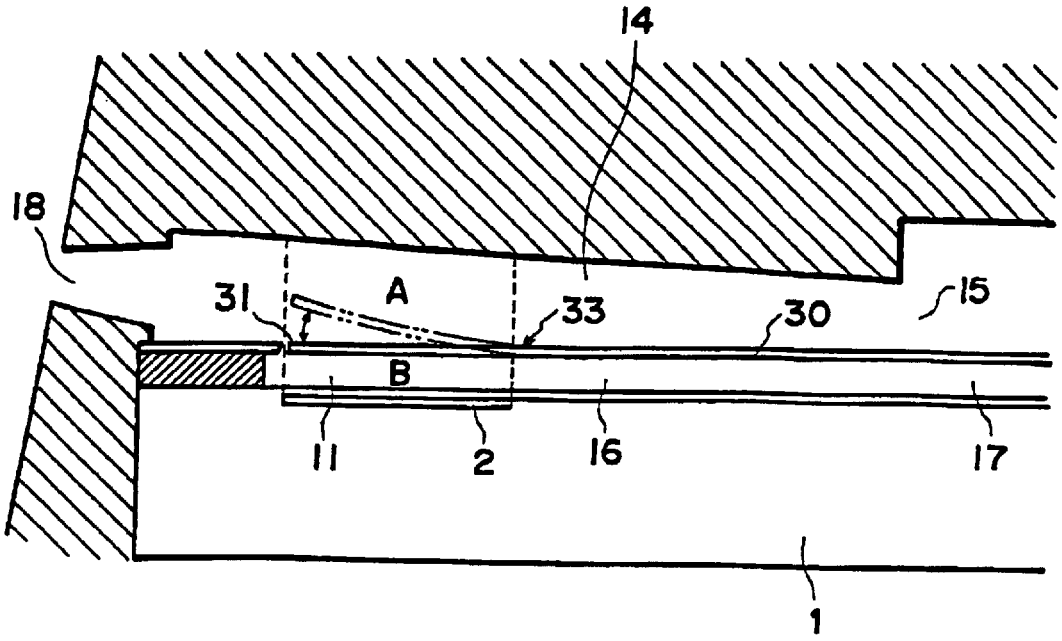
FIG. 9 is a partial partly broken perspective view of an example of a 2 flow path type liquid ejecting head using the liquid ejection principle applied to the present invention.
Figure 10:
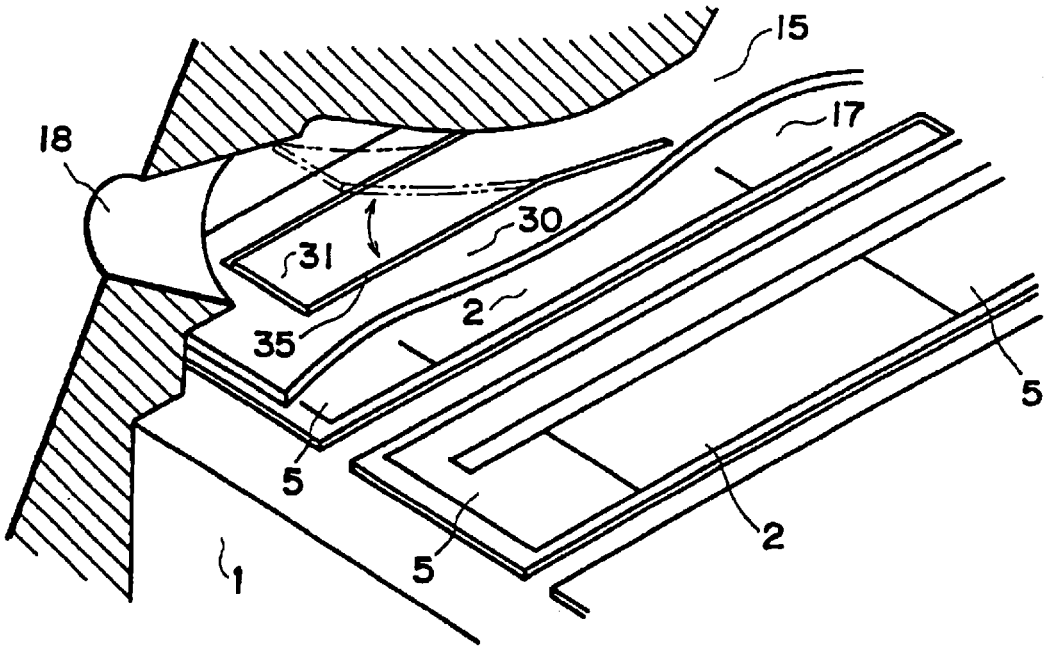
FIG. 10 is a portion partly broken perspective view showing an example of a 2 flow path type liquid ejecting head using the liquid ejection principle applied to the present invention.

FIG. 9 is a sectional schematic view in a direction along the flow path of the liquid ejecting head of this embodiment. FIG. 10 is a perspective view thereof.

In the liquid ejecting head of this embodiment, a second liquid flow path 16 for the bubble generation is provided on the element substrate 1 which is provided with a heat generating element 2 for supplying thermal energy for generating the bubble in the liquid, and a first liquid flow path 14 for the ejection liquid in direct communication with the ejection outlet 18 is formed thereabove.

The upstream side of the first liquid flow path is in fluid communication with a first common liquid chamber 15 for supplying the ejection liquid into a plurality of first liquid flow paths, and the upstream side of the second liquid flow path is in fluid communication with the second common liquid chamber for supplying the bubble generation liquid to a plurality of second liquid flow paths.

In the case that the bubble generation liquid and ejection liquid are the same liquids, the number of the common liquid chambers may be one.

Between the first and second liquid flow paths, there is a separation wall 30 of an elastic material such as metal so that the first flow path and the second flow path are separated. In the case that mixing of the bubble generation liquid and the ejection liquid should be minimum, the first liquid flow path 14 and the second liquid flow path 16 are preferably isolated by the partition wall. However, when the mixing to a certain extent is permissible, the complete isolation is not inevitable.

A portion of the partition wall in the upward projection space of the heat generating element (ejection pressure generation region including A and B (bubble generation region 11) in FIG. 10), is in the form of a cantilever movable member 31, formed by slits 35, having a fulcrum 33 at the common liquid chamber (15, 17) side and free end at the ejection outlet side (downstream with respect to the general flow of the liquid). The movable member 31 is faced to the surface, and therefore, it operates to open toward the ejection outlet side of the first liquid flow path upon the bubble generation of the bubble generation liquid (direction of the arrow in the Figure). In an example of FIG. 11, too, a partition wall 30 is disposed, with a space for constituting a second liquid flow path, above an element substrate 1 provided with a heat generating resistor portion as the heat generating element 2 and wiring electrodes 5 for applying an electric signal to the heat generating resistor portion.

As for the positional relation among the fulcrum 33 and the free end 32 of the movable member 31 and the heat generating element, are the same as in the previous example.

In the previous example, the description has been made as to the relation between the structures of the liquid supply passage 12 and the heat generating element 2. The relation between the second liquid flow path 16 and the heat generating element 2 is the same in this embodiment.

Figure 11:
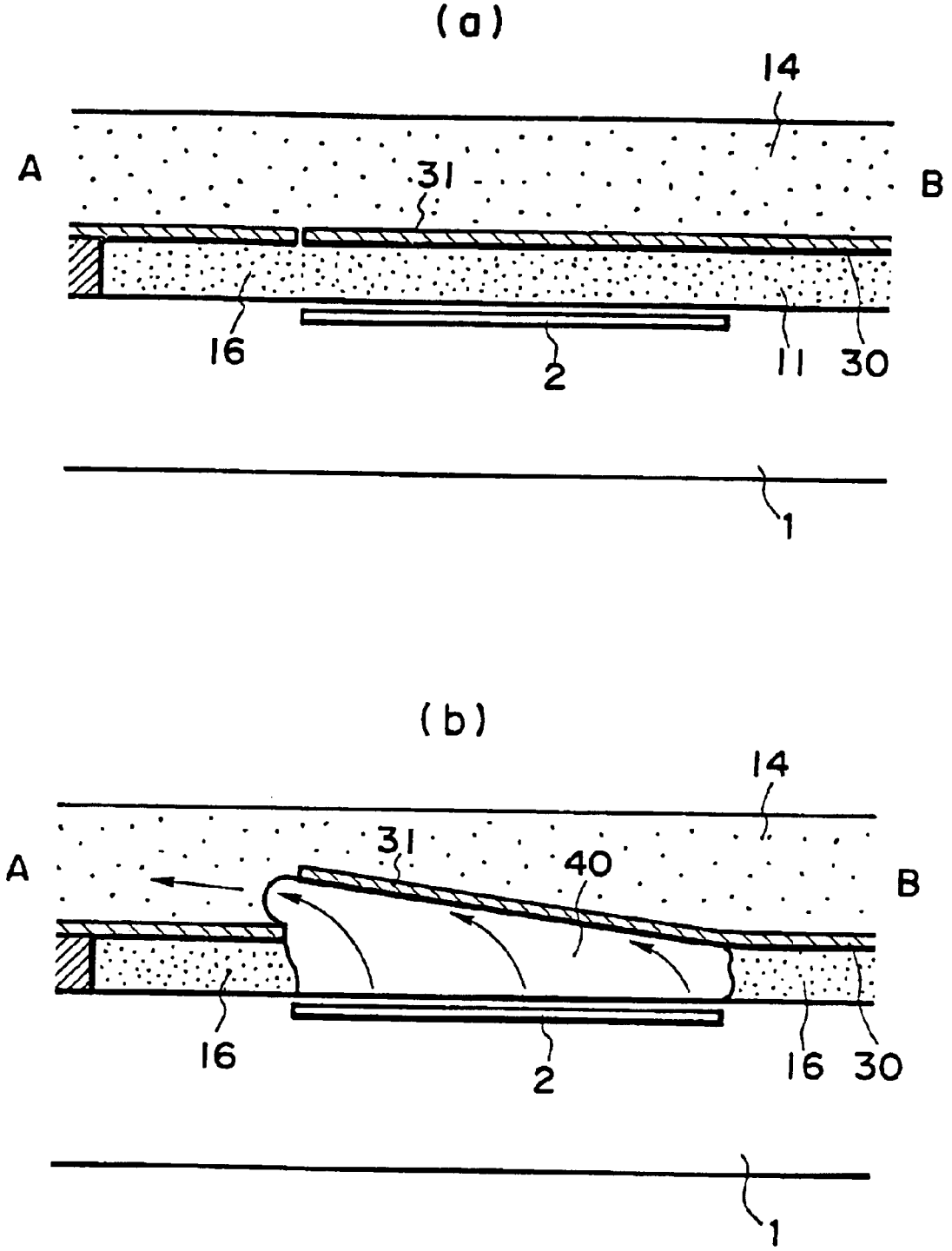
FIG. 11, consisting of FIGS. 11(*a*) and 11(*b*), illustrates an operation of a movable member.

Referring to FIG. 11, the operation of the liquid ejecting head of this embodiment will be described.

The used ejection liquid in the first liquid flow path 14 and the used bubble generation liquid in the second liquid flow path 16 were the same water base inks.

By the heat generated by the heat generating element 2, the bubble generation liquid in the bubble generation region in the second liquid flow path generates a bubble 40, by film boiling phenomenon as described hereinbefore.

In this embodiment, the bubble generation pressure is not released in the three directions except for the upstream side in the bubble generation region, so that the pressure produced by the bubble generation is propagated concentratedly on the movable member 6 side in the ejection pressure generation portion, by which the movable member 6 is displaced from the position indicated in FIG. 11, (*a*) toward the first liquid flow path side as indicated in FIG. 11, (*b*) with the growth of the bubble. By the operation of the movable member, the first liquid flow path 14 and the second liquid flow path 16 are in wide fluid communication with each other, and the pressure produced by the generation of the bubble is mainly propagated toward the ejection outlet in the first liquid flow path (direction A). By the propagation of the pressure and the mechanical displacement of the movable member, the liquid is ejected through the ejection outlet.

Then, with the contraction of the bubble, the movable member 31 returns to the position indicated in FIG. 11, (*a*), and correspondingly, an amount of the liquid corresponding to the ejection liquid is supplied from the upstream in the first liquid flow path 14. In this embodiment, the direction of the liquid supply is codirectional with the closing of the movable member as in the foregoing embodiments, the refilling of the liquid is not impeded by the movable member.

The major functions and effects as regards the propagation of the bubble generation pressure with the displacement of the movable wall, the direction of the bubble growth, the prevention of the back wave and so on, in this embodiment, are the same as with the first embodiment, but the two-flow-path structure is advantageous in the following points.

The ejection liquid and the bubble generation liquid may be separated, and the ejection liquid is ejected by the pressure produced in the bubble generation liquid. Accordingly, a high viscosity liquid such as polyethylene glycol or the like with which bubble generation and therefore ejection force is not sufficient by heat application, and which has not been ejected in good order, can be ejected. For example, this liquid is supplied into the first liquid flow path, and liquid with which the bubble generation is in good order is supplied into the second path as the bubble generation liquid. An example of the bubble generation liquid a mixture liquid (1–2 cP approx.) of the anol and water (4:6). By doing so, the ejection liquid can be properly ejected.

Additionally, by selecting as the bubble generation liquid a liquid with which the deposition such as kogation does not remain on the surface of the heat generating element even upon the heat application, the bubble generation is stabilized to assure the proper ejections. The above-described effects in the foregoing embodiments are also provided in this embodiment, the high viscous liquid or the like can be ejected with a high ejection efficiency and a high ejection pressure.

Furthermore, liquid which is not durable against heat is ejectable. In this case, such a liquid is supplied in the first liquid flow path as the ejection liquid, and a liquid which is not easily altered in the property by the heat and with which the bubble generation is in good order, is supplied in the second liquid flow path. By doing so, the liquid can be ejected without thermal damage and with high ejection efficiency and with high ejection pressure.

In the foregoing, the description has been made as to the major parts of the liquid ejecting head and the liquid ejecting method according to the embodiments of the present invention. The description will now be made as to further detailed embodiments usable with the foregoing embodiments. The following examples are usable with both of the single-flow-path type and two-flow-path type without specific statement.

<Liquid Flow Path Ceiling Configuration>

Figure 12:
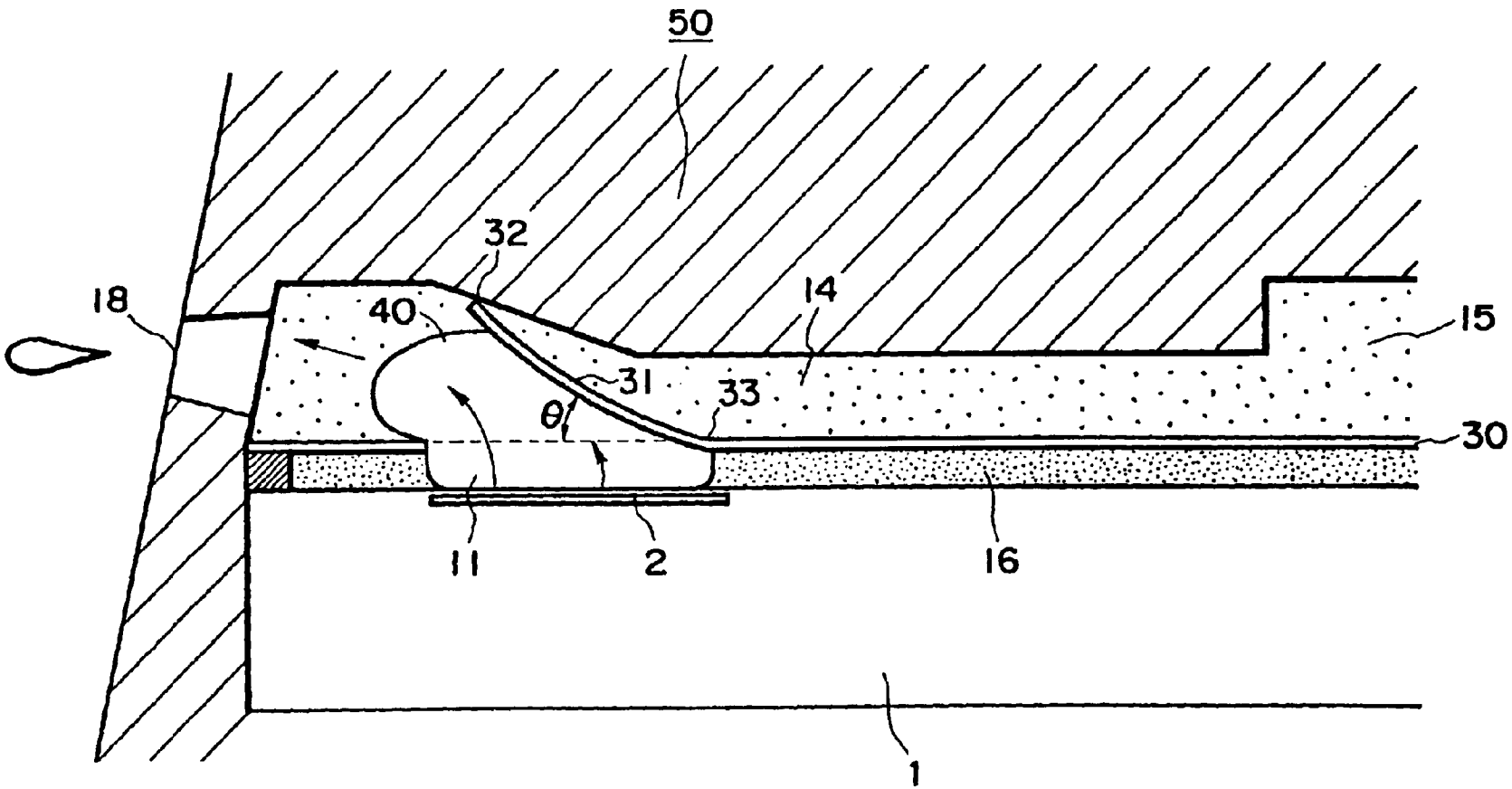
FIG. 12 illustrates a structure of a movable member and a first liquid flow path.

FIG. 12 is a sectional view taken along the length of the flow path of the liquid ejecting head according to the embodiment. Grooves for constituting the first liquid flow paths 14 (or liquid flow paths 10 in FIG. 2) are formed in grooved member 50 on a partition wall 30. In this embodiment, the height of the flow path ceiling adjacent the free end 32 position of the movable member is greater to permit larger operation angle θ of the movable member. The operation range of the movable member is determined in consideration of the structure of the liquid flow path, the durability of the movable member and the bubble generation power or the like. It is desirable that it moves in the angle range wide enough to include the angle of the position of the ejection outlet.

As shown in this Figure, the displaced level of the free end of the movable member is made higher than the diameter of the ejection outlet, by which sufficient ejection pressure is transmitted. As shown in this Figure, a height of the liquid flow path ceiling at the fulcrum 33 position of the movable member is lower than that of the liquid flow path ceiling at the free end 32 position of the movable member, so that the release of the pressure wave to the upstream side due to the displacement of the movable member can be further effectively prevented.

<Positional Relation Between Second Liquid Flow Path and Movable Member>

Figure 13:
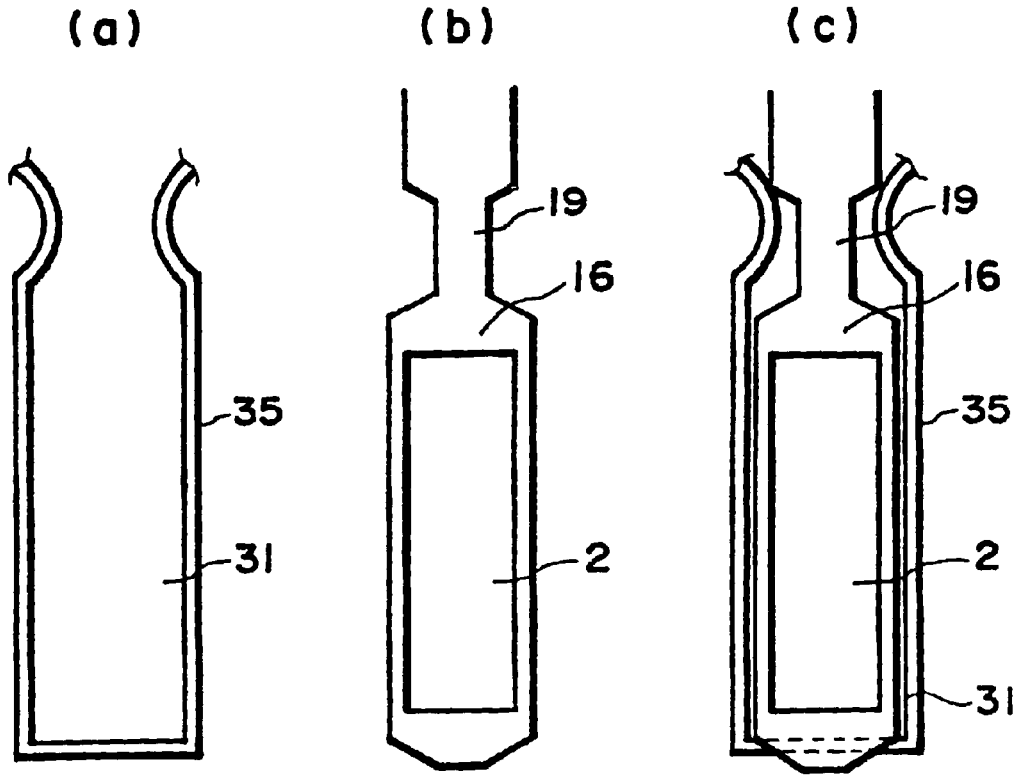
FIG. 13, consisting of FIGS. 13(*a*)–13(*c*), illustrates structures of a movable member and liquid flow path.
Figure 14:
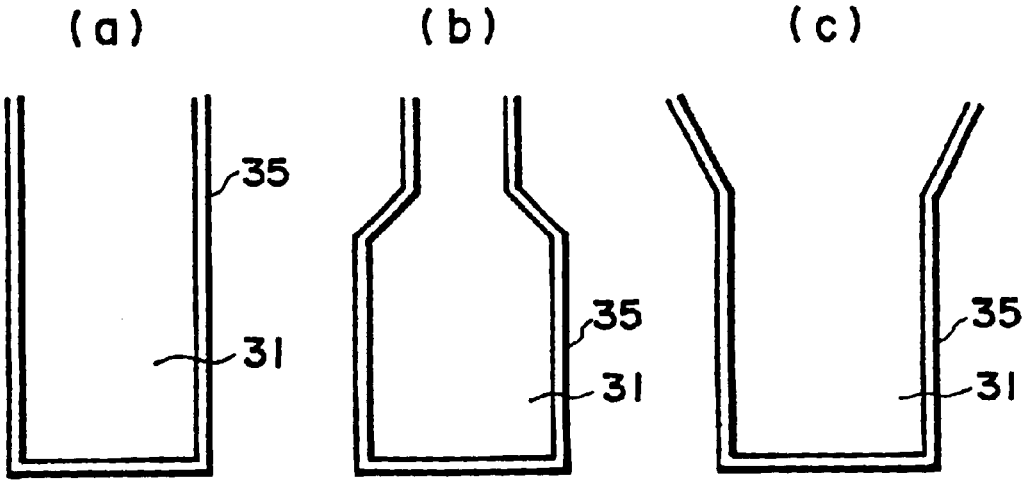
FIG. 14, consisting of FIGS. 14(*a*)–14(*c*), illustrates another configuration of the movable member.

FIG. 13 is an illustration of a positional relation between the above-described movable member 31 and second liquid flow path 16, and (*a*) is a view of the movable member 31 position of the partition wall 30 as seen from the above, and (*b*) is a view of the second liquid flow path 16 seen from the above without partition wall 30. FIG. 14, (*c*) is a schematic view of the positional relation between the movable member 6 and the second liquid flow path 16 wherein the elements are overlaid. In these Figures, the bottom is a front side having the ejection outlets.

The second liquid flow path 16 of this embodiment has a throat portion 19 upstream of the heat generating element 2 with respect to a general flow of the liquid from the second common liquid chamber side to the ejection outlet through th heat generating element position, the movable member position along the first flow path, so as to provide a chamber (bubble generation chamber) effective to suppress easy release, toward the upstream side, of the pressure produced upon the bubble generation in the second liquid flow path 16.

In the case of the conventional head wherein the flow path where the bubble generation occurs and the flow path from which the liquid is ejected, are the same, a throat portion may be provided to prevent the release of the pressure generated by the heat generating element toward the liquid chamber. In such a case, the cross-sectional area of the throat portion should not be too small in consideration of the sufficient refilling of the liquid.

However, in the case of this embodiment, much or most of the ejected liquid is from the first liquid flow path, and the bubble generation liquid in the second liquid flow path having the heat generating element is not consumed much, so that the filling amount of the bubble generation liquid to the bubble generation region 11 may be small. Therefore, the clearance at the throat portion 19 can be made very small, for example, as small as several μm-ten and several μm, so that the release of the pressure produced in the second liquid flow path can be further suppressed and to further concentrate it to the movable member side. The pressure can be used as the ejection pressure through the movable member 31, and therefore, the high ejection energy use efficiency and ejection pressure can be accomplished. The configuration of the second liquid flow path 16 is not limited to the one described above, but may be any if the pressure produced by the bubble generation is effectively transmitted to the movable member side.

As shown in FIG. 13, (*c*), the lateral sides of the movable member 31 cover respective parts of the walls constituting the second liquid flow path so that the falling of the movable member 31 into the second liquid flow path is prevented. By doing so, the above-described separation between the ejection liquid and the bubble generation liquid is further enhanced. Furthermore, the release of the bubble through the slit can be suppressed so that ejection pressure and ejection efficiency are further increased. Moreover, the above-described effect of the refilling from the upstream side by the pressure upon the collapse of bubble, can be further enhanced.

In FIG. 11, (*b*) and FIG. 12, a part of the bubble generated in the bubble generation region of the second liquid flow path 4 with the displacement of the movable member 6 to the first liquid flow path 14 side, extends into the first liquid flow path 14 side, by selecting the height of the second flow path to permit such extension of the bubble, the ejection force is further improved as compared with the case without such extension of the bubble. To provide such extending of the bubble into the first liquid flow path 14, the height of the second liquid flow path 16 is preferably lower than the height of the maximum bubble, more particularly, the height is preferably several μm-30 μm, for example. In this example, the height is 15 μm.

<Movable Member and Partition Wall>

Figure 15:
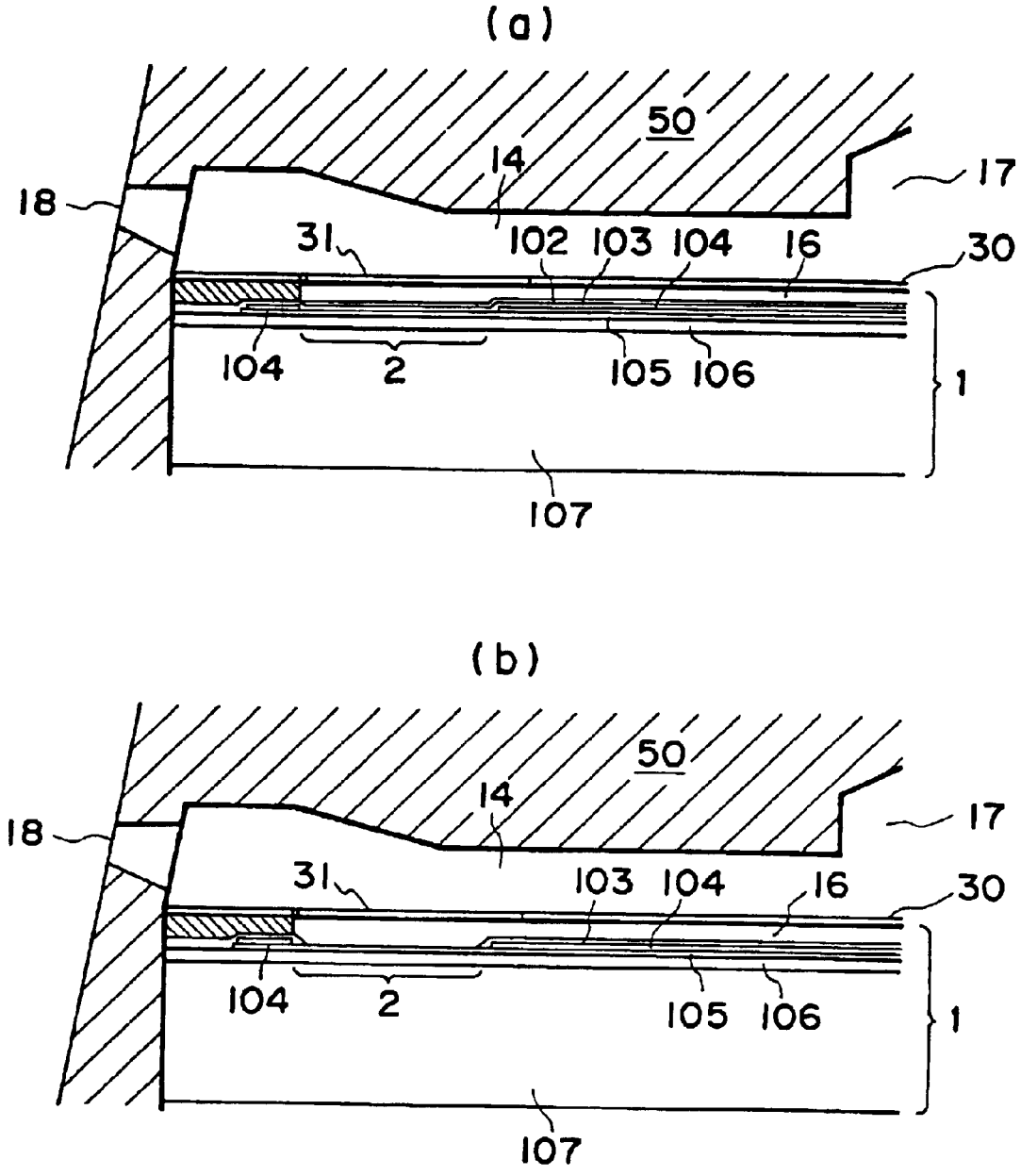
FIG. 15, consisting of FIGS. 15(*a*) and 15(*b*), is a longitudinal sectional view of a liquid ejecting head using the liquid ejection principle applied to the present invention.
Figure 16:
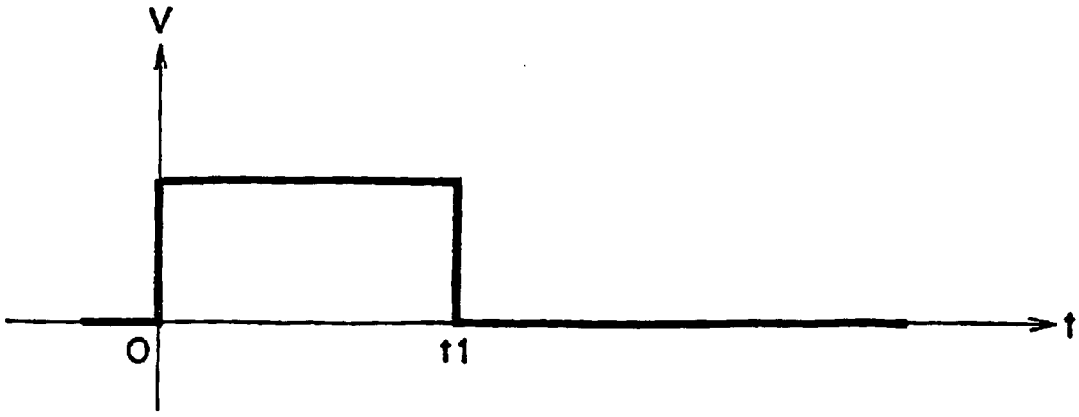
FIG. 16 is a schematic view showing a configuration of a driving pulse for effecting bubble generation.

FIG. 14 shows another example of the movable member 31, wherein reference numeral 35 designates a slit formed in the partition wall, and the slit is effective to provide the movable member 31. In FIG. 15, (*a*), the movable member has a rectangular configuration, and in (*b*), it is narrower in the fulcrum side to permit increased mobility of the movable member, and in (*c*), it has a wider fulcrum side to enhance the durability of the movable member. The configuration narrowed and arcuated at the fulcrum side is desirable as shown in FIG. 14, (*a*), since both of easiness of motion and durability are satisfied. However, the configuration of the movable member is not limited to the one described above, but it may be any if it does not enter the second liquid flow path side, and motion is easy with high durability.

In the foregoing embodiments, th plate or film movable member 31 and the separation wall 5 having this movable member was made of a nickel having a thickness of 5 μm, but this is not limited to this example, but it may be any if it has anti-solvent property against the bubble generation liquid and the ejection liquid, and if the elasticity is enough to permit the operation of the movable member, and if the required fine slit can be formed.

Preferable examples of the materials for the movable member include durable materials such as metal such as silver, nickel, gold, iron, titanium, aluminum, platinum, tantalum, stainless steel, phosphor bronze or the like, alloy thereof, or resin material having nytril group such as acrylonitrile, butadiene, stylene or the like, resin material having amide group such as polyamide or the like, resin material having carboxyl such as polycarbonate or the like, resin material having aldehyde group such as polyacetal or the like, resin material having sulfon group such as polysulfone, resin material such as liquid crystal polymer or the like, or chemical compound thereof; or materials having durability against the ink, such as metal such as gold, tungsten, tantalum, nickel, stainless steel, titanium, alloy thereof, materials coated with such metal, resin material having amide group such as polyamide, resin material having aldehyde group such as polyacetal, resin material having ketone group such as polyetheretherketone, resin material having imide group such as polyimide, resin material having hydroxyl group such as phenolic resin, resin material having ethyl group such as polyethylene, resin material having alkyl group such as polypropylene, resin material having epoxy group such as epoxy resin material, resin material having amino group such as melamine resin material, resin material having methylol group such as xylene resin material, chemical compound thereof, ceramic material such as silicon dioxide or chemical compound thereof.

Preferable examples of partition or division wall include resin material having high heat-resistive, high anti-solvent property and high molding property, more particularly recent engineering plastic resin materials such as polyethylene, polypropylene, polyamide, polyethylene terephthalate, melamine resin material, phenolic resin, epoxy resin material, polybutadiene, polyurethane, polyetheretherketone, polyether sulfone, polyallylate, polyimide, polysulfone, liquid crystal polymer (LCP), or chemical compound thereof, or metal such as silicon dioxide, silicon nitride, nickel, gold, stainless steel, alloy thereof, chemical compound thereof, or materials coated with titanium or gold.

The thickness of the separation wall is determined depending on the used material and configuration from the standpoint of sufficient strength as the wall and sufficient operativity as the movable member, and generally, 0.5 μm–10 μm approx. is desirable.

The width of the slit 35 for providing the movable member 31 is 2 μm in the embodiments. When the bubble generation liquid and ejection liquid are different materials, and mixture of the liquids is to be avoided, the gap is determined so as to form a meniscus between the liquids, thus avoiding mixture therebetween. For example, when the bubble generation liquid has a viscosity about 2 cP, and the ejection liquid has a viscosity not less than 100 cP, 5 μm approx. slit is enough to avoid the liquid mixture, but not more than 3 μm is desirable.

<Element Substrate>

The description will be made as to a structure of the element substrate provided with the heat generating element for heating the liquid.

FIG. 15 is a longitudinal section of the liquid ejecting head according to an embodiment of the present invention, wherein (*a*) has a protection layer, and (*b*) does not have a protection layer.

On the element substrate 1, a grooved member 50 is mounted, the member 50 having second liquid flow paths 16, separation walls 30, first liquid flow paths 14 and grooves for constituting the first liquid flow path.

The element substrate 1 has, as shown in FIG. 11, patterned wiring electrode (0.2–1.0 μm thick) of aluminum or the like and patterned electric resistance layer 105 (0.01–0.2 μm thick) of hafnium boride ($HfB_2$), tantalum nitride (TaN), tantalum aluminum (TaAl) or the like constituting the heat generating element on a silicon oxide film or silicon nitride film 106 for insulation and heat accumulation, which in turn is on the substrate 107 of silicon or the like. A voltage is applied to the resistance layer 105 through the two wiring electrodes 104 to flow a current through the resistance layer to effect heat generation. Between the wiring electrode, a protection layer of silicon oxide, silicon nitride or the like of 0.1–2.0 μm thick is provided on the resistance layer, and in addition, an anti-cavitation layer of tantalum or the like (0.1–0.6 μm thick) is formed thereon to protect the resistance layer 105 from various liquid such as ink.

The pressure and shock wave generated upon the bubble generation and collapse is so strong that the durability of the oxid film which is relatively fragile is deteriorated. Therefore, metal material such as tantalum (Ta) or the like is used as the anti-cavitation layer.

The protection layer may be omitted depending on the combination of liquid, liquid flow path structure and resistance material. One of such examples is shown in FIG. 4, (*b*). The material of the resistance layer not requiring the protection layer, includes, for example, iridium-tantalum-aluminum alloy or the like. Thus, the structure of the heat generating element in the foregoing embodiments may include only the resistance layer (heat generation portion) or may include a protection layer for protecting the resistance layer.

In the embodiment, the heat generating element has a heat generation portion having the resistance layer which generates heat in response to the electric signal. This is not limiting, and it will suffice if a bubble enough to eject the election liquid is created in the bubble generation liquid. For example, heat generation portion may be in the form of a photothermal transducer which generates heat upon receiving light such as laser, or the one which generates heat upon receiving high frequency wave.

On the element substrate 1, function elements such as a transistor, a diode, a latch, a shift register and so on for selective driving the electrothermal transducer element may also be int grally built in, in addition to the resistance layer 105 constituting the heat generation portion and the electrothermal transducer constituted by the wiring electrode 104 for supplying the electric signal to the resistance layer.

Figure 21:
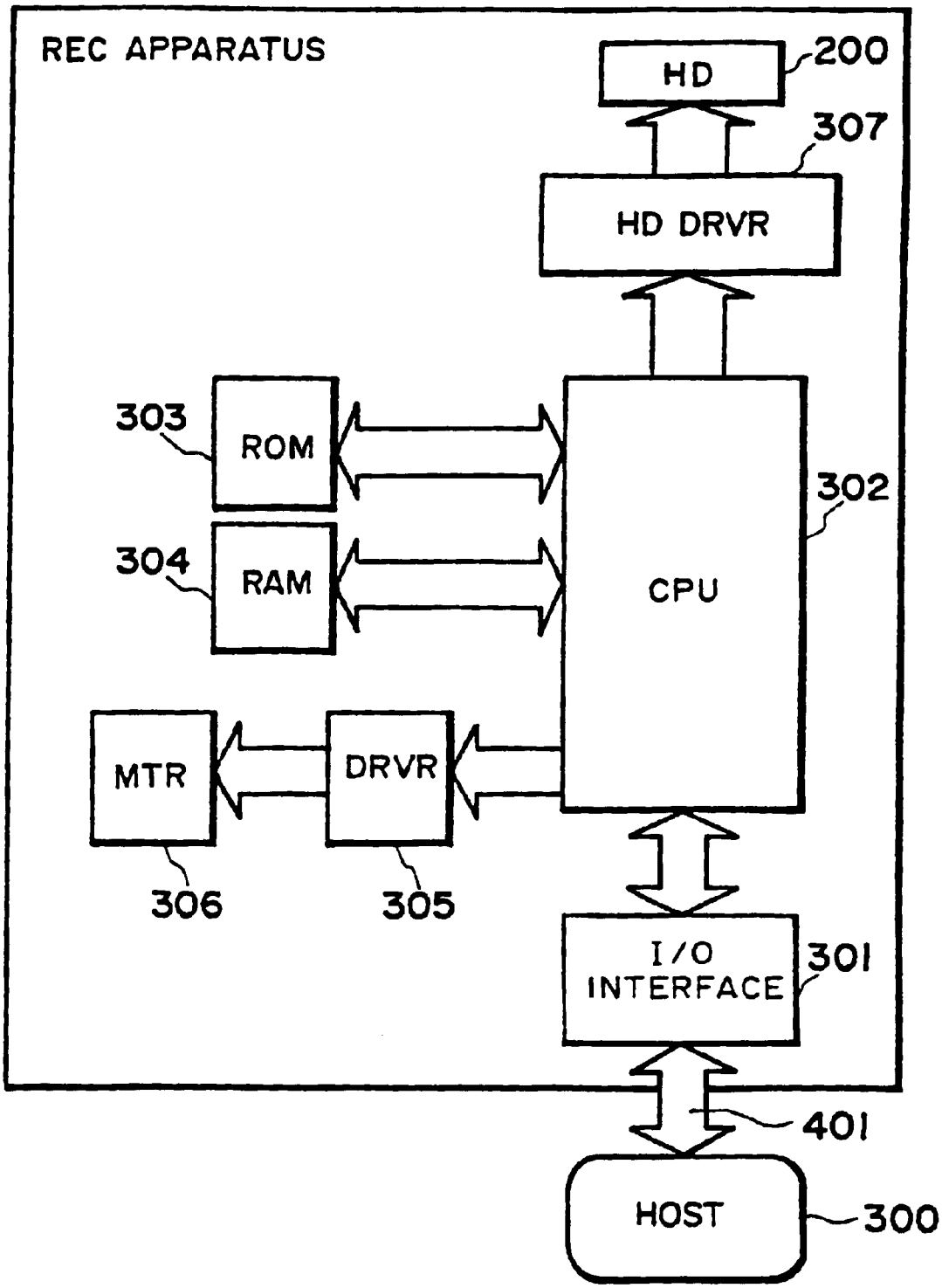
FIG. 21 is a block diagram of a liquid ejecting apparatus.

In order to eject the liquid by driving the heat generation portion of the electrothermal transducer on the above-described element substrate 1, the resistance layer 105 is supplied through the wiring electrode 104 with rectangular pulses as shown in FIG. 21 to cause instantaneous heat generation in the resistance layer 105 between the wiring electrode. In the case of the heads of the foregoing embodiments, the applied energy has a voltage of 24 V, a pulse width of 7 $\mu$sec, a current of 150 mA and a frequency of 6 kHz to drive the heat generating element, by which the liquid ink is ejected through the ejection outlet through the process described hereinbefore. However, the driving signal conditions are not limited to this, but may be any if the bubble generation liquid is properly capable of bubble generation.

<Head Structure of 2 Flow Path Structure>

The description will be made as to a structure of the liquid ejecting head with which different liquids are separately accommodated in first and second common liquid chamber, and the number of parts can be reduces so that the manufacturing cost can be reduced.

Figure 17:
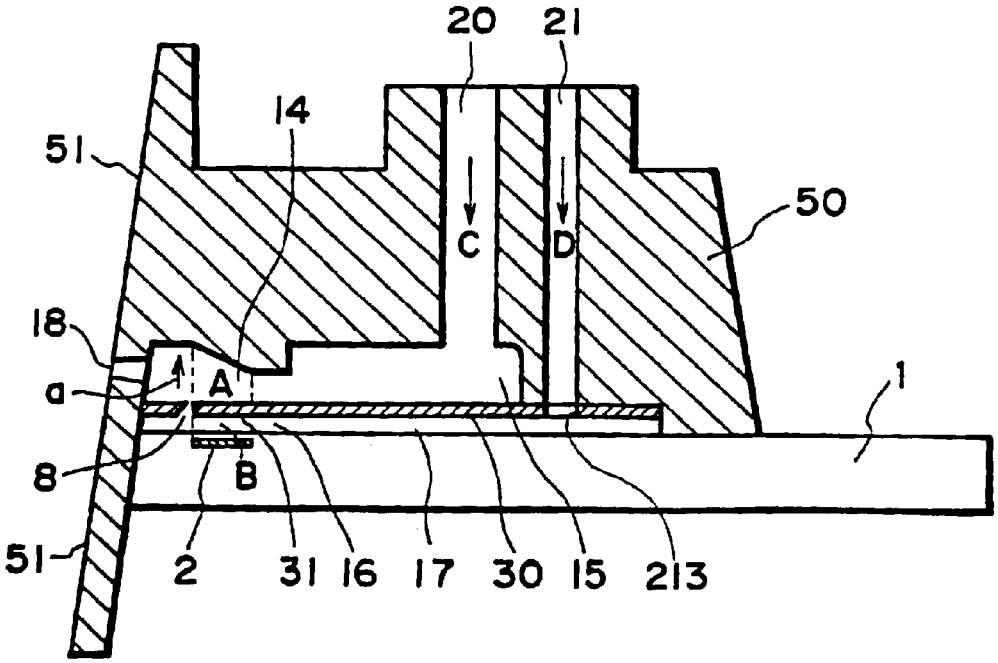
FIG. 17 is a sectional view illustrating a supply passage of a liquid ejecting head using the liquid ejection principle applied to the present invention.

FIG. 17 is a schematic view of such a liquid ejecting head. The same reference numerals as in the previous embodiment are assigned to the elements having the corresponding functions, and detailed descriptions thereof are omitted for simplicity.

In this embodiment, a grooved member 50 has an orifice plate 51 having an ejection outlet 18, a plurality of grooves for constituting a plurality of first liquid flow paths 14 and a recess for constituting the first common liquid chamber 15 for supplying the liquid (ejection liquid) to the plurality of liquid flow paths 14. A separation wall 30 is mounted to the bottom of the grooved member 50 by which plurality of first liquid flow paths 14 are formed. Such a grooved member 50 has a first liquid supply passage 20 extending from an upper position to the first common liquid chamber 15. The grooved member 50 also has a second liquid supply passage 21 extending from an upper position to the second common liquid chamber 17 through the separation wall 30.

As indicated by an arrow C in FIG. 17, the first liquid (ejection liquid) is supplied through the first liquid supply passage 20 and first common liquid chamber 15 to the first liquid flow path 14, and the second liquid (bubble generation liquid) is supplied to the second liquid flow path 16 through the second liquid supply passage 21 and the second common liquid chamber 17 as indicated by arrow D in FIG. 17.

In this example, the second liquid supply passage 21 is extended in parallel with the first liquid supply passage 20, but this is not limited to the exemplification, but it may be any if the liquid is supplied to the second common liquid chamber 17 through the separation wall 30 outside the first common liquid chamber 15.

The (diameter) of the second liquid supply passage 21 is determined in consideration of the supply amount of the second liquid. The configuration of the second liquid supply passage 21 is not limited to circular or round but may be rectangular or the like.

Figure 18:
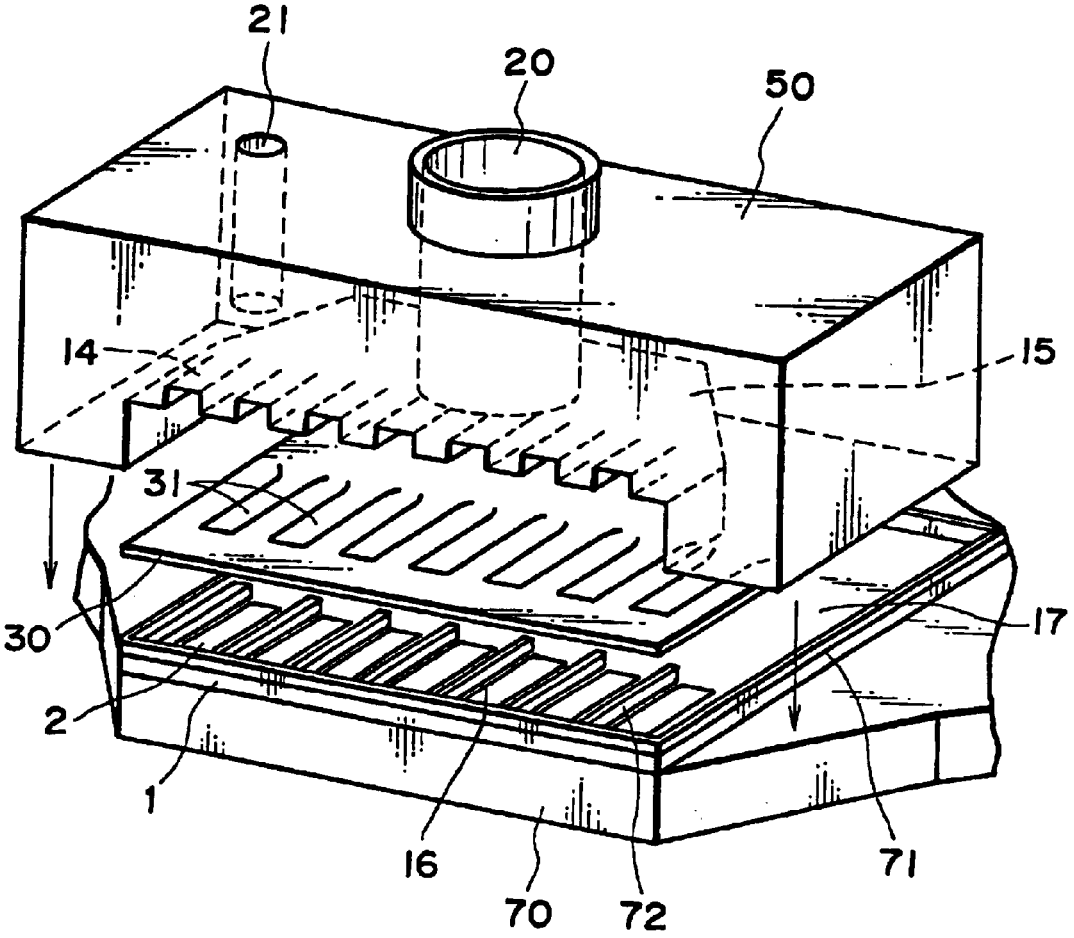
FIG. 18 is an exploded perspective view of a liquid ejecting head using the liquid ejection principle applied to the present invention.

The second common liquid chamber 17 may be formed by dividing the grooved by a separation wall 30. As for the method of forming this, as shown in FIG. 18 which is an exploded perspective view, a common liquid chamber frame and a second liquid passage wall are formed of a dry film, and a combination of a grooved member 50 having the separation wall fixed thereto and the element substrate 1 are bonded, thus forming the second common liquid chamber 17 and the second liquid flow path 16.

In this example, the element substrate 1 is constituted by providing the supporting member 70 of metal such as aluminum with a plurality of electrothermal transducer elements as heat generating elements for generating heat for bubble generation from the bubble generation liquid through film boiling.

Above the element substrate 1, there are disposed the plurality of grooves constituting the liquid flow path 16 formed by the second liquid passage walls, the recess for constituting the second common liquid chamber (common bubble generation liquid chamber) 17 which is in fluid communication with the plurality of bubble generation liquid flow paths for supplying the bubble generation liquid to the bubble generation liquid passages, and the separation or dividing walls 30 having the movable walls 31.

Designated by reference numeral 50 is a grooved, member. The grooved member is provided with grooves for constituting the ejection liquid flow paths (first liquid flow paths) 14 by mounting the separation walls 30 thereto, a recess for constituting the first common liquid chamber (common ejection liquid chamber) 15 for supplying the ejection liquid to the ejection liquid flow paths, the first supply passage (ejection liquid supply passage) 20 for supplying the ejection liquid to the first common liquid chamber, and the second supply passage (bubble generation liquid supply passage) 21 for supplying the bubble generation liquid to the second supply passage (bubble generation liquid supply passage) 21. The second supply passage 21 is connected with a fluid communication path in fluid communication with the second common liquid chamber 17, penetrating through the separation wall 30 disposed outside of the first common liquid chamber 15. By the provision of the fluid communication path, the bubble generation liquid can be supplied to the second common liquid chamber 15 without mixture with the ejection liquid.

The positional relation among the element substrate 1, separation wall 30, grooved top plate 50 is such that the movable members 31 are arranged corresponding to the heat generating elements on the element substrate 1, and that the ejection liquid flow paths 14 are arranged corresponding to the movable members 31. In this example, one second supply passage is provided for the grooved member, but it may be plural in accordance with the supply amount. The cross-sectional area of the flow path of the ejection liquid supply passage 20 and the bubble generation liquid supply passage 21 may be determined in proportion to the supply amount. By the optimization of the cross-sectional area of the flow path, the parts constituting the grooved member 50 or the like can be downsized.

As described in the foregoing, according to this embodiment, the second supply passage for supplying the second liquid to the second liquid flow path and the first supply passage for supplying the first liquid to the first liquid flow path, can be provided by a single grooved top plate, so that the number of parts can be reduced, and therefore, the reduction of the manufacturing steps and therefore the reduction of the manufacturing cost, are accomplished.

Furthermore, the supply of the second liquid to the second common liquid chamber in fluid communication with the second liquid flow path, is effected through the second liquid flow path which penetrates the separation wall for separating the first liquid and the second liquid, and therefore, one bonding step is enough for the bonding of the separation wall, the grooved member and the heat generating element substrate, so that the manufacturing is easy, and the accuracy of the bonding is improved.

Since the second liquid is supplied to the second liquid common liquid chamber, penetrating the separation wall, the supply of the second liquid to the second liquid flow path is assured, and therefore, the supply amount is sufficient so that the stabilized ejection is accomplished.

<Ejection Liquid and Bubble Generation Liquid>

As described in the foregoing embodiment, according to the present invention, by the structure having the movable member described above, the liquid can be ejected at higher ejection force or ejection efficiency than the conventional liquid ejecting head. When the same liquid is used for the bubble generation liquid and the ejection liquid, it is possible that the liquid is not deteriorated, and that deposition on the heat generating element due to heating can be reduced. Therefore, a reversible state change is accomplished by repeating the gassification and condensation. So, various liquids are usable, if the liquid is the one not deteriorating the liquid flow passage, movable member or separation wall or the like.

Among such liquids, the one having the ingredient as used in conventional bubble jet device, can be used as a recording liquid.

When the two-flow-path structure of the present invention is used with different ejection liquid and bubble generation liquid, the bubble generation liquid having the above-described property is used, more particularly, the examples includes: methanol, ethanol, n-propyl alcohol, isopropyl alcohol, n-n-hexane, n-heptane, n-octane, toluene, xylene, methylen dichloride, trichloroethylene, Freon TF, Freon BF, ethyl ether, dioxane, cyclohexane, methyl acetate, ethyl acetate, acetone, methyl ethyl ketone, water, or the like, and a mixture thereof.

As for the ejection liquid, various liquids are usable without paying attention to the degree of bubble generation property or thermal property. The liquids which have not been conventionally usable, because of low bubble generation property and/or easiness of property change due to heat, are usable.

However, it is desired that the ejection liquid by itself or by reaction with the bubble generation liquid, does not impede the ejection, the bubble generation or the operation of the movable member or the like.

As for the recording ejection liquid, high viscous ink or the like is usable. As for another ejection liquid, pharmaceuticals and perfume or the like having a nature easily deteriorated by heat is usable. The ink of the following ingredient was used as the recording liquid usable for both of the ejection liquid and the bubble generation liquid, and the recording operation was carried out. Since the ejection speed of the ink is increased, the shot accuracy of the liquid droplets is improved, and therefore, highly desirable images were recorded.

Dye ink viscosity of 2 cp:

| | |
|---|---|
| (C.I. food black 2) dye | 3 wt. % |
| diethylene glycol | 10 wt. % |
| Thio diglycol | 5 wt. % |
| Ethanol | 5 wt. % |
| Water | 77 wt. % |

Recording operations were also carried out using the following combination of the liquids for the bubble generation liquid and the ejection liquid. As a result, the liquid having a ten and several cps viscosity, which was unable to be ejected heretofore, was properly ejected, and even 150 cps liquid was properly ejected to provide high quality image.

| | |
|---|---|
| Bubble generation liquid 2: | |
| Ethanol | 40 wt. % |
| Water | 60 wt. % |
| Bubble generation liquid 2: | |
| Water | 100 wt. % |
| Bubble generation liquid 3: | |
| Isopropyl alcoholic | 10 wt. % |
| Water | 90 wt. % |
| Ejection liquid 1: (Pigment ink approx. 15 cp) | |
| Carbon black | 5 wt. % |
| Stylene-acrylate-acrylate ethyl copolymer resin material | 1 wt. % |
| Dispersion material (oxide 140, weight average molecular weight) | |
| Mono-ethanol amine | 0.25 wt. % |
| Glyceline | 69 wt. % |
| Thiodiglycol | 5 wt. % |
| Ethanol | 3 wt. % |
| Water | 16.75 wt. % |
| Ejection liquid 2 (55 cp): | |
| Polyethylene glycol 200 | 100 wt. % |
| Ejection liquid 3 (150 cp): | |
| Polyethylene glycol 600 | 100 wt. % |

In the case of the liquid which has not been easily ejected, the ejection speed is low, and therefore, the variation in the ejection direction is expanded on the recording paper with the result of poor shot accuracy. Additionally, variation of ejection amount occurs due to the ejection instability, thus preventing the recording of high quality image. However, according to the embodiments, the use of the bubble generation liquid permits sufficient and stabilized generation of the bubble. Thus, the improvement in the shot accuracy of the liquid droplet and the stabilization of the ink ejection amount can be accomplished, thus improving the recorded image quality remarkably.

<Liquid Ejection Head Cartridge>

The description will be made as to a liquid ejection head cartridge having the liquid ejecting head of the foregoing example.

Figure 19:
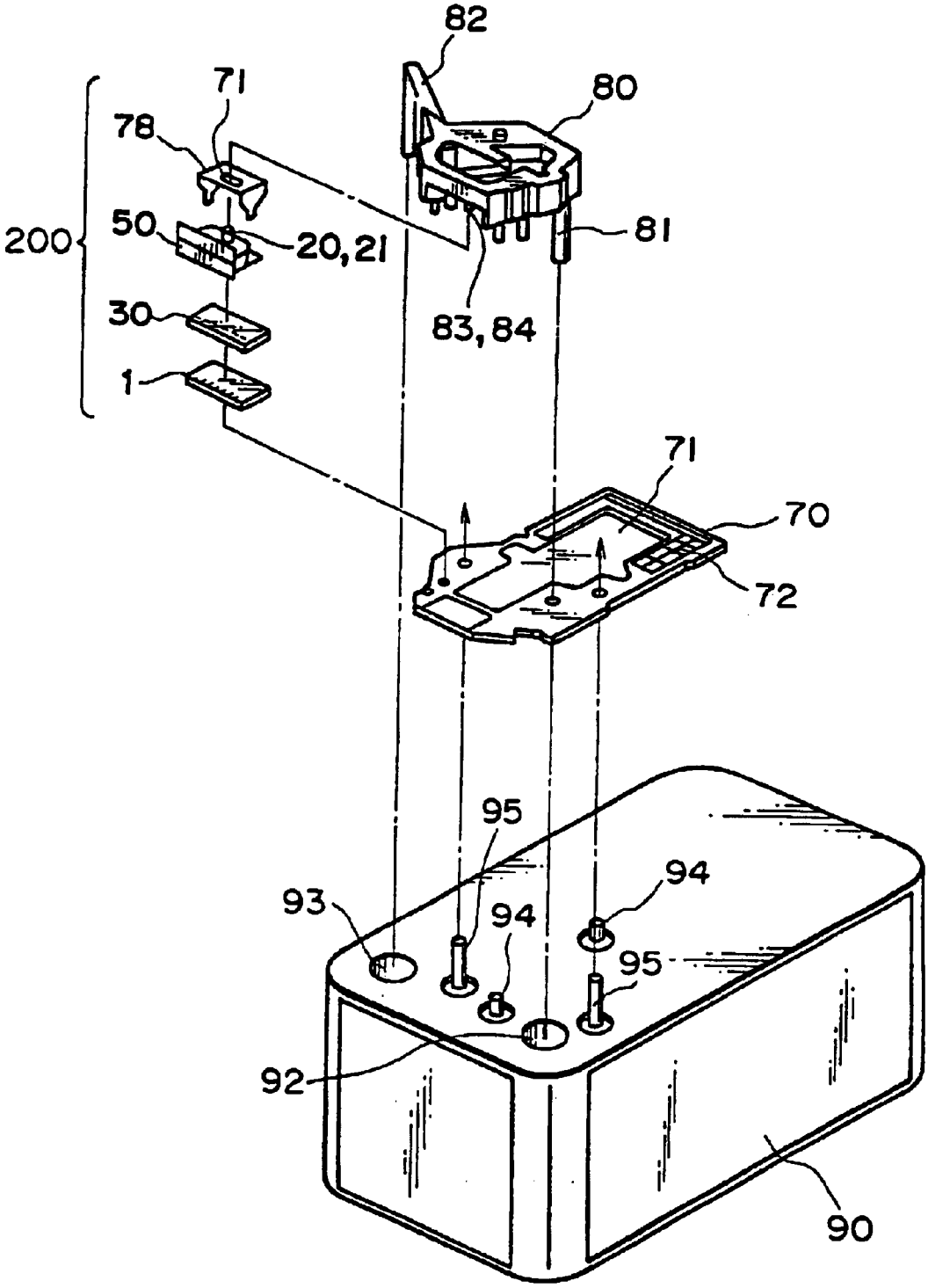
FIG. 19 is an exploded perspective view of a liquid ejection head cartridge.

FIG. 19 is a schematic exploded perspective view of a liquid ejection head cartridge including the above-described liquid ejecting head, and the liquid ejection head cartridge comprises generally a liquid ejecting head portion 201 and a liquid container 80.

The liquid ejecting head portion 201 comprises an element substrate 1, a separation wall 30, a grooved member 50, a confining spring 78, liquid supply member 90 and a supporting member 70. The element substrate 1 is provided with a plurality of heat generating resistors for supplying heat to the bubble generation liquid, as described hereinbefore. A bubble generation liquid passage is formed between the element substrate 1 and the separation wall 30 having the movable wall. By the coupling between the separation wall 30 and the grooved top plate 50, an ejection flow path (unshown) for fluid communication with the ejection liquid is formed.

The confining spring 78 functions to urge the grooved member 50 to the element substrate 1, and is effective to properly integrate the element substrate 1, separation wall 30, grooved and the supporting member 70 which will be described hereinafter.

Supporting member 70 functions to support an element substrate 1 or the like, and the supporting member 70 has thereon a circuit board 71, connected to the element substrate 1, for supplying the electric signal thereto, and contact pads 72 for electric signal transfer between the device side when the cartridge is mounted on the apparatus.

The liquid container 90 contains the ejection liquid such as ink to be supplied to the liquid ejecting head and the bubble generation liquid for bubble generation, separately. The outside of the liquid container 90 is provided with a positioning portion 94 for mounting a connecting member for connecting the liquid ejecting head with the liquid container and a fixed shaft 95 for fixing the connection portion. The ejection liquid is supplied to the ejection liquid supply passage 81 of a liquid supply member 80 through a supply passage 84 of the connecting member from the ejection liquid supply passage 92 of the liquid container, and is supplied to a first common liquid chamber through the ejection liquid supply passages 83, 71 and 21 of the members. The bubble generation liquid is similarly supplied to the bubble generation liquid supply passage 82 of the liquid supply member 80 through the supply passage of the connecting member from the supply passage 93 of the liquid container, and is supplied to the second liquid chamber through the bubble generation liquid supply passage 84, 71, 22 of the members. In such a liquid ejection head cartridge, even if the bubble generation liquid and the ejection liquid are different liquids, the liquids are supplied in good order. in the case that the ejection liquid and the bubble generation liquid are the same, the supply path for the bubble generation liquid and the ejection liquid are not necessarily separated.

After the liquid is used up, the liquid containers may be supplied with the respective liquids. To facilitate this supply, the liquid container is desirably provided with a liquid injection port. The liquid ejecting head and the liquid container may be integral with each other or separate from each other.

<Liquid Ejecting Apparatus>

Figure 20:
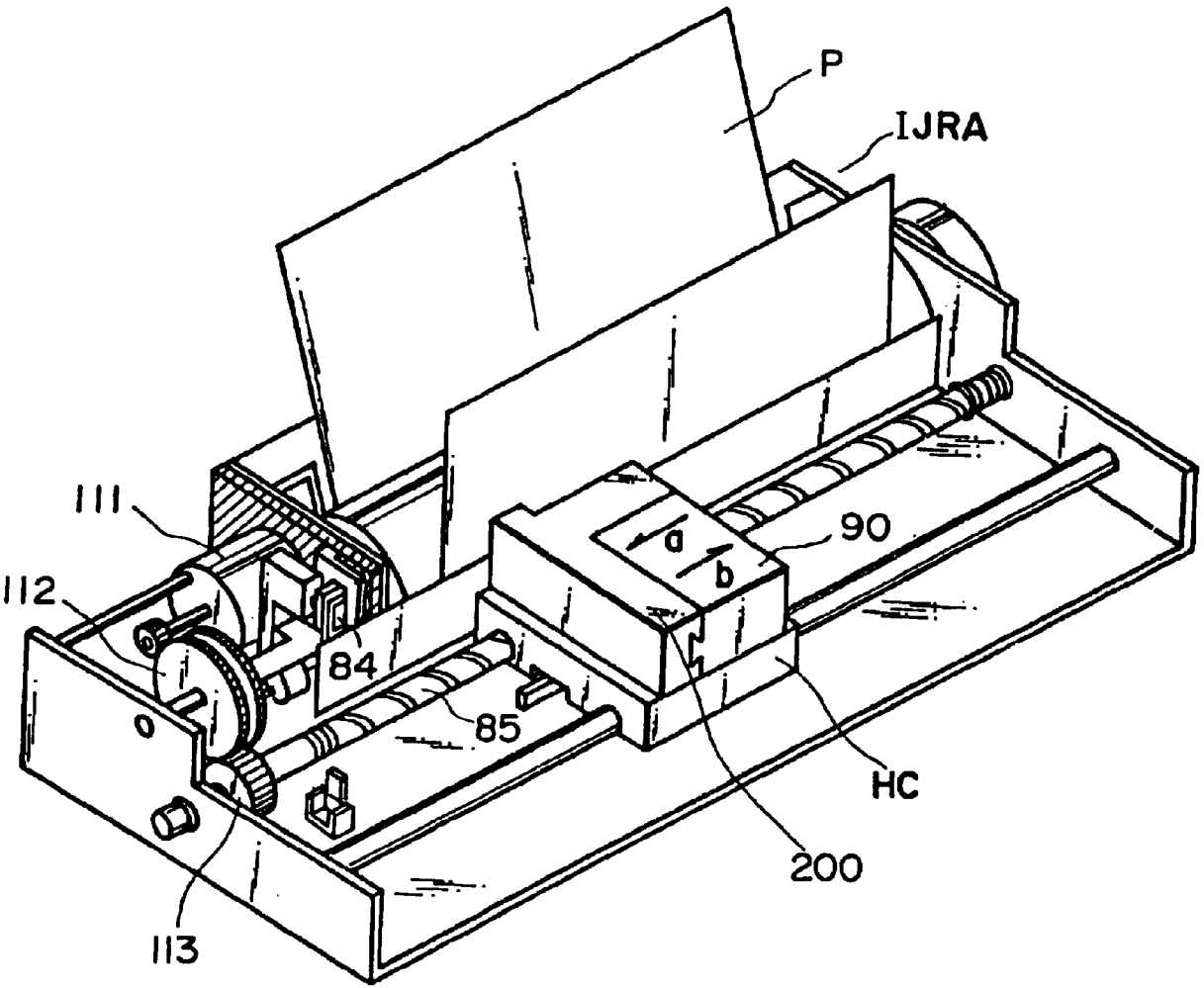
FIG. 20 is a schematic illustration of a liquid ejecting apparatus.

FIG. 20 schematically show a structure of a liquid ejecting apparatus having the above-described liquid ejecting head 201. In this example, the ejection liquid is ink. The apparatus is an ink ejection recording apparatus. the liquid ejecting device comprises a carriage HC to which the head cartridge comprising a liquid container portion 90 and liquid ejecting head portion 201 which are detachably connectable with each other, is mountable. the carriage HC is reciprocable in a direction of width of the recording material 150 such as a recording sheet or the like fed by a recording material transporting means.

When a driving signal is supplied to the liquid ejecting means on the carriage from unshown driving signal supply means, the recording liquid is ejected to the recording material from the liquid ejecting head 201 in response to the signal.

The liquid ejecting apparatus of this embodiment comprises a motor 111 as a driving source for driving the recording material transporting means and the carriage, gears 112, 113 for transmitting the power from the driving source to the carriage, and carriage shaft 18 5 and so on. By the recording device and the liquid ejecting method, satisfactory print can be provided on various recording materials. When the liquid ejecting method is carried out for various recording materials.

FIG. 21 is a block diagram of the entirety of the device for carrying out ink ejection recording using the liquid ejecting head and the liquid ejecting method of the present invention.

The recording apparatus receives printing data in the form of a control signal from a host computer 300. The printing data is temporarily stored in an input interface 301 of the printing apparatus, and at the same time, is converted into processable data to be inputted to a CPU 302, which doubles as means for supplying a head driving signal. The CPU 302 processes the aforementioned data inputted to the CPU 302, into printable data (image data), by processing them with the use of peripheral units such as RAMs 304 or the like, following control programs stored in an ROM 303.

Further, in order to record the image data onto an appropriate spot on a recording sheet, the CPU 302 generates driving data for driving a driving motor which moves the recording sheet and the recording head in synchronism with the image data. The image data and the motor driving data are transmitted to a head 200 and a driving motor 306 through a head driver 307 and a motor driver 305, respectively, which are controlled with the proper timings for forming an image.

When the ejection power refreshing operation is required as after rest of the head, the CPU302 supplies refreshing operation instructions to the recovering device 310 including the suction recovery device 200. The recovering device 310 having received the ejection power recovery instructions, carries out the series of operations for the recovery of the ejection power of the head on the basis of suction or pressurizing recovery sequence.

As for recording medium, to which liquid such as ink is adhered, and which is usable with a recording apparatus such as the one described above, the following can be listed; various sheets of paper; OHP sheets; plastic material used for forming compact disks, ornamental plates, or the like; fabric; metallic material such as aluminum, copper, or the like; leather material such as cow hide, pig hide, synthetic leather, or the like; lumber material such as solid wood, plywood, and the like; bamboo material; ceramic material such as tile; and material such as sponge which has a three dimensional structure.

The aforementioned recording apparatus includes a printing apparatus for various sheets of paper or OHP sheet, a recording apparatus for plastic material such as plastic material used for forming a compact disk or the like, a recording apparatus for metallic plate or the like, a recording apparatus for leather material, a recording apparatus for lumber, a recording apparatus for ceramic material, a recording apparatus for three dimensional recording medium such as sponge or the like, a textile printing apparatus for recording images on fabric, and the like recording apparatuses.

As for the liquid to be used with these liquid ejection apparatuses, any liquid is usable as long as it is compatible with the employed recording medium, and the recording conditions.

<Recording System>

Next, an exemplary ink jet recording system will be described, which records images on recording medium, using, as the recording head, the liquid ejection head in accordance with the present invention.

Figure 22:
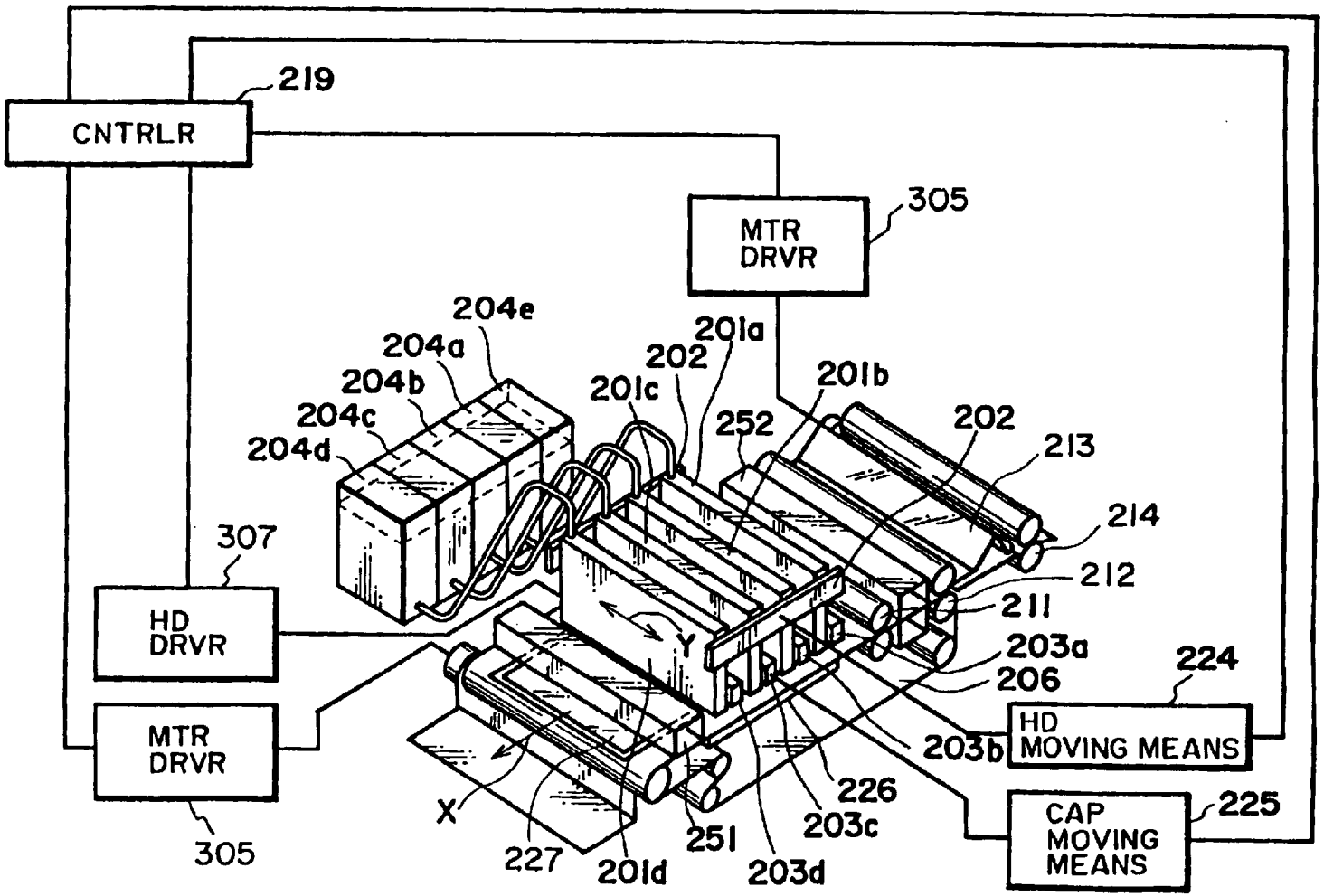
FIG. 22 is a diagram of a liquid ejection recording system.

FIG. 22 is a schematic perspective view of an ink jet recording system employing the aforementioned liquid ejection head 201 in accordance with the present invention, and depicts its general structure. The liquid ejection head in this embodiment is a full-line type head, which comprises plural ejection orifices aligned with a density of 360 dpi so as to cover the entire recordable range of the recording medium 150. It comprises four heads, which are correspondent to four colors; yellow (Y), magenta (M), cyan (C) and black (Sk). These four heads are fixedly supported by a holder 1202, in parallel to each other and with predetermined intervals.

These heads are driven in response to the signals supplied from a head driver 307, which constitutes means for supplying a driving signal to each head.

Each of the four color inks (Y, M, C and Bk) is supplied to a correspondent head from an ink container 1204*a*, 1204*b*, 1205*c* or 1204*d*. A reference numeral 1204*e* designates a bubble generation liquid container from which the bubble generation liquid is delivered to each head.

Between the container and the each head, the tube is provided with pressurizing recovering device 311*e*, 311*a*, 311*b*, 311*c*, or 311*d*, as shown in the Figure. The driving means for the pressurizing recovering device is a pressurizing pump, and when the recovery for the ejection power of the head is necessary, the CPU302 shown in FIG. 58 produces pressurizing recovery instructions, and the series of operations for the recovery of the ejection power of the head is carried out on the basis of the predetermined pressurizing recovery sequence.

Below each head, there is a head cap 203*a*–203*d* having ink absorption member such as sponge, which covers the ejection outlets of each head when the recording operation is not effected to protect the head.

Designated by reference numeral 206 is a conveyer belt constituting feeding means for feeding a recording material as has been described. The conveyer belt 206 extends along a predetermined path using various rollers, and is driven by a driving roller connected with the motor driver 305.

The ink jet recording system in this embodiment comprises a pre-printing processing apparatus 1251 and a post-printing processing apparatus 1252, which are disposed on the upstream and downstream sides, respectively, of the ink jet recording apparatus, along the recording medium conveyance path. These processing apparatuses 1251 and 1252 process the recording medium in various manners before or after recording is made, respectively.

The pre-printing process and the postprinting process vary depending on the type of recording medium, or the type of ink. For example, when recording medium composed of metallic material, plastic material, ceramic material or the like is employed, the recording medium is exposed to ultra-violet rays and ozone before printing, activating its surface.

In a recording material tending to acquire electric charge, such as plastic resin material, the dust tends to deposit on the surface by static electricity. The dust may impede the desired recording. In such a case, the use is made with ionizer to remove the static charge of the recording material, thus removing the dust from the recording material. When a textile is a recording material, from the standpoint of feathering prevention and improvement of fixing or the like, a pre-processing may be effected wherein alkali property substance, water soluble property substance, composition polymeric, water soluble property metal salt, urea, or thiourea is applied to the textile. The pre-processing is not limited to this, and it may be the one to provide the recording material with the proper temperature.

On the other hand, the post-processing is a process for imparting, to the recording material having received the ink, a h at treatment, ultraviolet radiation projection to promote the fixing of the ink, or a cleaning for removing the process material used for the pre-treatment and remaining because of no reaction.

In this embodiment, the head is a full line head, but the present invention is of course applicable to a serial type wherein the head is moved along a width of the recording material.

Figure 23:
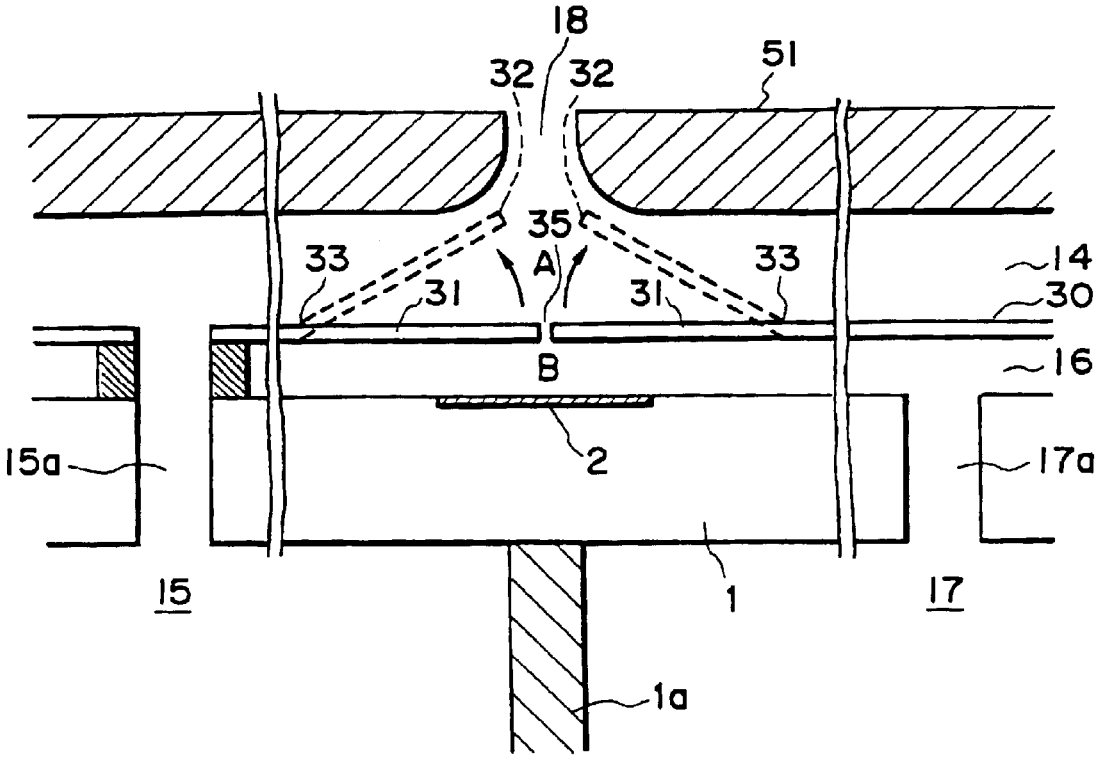
FIG. 23 is a schematic view illustrating structures of another example (side shooter type) of a liquid ejecting head using the liquid ejection principle applied to the present invention.

In the foregoing, so-called edge shooter type has been describe, but the present invention is not limited to this and is applicable to a so-called side shooter type head, for example, shown in FIG. 23.

FIG. 23 is a schematic cross-sectional view schematic a showing an example to which the present invention is applied.

The liquid ejecting head of this example is a so-called side shooter type head, wherein the ejection outlet 11 is faced substantially parallel to a heat generation surface of the heat generating element 2. The heat generating element 2 has a size of 48 $\mu$m×46 $\mu$m and is in the form of a heat generating resistor. It is mounted on a substrate 1, and generates thermal energy used to generate a bubble by film boiling of liquid as disclosed in U.S. Pat. No. 4,723,129. The ejection outlet 18 is formed in an orifice plate 51 which is an ejection outlet portion material. The orifice plate 51 is manufactured from nickel through electro-forming.

A first liquid flow path 14 is provided below the orifice plate 14 so that it is directly in fluid communication with the ejection outlet 11 to flow the liquid therethrough. On the other hand, a second liquid flow path 16 is provided on the substrate 1 to flow the bubble generation liquid. Between the first liquid flow path 3 and the second liquid flow path 16, a separation wall 30 is provided to isolate the liquid flow paths. Separation wall 30 is of a material having an elastic, such as metal. In this example, the separation wall 30 is of nickel having thickness of 5 $\mu$m. This separation wall 30 substantially isolates the ejection liquid in the first liquid flow path 14 and the bubble generation liquid in the second liquid flow path 16.

The ejection liquid is supplied to the first liquid flow path 14 through the first supply passage 15*a* from a first common liquid chamber 5 storing the ejection liquid. The bubble generation liquid is supplied to the second liquid flow path 16 through the second supply passage 17*a* from a second common liquid chamber 17 storing the bubble generation liquid. The first common liquid chamber 15 and the second common liquid chamber 7 are isolated by the partition 1*a*. In this example, the ejection liquid to be supplied to the first liquid flow path 14, and the bubble generation liquid to be supplied to the second liquid flow path 16, are of water base ink (a mixed liquid of ethanol and water).

The separation wall 5 is disposed adjacent the portion of the projected space of the heat generation surface of the heat generating element 2 perpendicular to the heat generation surface, and has a pair of movable portions 6 of flat plate cantilever configuration, one of which is a movable member and the other is an opposing member opposed to the movable member. The movable portion 31 and the heat generating surface a disposed with a clearance of 15 $\mu$m approx. The free ends 32 a of the movable portions 31 are opposed to each other with a gap of approx. 2 $\mu$m (slit 35). Designated by 33 is a base portion functioning as a base portion upon opening of the movable portions 31. Slit 35 is formed in a plane including a line connecting a center portion of the heat generating element 2 and the center portion of the ejection outlet 18. In this example, the slit 8 is so narrow that the bubble does not extend through the slit 8 around the movable portions 6 before the movable portion 5 is displaced, when the bubble growths. At least the free end 32 of the movable portion 31 is disposed within a region to which the pressure due to th bubble extends. In FIG. 23, "A" designates an upper side region (ejection outlet side) of the movable portion 31 in a stable state, and "B" designates a lower side (heat generating element side) region.

Figure 1:
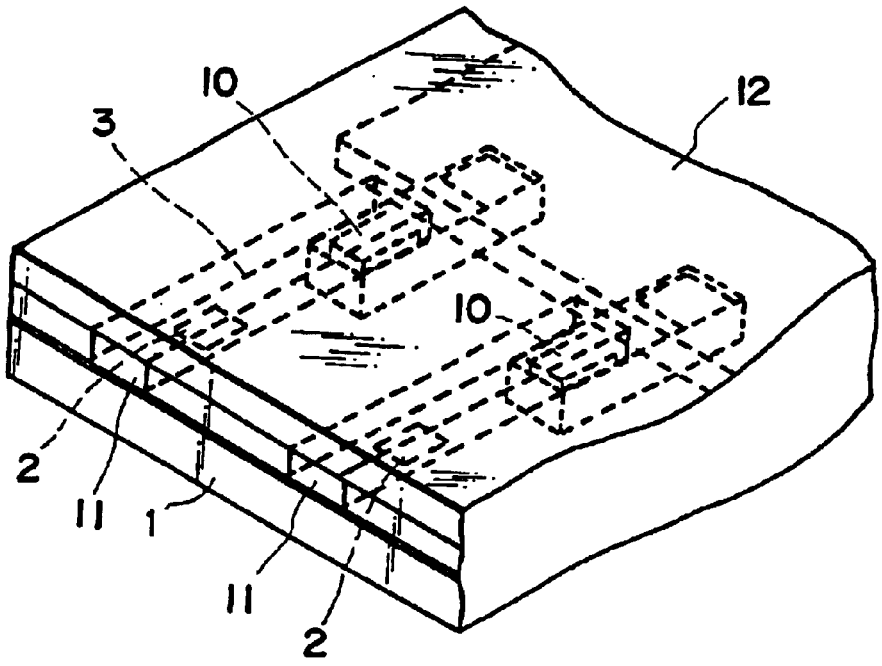
FIG. 1 illustrates a liquid flow passage structure of a conventional liquid ejecting head, wherein (a) is a schematic perspective view thereof, and (b) is a sectional view thereof.
Figure 1:
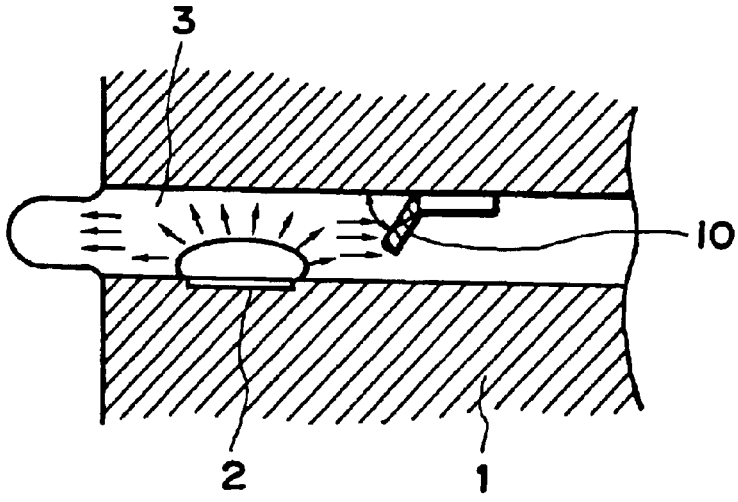

When heat is generated at the heat generation surface of the heat generating element 2, and a bubble is generated in the region B, the free end 32 of the movable portion 31 is instantaneously moved in the direction of the arrow in FIG. 1 namely toward the region A with the base portion 33 functioning as a fulcrum by the pressure resulting from the generation and growth of the bubble and by the expanding bubble per se. By this, the liquid is ejected out through the ejection outlet 18.

In the side shooter type liquid ejecting head having such a structure, the present invention is capable of providing the advantageous effects that the refilling of the ejection liquid is improved, and the liquid can be ejected with high ejection pressure and with high ejection energy use efficiency.

In this example, the liquid in the second liquid flow path 16 and the liquid in the first liquid flow path 14, are substantially isolated, the paths may be in fluid communication with each other at least at a part thereof, if the liquids are the same, or they may be mixed.

In this example, the free ends 32 of the movable members 31 are opposed to each other, but only one movable member may be enough, depending on the case.

(Embodiments)

The description will be made as to an embodiment wherein mixed liquid of the ejection liquid and the bubble generation liquid, is discharged from the inside, in the separation system wherein the ejection liquid and the bubble generation liquid are supposed to be substantially separated.

When the bubble generation liquid and the ejection liquid are different, and are supposed to be substantially separated, the bubble generation liquid or the ejection liquid may disperse into the other, or they disperse into each other through the slit 35 (FIG. 2) between the movable member 31 and the separation wall 30 constituting the above-described valve structure, if the rest period (the ejection liquid is not ejected from the ejection head) is very long. If this occurs, mixed liquid is produced. If the mixed liquid is produced, some problems may arise at the initial stage of printing. For example, density non-uniformity or the like may occur; ejection performance may be uneven; feathering of the liquid may be uneven; or burnt deposit may be produced on the heat generating element when the ejection liquid contains such a component.

On the other hand, not being limited to the case wherein the ejection liquid and the bubble generation liquid are different, if the rest period of the ejection head is very long, the viscosity of the ejection liquid may be increased to a significant extent due to evaporation of water, depending on the length of the rest period. The viscosity-increased ejection liquid is not desirable for the satisfactory ejection and the recorded image, and therefore, it is desirable to exclude the viscosity-increased ejection liquid to the outside or to decrease the viscosity thereof.

In the separation type ejection head, the ejection liquid having a relatively high viscosity may be satisfactorily ejected. But, depending on the ejection liquid used, it is necessary to set the viscosity of the ejection liquid at a level lower than that at the normal temperature because of the property relative to the recording material.

Furthermore, under a low temperature condition, the liquid viscosity further increases, and under a low humidity condition, the evaporation is promoted. In these conditions, the viscosity-increased of the liquid is accelerated with the result of influence to the ejection or to the printing.

In this example, the exclusion of mixed liquid, the exclusion of the viscosity-increased ejection liquid, and/or the decrease of the viscosity, is accomplished by non-printing ejection from the ejection head. In the following, the ejection not effecting the recording is called "preliminary ejection".

(First Embodiment)

In this example, the number of the ejections in the preliminary ejection, is determinated in accordance with an initial dynamic viscosity of the ejection liquid. The initial dynamic viscosity represents an initial liquid viscosity after the non-use or rest period, and is dependent upon the length of the rest time period, if the variation of the ambience factors such as the temperature, is not significant. In this embodiment, a relation between the rest time and the initial dynamic viscosity after a rest period, is determinated beforehand (the initial dynamic viscosity is shown in relation to it), and the preliminary ejection is carried out in accordance with the rest period, in the following manner.

According to the preliminary ejection of this example, the temperature rise of the ejection liquid in the ejection head occurs due to the continuous driving of the heat generating element by the preliminary ejection, so that the dynamic viscosity is decreased. Thus, the dynamic viscosity of the ejection liquid increased during the rest period, is decreased to permit satisfactory ejection from the initial ejections. Depending on the ejection liquid used, the operation temperature (the temperature suitable for the ejection) is higher than the normal temperature, but in such a case, the temperature of the liquid is increased quickly to the operation temperature by the continuous ejections by the preliminary ejection. Secondly, even if the mixed liquid has been produced, it is discharged from the ejection nozzle by the preliminary ejection.

Thus, proper preliminary ejection can be carried out in consideration of various ambient conditions, by determinating beforehand the relation between the viscosity increase and the ambient temperature or humidity.

Figure 24:
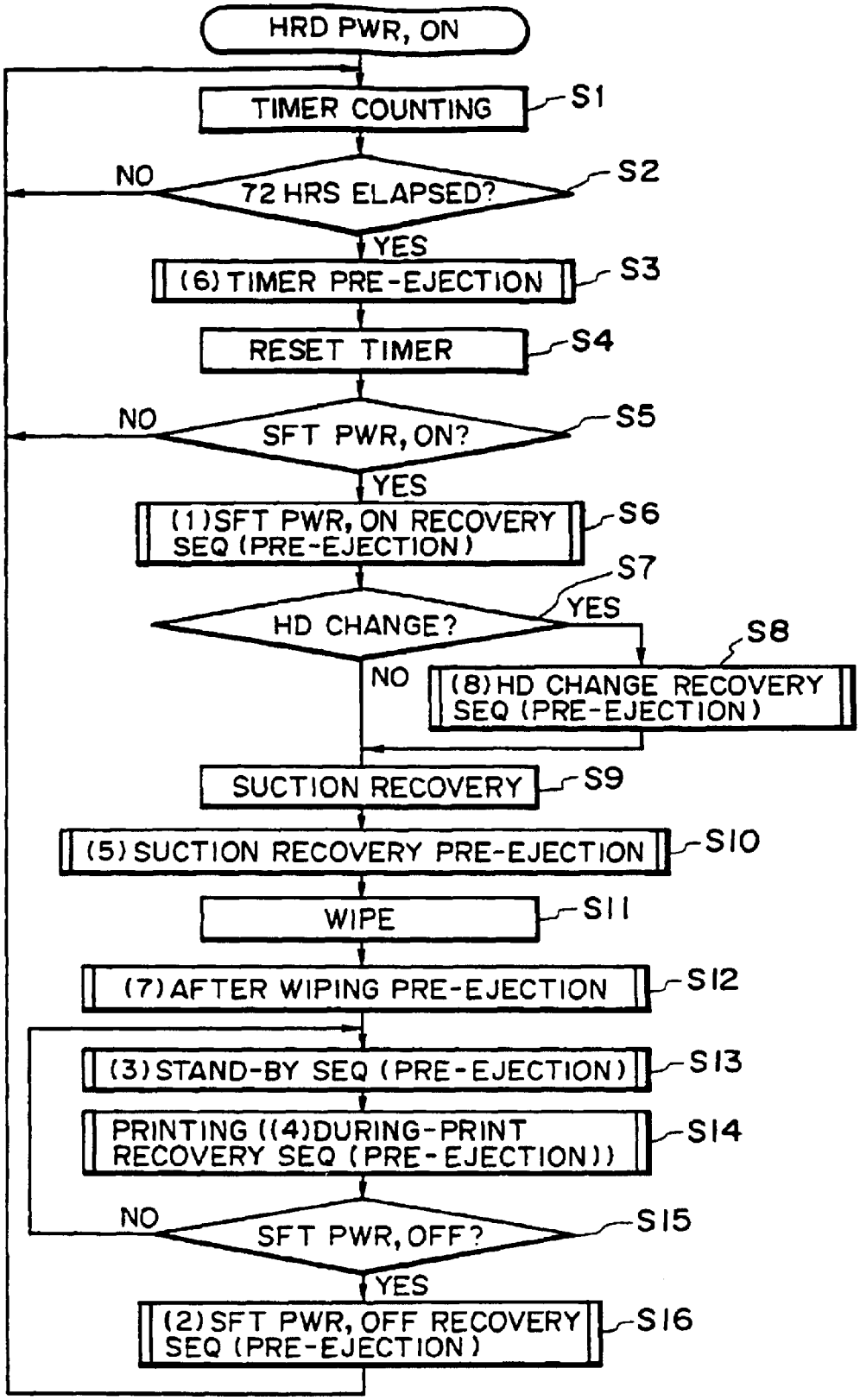
FIG. 24 is a flow chart showing process steps of the whole recording device according to a first embodiment of the present invention.

FIG. 24 is a flow chart showing the process carried out in the liquid ejection recording device in this example.

As shown in the Figure, the preliminary ejection of this example is carried out at various timings in the process being executed, and the ejection mode is different if the timing is different, as will be described hereinafter.

The process is started upon hard power ON, that is, by connecting the power supply code to the plug. If the rest period exceeds 72 hours (steps S1, S2), a timer preliminary ejection process is effected (step S3). Upon soft power ON, that is, upon actuation of the main switch of the recording device (step S5), the preliminary ejection for soft power ON is carried out (step S6).

When the head exchange is carried out (step S7), a preliminary ejection for head exchange is carried out (step S8). When suction recovery or wiping is carried out (step S9, S11), preliminary ejection for suction recovery or preliminary ejection for wiping, are carried out (step S10, S12).

After completion of such process upon the soft power ON, a stand-by sequence operations are carried out, and the preliminary ejection is carried out therein (step S13). Upon the start of the recording operation, the preliminary ejection is carried out as a part of the recovery sequence during the recording operation (step S14).

Upon soft power OFF at the recording completion (step S15), the preliminary ejection for the recovery sequence for the soft power OFF, is carried out (step S16).

Figure 25:
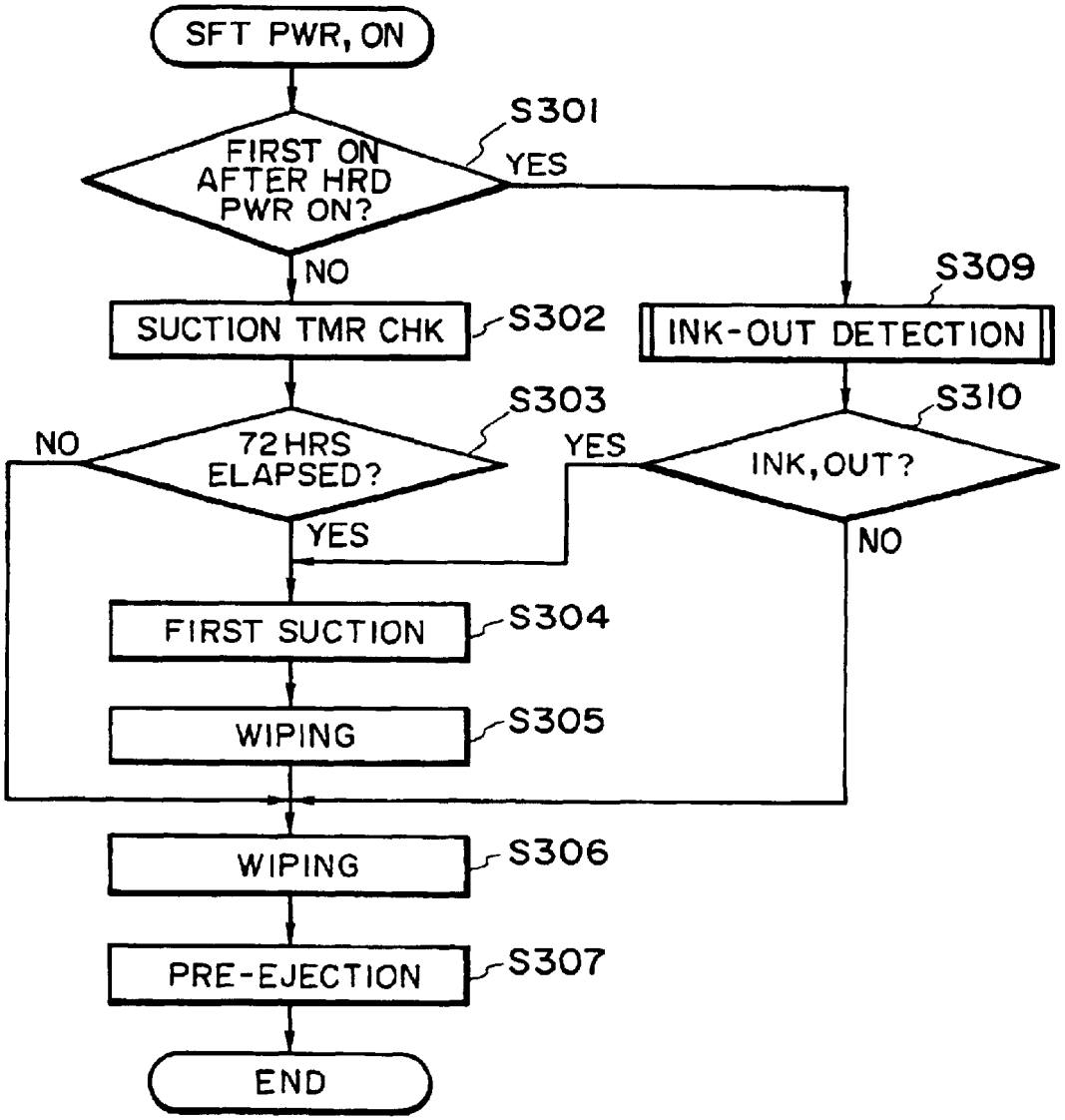
Figure 26:
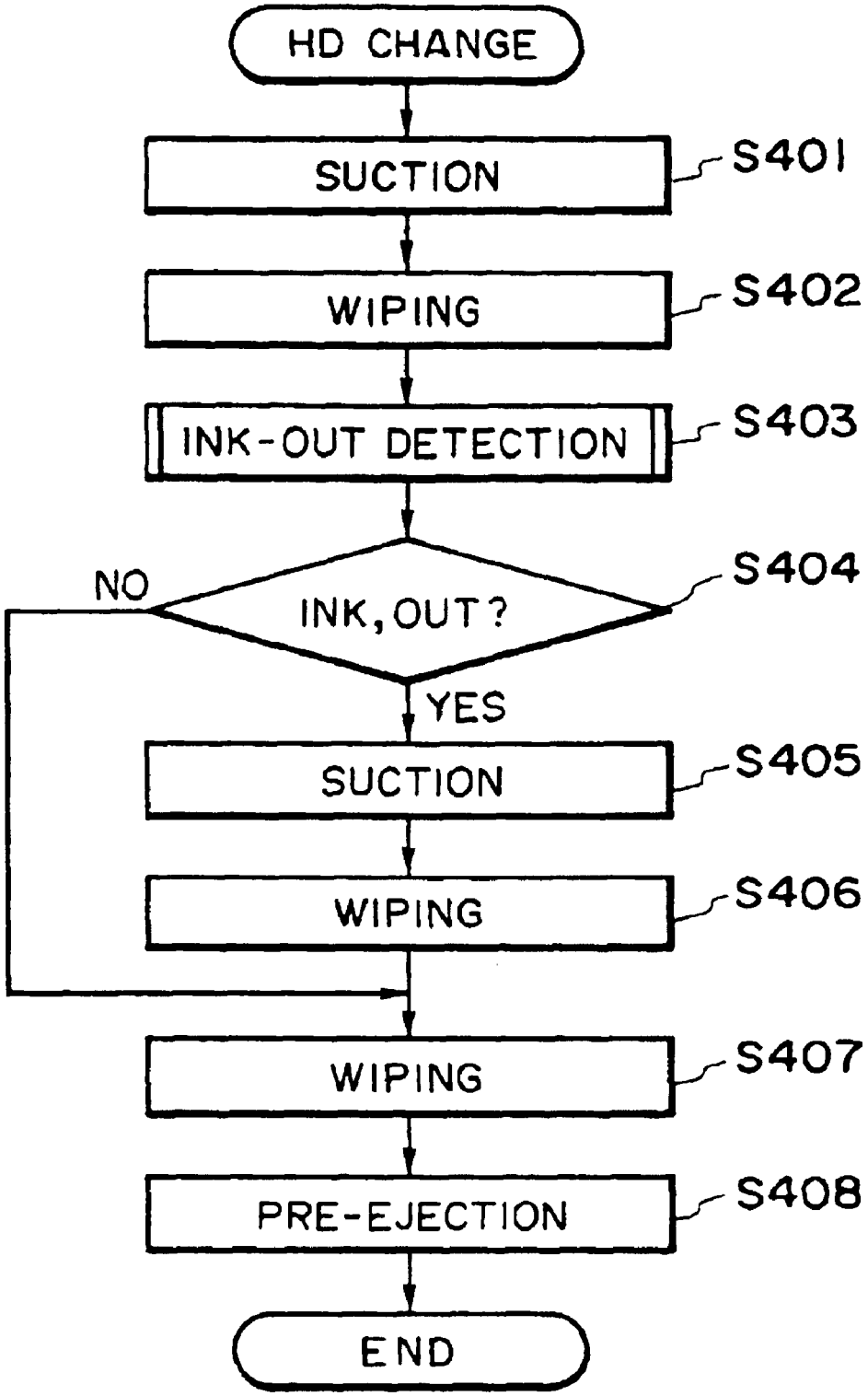
FIG. 26 is a flow chart of a recovery sequence of the process steps of FIG. 24, at the time of head exchange.
Figure 27:
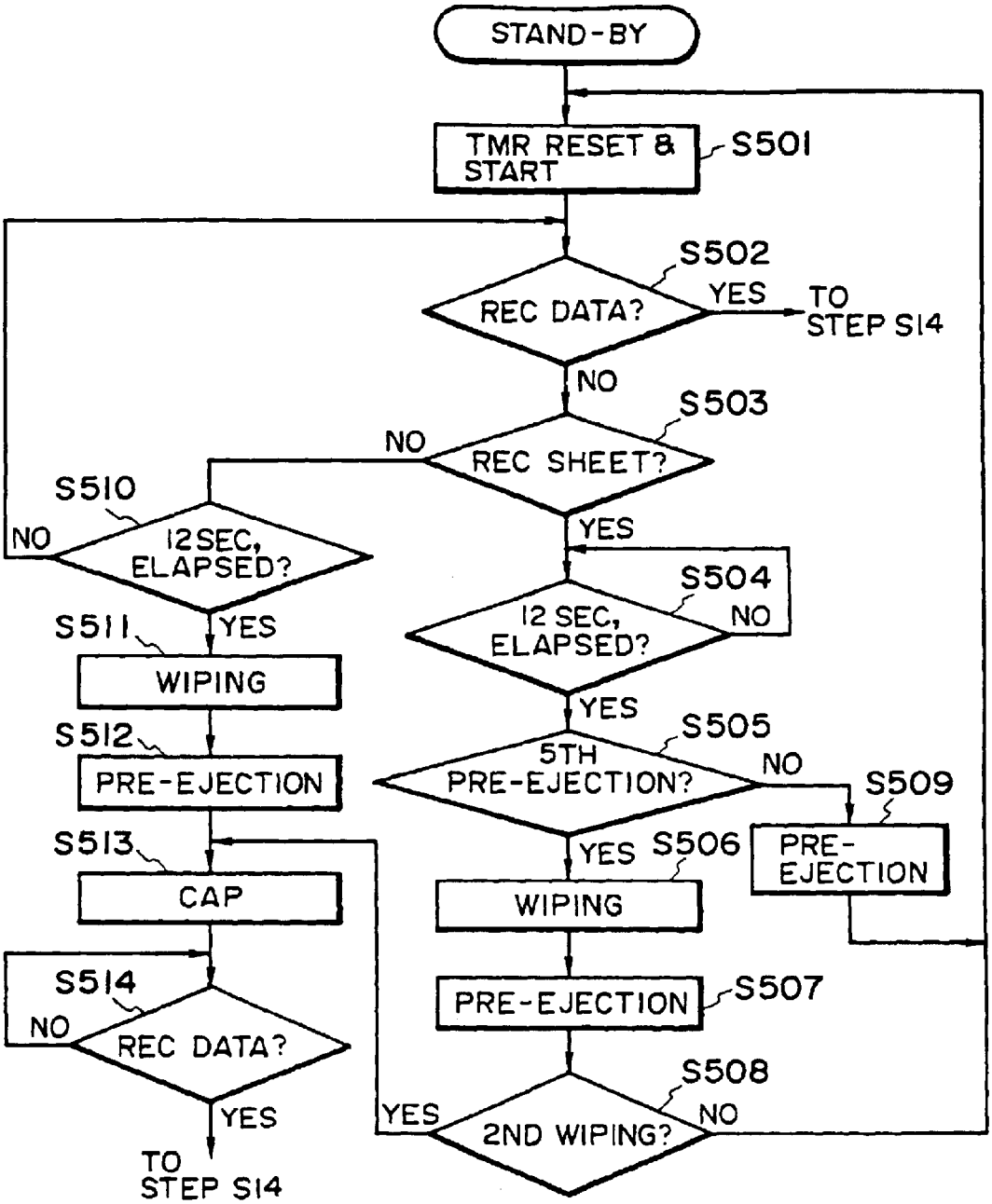
FIG. 27 is a flow chart of a stand-by sequence of the process steps of FIG. 24.
Figure 28:
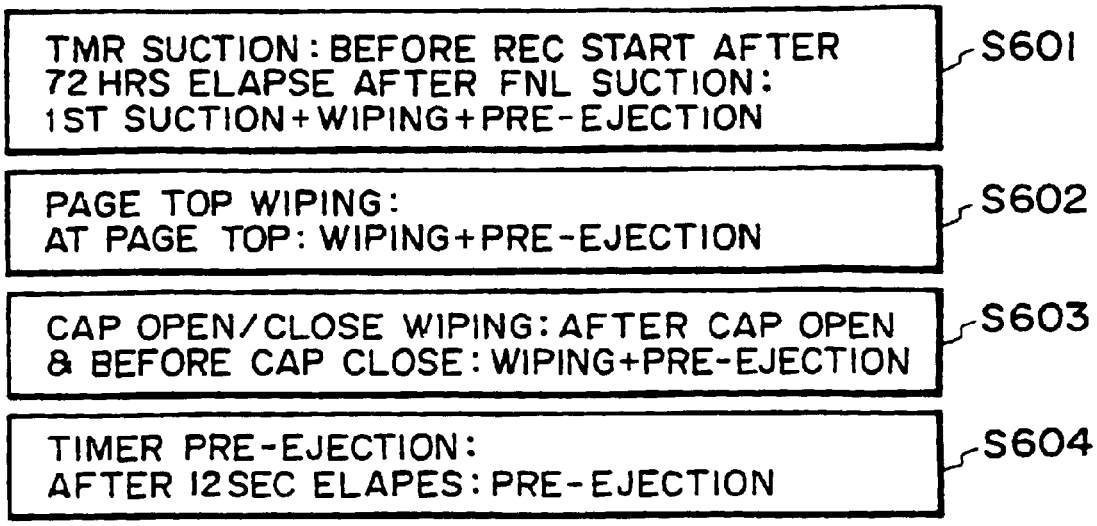
FIG. 28 illustrates a part of the recovery sequence process of the process steps of FIG. 24, during the recording operation.
Figure 29:
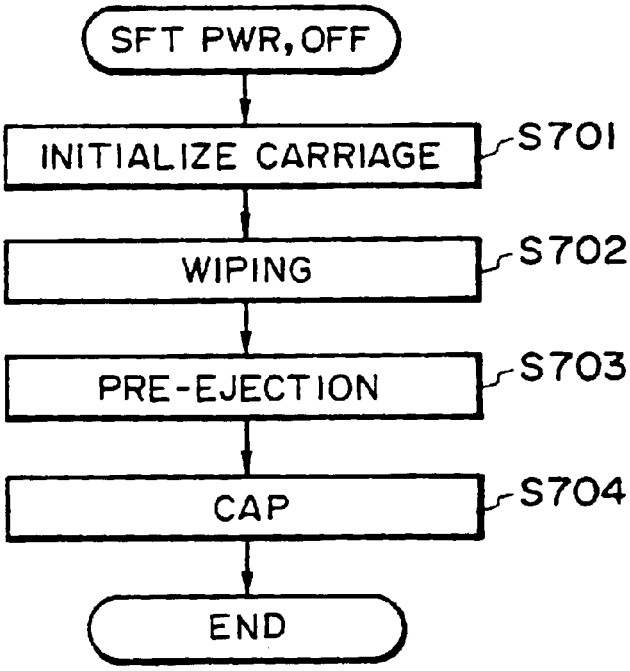
FIG. 29 is a flow chart of a soft power OFF recovery sequence of the process steps shown in FIG. 24.

FIGS. 25–29 show details of sequential operations described with FIG. 24. FIG. 25 shows the recovery sequence at the time of the soft power ON; FIG. 26 shows the recovery sequence at the time of th head exchange; FIG. 27 shows the sequence at the time of the stand-by; FIG. 28 shows four recovery sequence operations during recording operation; and FIG. 29 shows the recovery sequence at the time of the soft power OFF.

As shown in FIG. 25, the preliminary ejection in the sequence at the time of the soft power ON, is carried out (step S306) after the wiping (step S307), before elapse of 72 hours after the refreshing process by the ejection liquid suction (step S303); is carried out (step S307) after the suction operation (step S304) when 72 hours elapses or when ink leakage occurs.

As shown in, FIG. 26, in the recovery sequence at the time of the head exchange, the preliminary ejection is carried out either after the suction operation (step S405) or after the wiping (step S407), depending on whether the ink leakage occurs or not.

In the sequence at the time of the stand-by state, as shown in FIG. 27, the preliminary ejection is carried out (step S509) for each 12 sec elapse during the transfer stand-by of the recording data (step S504). The preliminary ejection is carried out after the wiping (step S506, S511) if 12 sec elapse (step S510) without feeding of the recording paper and after 5 preliminary ejection operations are carried out (step S505).

In the four recording operations shown in FIG. 28, the recovery sequence is carried out as an interrupting process. The process of step S601 is executed when 72 hours elapse from the previous refreshing process. The process of step S602 is carried out upon the start of the recording for one page. The FIG. 28 of the step S603 is carried out immediately before the capping and immediately after the cap opening. The process of step S604 is carried out when 12 sec elapse from the previous effect. The preliminary ejection is executed in this manner.

In the recovery sequence at the time of the soft power OFF shown in FIG. 29, the preliminary ejection is carried out after the wiping (step S703).

The preliminary ejection carried out after only the wiping is effected, among the above-described processes, is similar to the preliminary ejection after the wiping shown in step S12 of FIG. 24.

Now, the fundamental using conditions of the preliminary ejection operations in the above-described processes, will be described.

The conditions are usable for the embodiments which will be described hereinafter.

Usable range of the driving frequency: 1 Hz–30 kHz (usable range)

Driving Pulse and Driving Condition:

1. It is selectable independently of the driving pulse for the recording. Since the preliminary ejection has additional function of aging of the heater (heat generating element), the supplied energy may be larger than the driving pulse for the recording to enhance the effect therefor. For example, the pulse width may be larger. It is desirable that such driving conditions or pulse waveform may be changed in accordance with the non-ejection period of the ejection nozzles, or that it is changed in accordance with the compositions, viscosity of the ejection liquid or the ambient condition such as the temperature or humidity, for example.
2. The pulse shape and pulse number are selectable in accordance with the recording mode. The recording modes include a HG mode (high quality mode), HS mode (high speed recording mode), SHQ mode (ultra high quality mode) or the like. In the high quality mode, for example, high precision recording is possible without density non-uniformity, by pre-pulse control using double pulses.
3. Double pulse mode or single pulse mode is possible.

Drive timing: simultaneous driving is possible with the heater for the head temperature control or with the heater in the liquid chamber such as a rank heater indicating individual recording head property.

Driving position: operable to a preliminary ejection receptor outside the recording region or into a cap.

The timing for the preliminary ejection, is as has been described in conjunction with FIGS. 24–29, and the preliminary ejections at such timings, are operable with selectable frequency and selectable number of ejections, as follows.

(1) preliminary ejection in the recovery sequence at the time of the soft power ON
(preliminary ejection for recovery from the increased viscosity/deposition, of the ink after rest period)
2 kHz, 50–$10^4$ ejections
(2) preliminary ejection in the recovery sequence at the time of soft power OFF
(preliminary ejection for recovery from ink dry in consideration of the rest period after the power OFF)
500 Hz, 50–$10^4$ ejections
(3) preliminary ejection in the recovery sequence at the time of the stand-by state
(preliminary ejection for preventing initial ejection failure due to the ink dry, in the stand-by state)
500 Hz, 20–$10^4$ ejections
(4) preliminary ejection in the recovery sequence during the recording
(preliminary ejection for assuring initial proper ejection and for ejection defect prevention due to wetting with ink/deposition of foreign matter)
500 Hz, 20–$10^4$ ejections
(5) preliminary ejection at the time of the suction recovery
(preliminary ejection at the time of suction recovery (mainly by user))
2 kHz, 20–$10^4$ ejections
(6) timer (72 hours) preliminary ejection
(preliminary ejection for prevention of the last ejection failure due to a bubble produced in the rest period)
500 Hz, 20–$10^4$ ejections
(7) preliminary ejection after wiping
500 Hz, 50–$10^4$ ejections
(8) preliminary ejection in the recovery sequence at the time of the head exchange
(preliminary ejection for assuring avoiding of ink leakage at the time of exchange with a fresh head)
2 kHz, 50–$10^4$ ejections The description will be made as to some of the examples of the ejection frequencies and the numbers ejections of the preliminary ejections in the above-described timings for the initial dynamic viscosities. As shown in the following Embodiments 1–3, the number of the ejections is larger if the initial dynamic viscosity is larger.

(Embodiment 1)

When the ejection liquid had initial dynamic viscosity of 1–2 cP, the preliminary ejection timings (1)–(5) and (8) were used for each ejection outlet with the following frequencies and numbers of the ejections. The results were that the ejection liquid mixing was removed, and that the first ejection upon the ejection start was satisfactory.

(1) preliminary ejection in the recovery sequence at the time of the soft power OFF
500 Hz, 50 ejections
(2) preliminary ejection in the recovery sequence at the time of the soft power ON
2 kHz, 50 ejections
(3) preliminary ejection in the recovery sequence at the time of the stand-by
500 Hz, 20 ejections
(4) preliminary ejection in the recovery sequence during the recording
500 Hz, 20 ejections
(5) preliminary ejection at the time of the suction recovery
2 kHz, 20 ejections
(8) preliminary ejection in the recovery sequence at the time of the head exchange
2 kHz, 50 ejections The preliminary ejection of item (5) may be omitted if the suction recovery is good.

(Embodiment 2)

When the ejection liquid had initial dynamic viscosity of 2–20 cP, the preliminary ejection timings (1)–(5) and (8) were used for each ejection outlet with the following frequencies and numbers of the ejections. The results were that the ejection liquid mixing was removed, and that the first ejection upon the ejection start was satisfactory, as in Embodiment 1.

(1) preliminary ejection in the recovery sequence at the time of the soft power OFF
500 Hz, 2000 ejections
(2) preliminary ejection in the recovery sequence at the time of the soft power ON
2 kHz, 2000 ejections
(3) preliminary ejection in the recovery sequence at the time of the stand-by
500 Hz, 800 ejections
(4) preliminary ejection in the recovery sequence during the recording
500 Hz, 800 ejections
(5) preliminary ejection at the time of the suction recovery
2 kHz, 800 ejections
(8) preliminary ejection in the recovery sequence at the time of the head exchange
2 kHz, 2000 ejections The sequence of (3) is particularly desirable when the viscosity of the ejection liquid is high.

In the foregoing preliminary election operations, the preliminary ejections (1)–(3) are particularly effective to avoid first ejection defect after the increase of the ejection liquid viscosity and the prevention of the mixed liquid ejection printing.

(Embodiment 3)

When the ejection liquid had initial dynamic viscosity of 2–100 cP, the preliminary ejection timings (1)–(5) and (8) were used for each ejection outlet with the following frequencies and numbers of the ejections. The results were that the ejection liquid mixing was removed, and that the first ejection upon the ejection start was satisfactory, as in Embodiment 1.

(1) preliminary ejection in the recovery sequence at the time of the soft power OFF
500 Hz, 5000 ejections
(2) preliminary ejection in the recovery sequence at the time of the soft power ON
2 kHz, 5000 ejections
(3) preliminary ejection in the recovery sequence at the time of the stand-by
500 Hz, 2000 ejections
(4) preliminary ejection in the recovery sequence during the recording
500 Hz, 2000 ejections
(5) preliminary ejection at the time of the suction recovery
2 kHz, 2000 ejections
(8) preliminary ejection in the recovery sequence at the time of the head exchange
2 kHz, 5000 ejections In the foregoing preliminary ejection operations, the preliminary ejections (1)–(3) are particularly effective to avoid first ejection defect after the increase of the ejection liquid viscosity and the prevention of the mixed liquid ejection printing. Namely, it is effective to avoid the deterioration of the initial image quality of the image recorded on the recording material.

The driving pulse used in Embodiments 1–3, is a single pulse with the pulse width of 3–50 μscc. When the pulse width of 30 μsec approx. was used with Embodiment 3, the decrease of the dynamic viscosity due to the temperature rise is remarkable, and the ejection state of the first ejection was good.

(Embodiment 4)

In this embodiment, the similar process of Embodiment 2 was used, but initial pulse width was 20 μscc, and one half of the entire preliminary ejection was carried out with this pulse width, and the rest thereof was carried out with the pulse width of 5 μscc. First ejections were satisfactory.

(Second Embodiment)

In the second embodiment, the ejection state in the preliminary ejection is detected, and the preliminary election mode is changed on the basis of the detection result.

The dynamic viscosity generally changes mainly depending on the pressure and temperature. In a liquid recording device, the temperature or humidity relatively greatly changes depending on the use ambience or use state. Therefore, the preliminary ejection may be excessive or insufficient, in the first embodiment wherein the dynamic viscosity is predicted from the rest period. Even in the case where the number of the preliminary elections is large because the rest time is relatively long, the dynamic viscosity may be quite low it the ambient temperature is high or if the humidity is high. Therefore, in such a case, the selected number of the preliminary ejections, will be excessively large.

Figure 30:
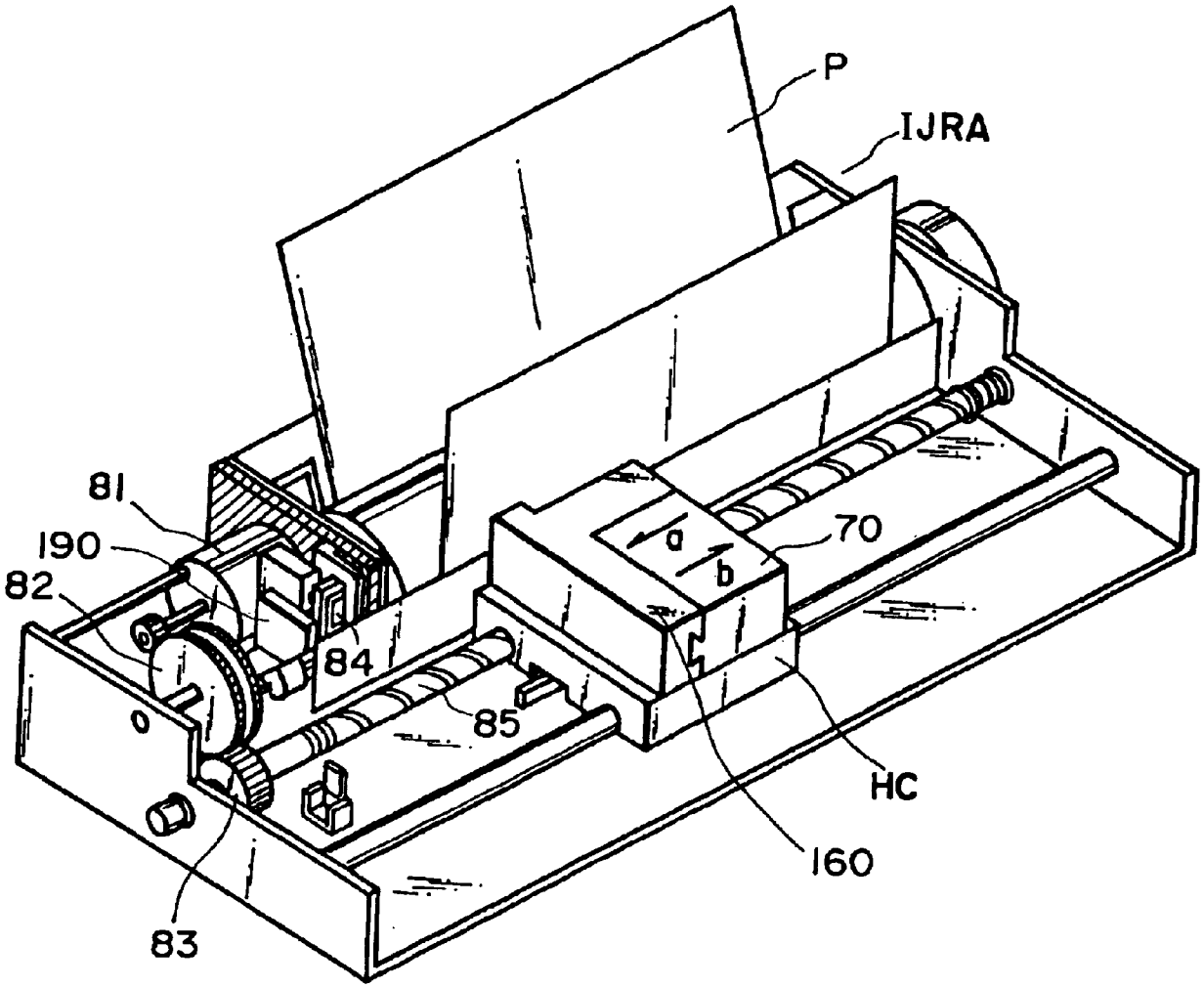
FIG. 30 is a perspective view showing a liquid ejecting apparatus according to a second embodiment of the present invention.
Figure 31:
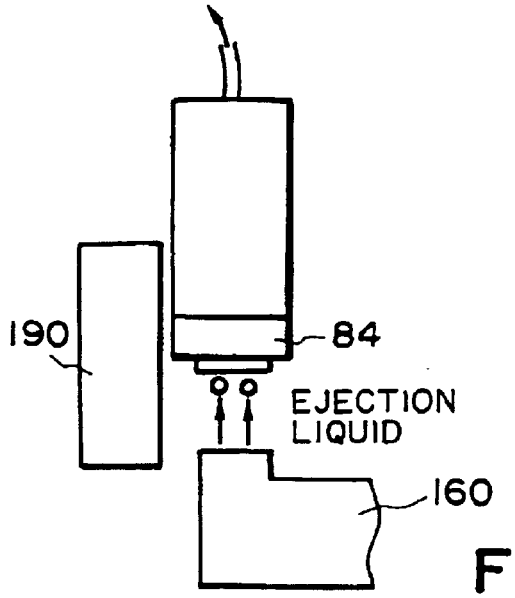
FIG. 31 is a top plan view illustrating a structure for dynamic viscosity detection.

In this example, as shown in FIG. 30, there is provided a sensor unit 190 for dynamic viscosity detection, adjacent the capping unit at the home position. FIG. 31 shows a positional relation between the sensor unit 190 and the head 160 or the like.

In these Figures, when the ejection is carried out to the cap 84 from the ejection head 160 at the time of the preliminary ejection, light of LED stroboscope is emitted at predetermined timing from the sensor unit 190. The light is reflected by the ejection liquid in the ejection range thereof, and is detected by CCD in the sensor unit 190. The emission timing of the LED stroboscope is set to be delayed by predetermined time from the pulse application timing for the ejections in the preliminary ejection. When the ejected droplet is in the ejection range upon the emission of the LED stroboscope, and therefore, the reflected light is detected, the liquid ejection (ejection frequency) follows the application (driving frequency) of the liquid ejection, and therefore, It is discriminated that the dynamic viscosity is at a predetermined low level.

Figure 32:
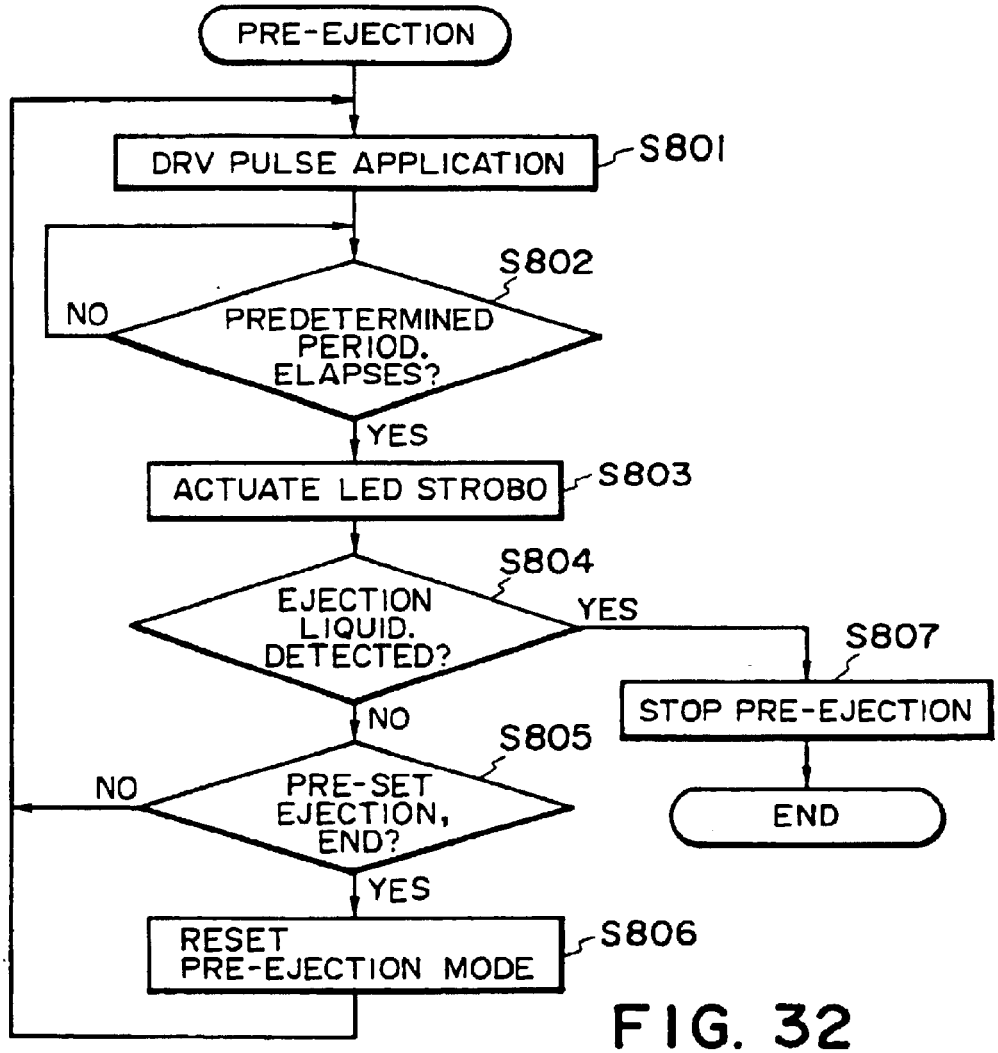
FIG. 32 is a flow chart of preliminary sequence.

FIG. 32 is a flow chart showing a preliminary ejection sequence used with the structure shown in FIGS. 30 and 31.

As shown in the same Figure, LED stroboscope is actuated with a predetermined time delay for each driving pulse application (step S801) in the preliminary ejection, the detection is made at th same timing as to whether there is an ejection liquid in the range where it is supposed to exist (step S802–S804). When the ejected droplets are detected as a result, it is considered that the dynamic viscosity is low enough, and therefore, the preliminary ejection is stopped.

On the other hand, if the ejected droplet is not detected (step S804), and if the selected number of preliminary ejections are completed (step S805), it is considered that the preliminary ejection is insufficient, and the pulse width, the number of ejections of the preliminary ejection is set again (step S806) to carry out the preliminary ejection further.

Thus, according to this embodiment, the preliminary ejection is carried out to proper extent.

Figure 33:
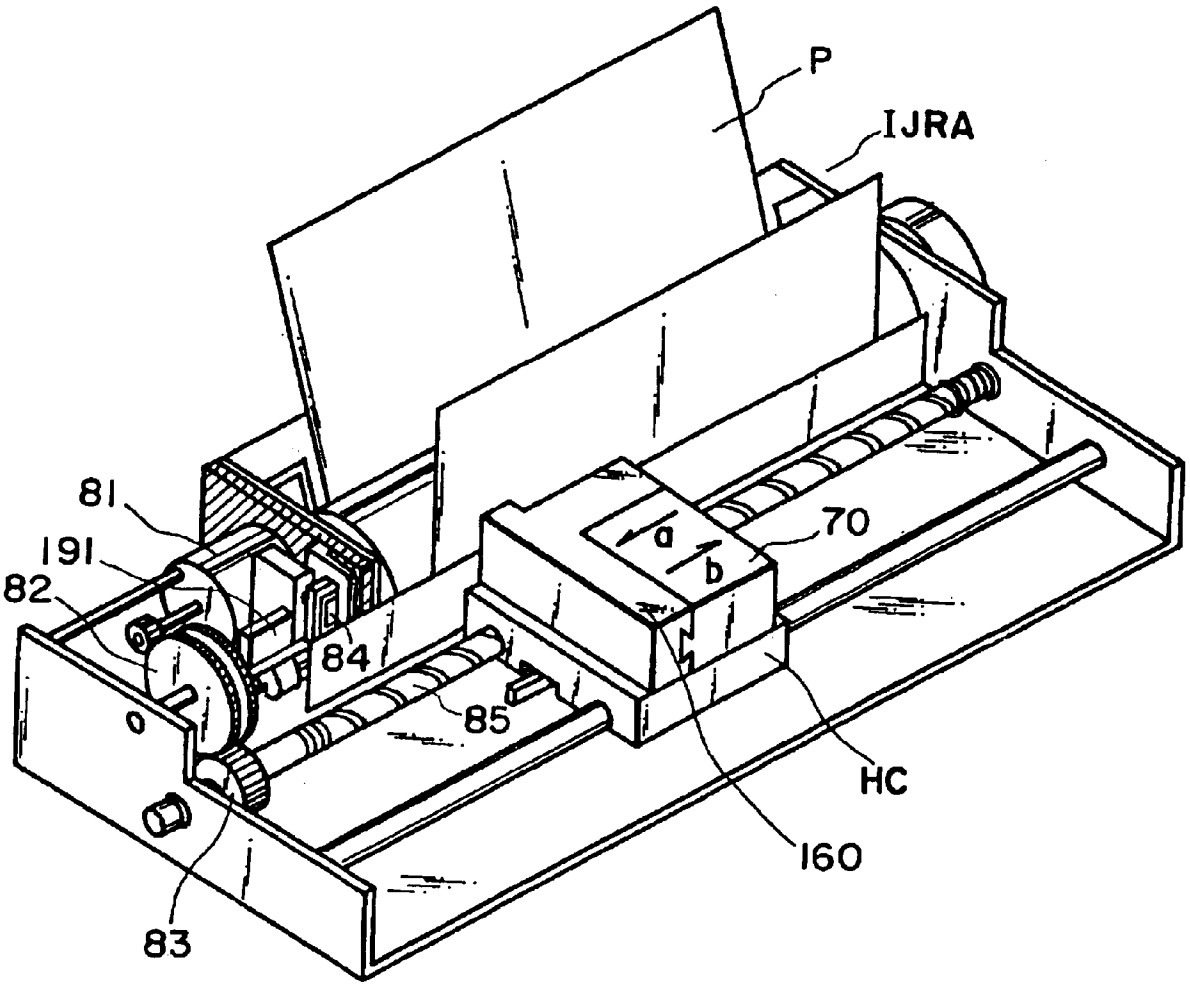
FIG. 33 is a perspective view showing an example of another structure of a liquid ejecting apparatus according to a second embodiment of the present invention.

FIG. 33 shows another example of this embodiment. In this Figure, designated by 191 is a glass plate provided adjacent to the cap 84. The surface of the glass plate 91 is painted into white, and the head 160 ejects the liquid onto the glass plate 91 in the preliminary ejection.

In FIG. 33, the mixture in the ejection head is detected, and the density of the ejection liquid deposited on the glass plate 191 is detected by optical detecting means. When the detected density is above a predetermined level (the density of the ejection liquid without mixture), the preliminary ejection is stopped.

Figure 34:
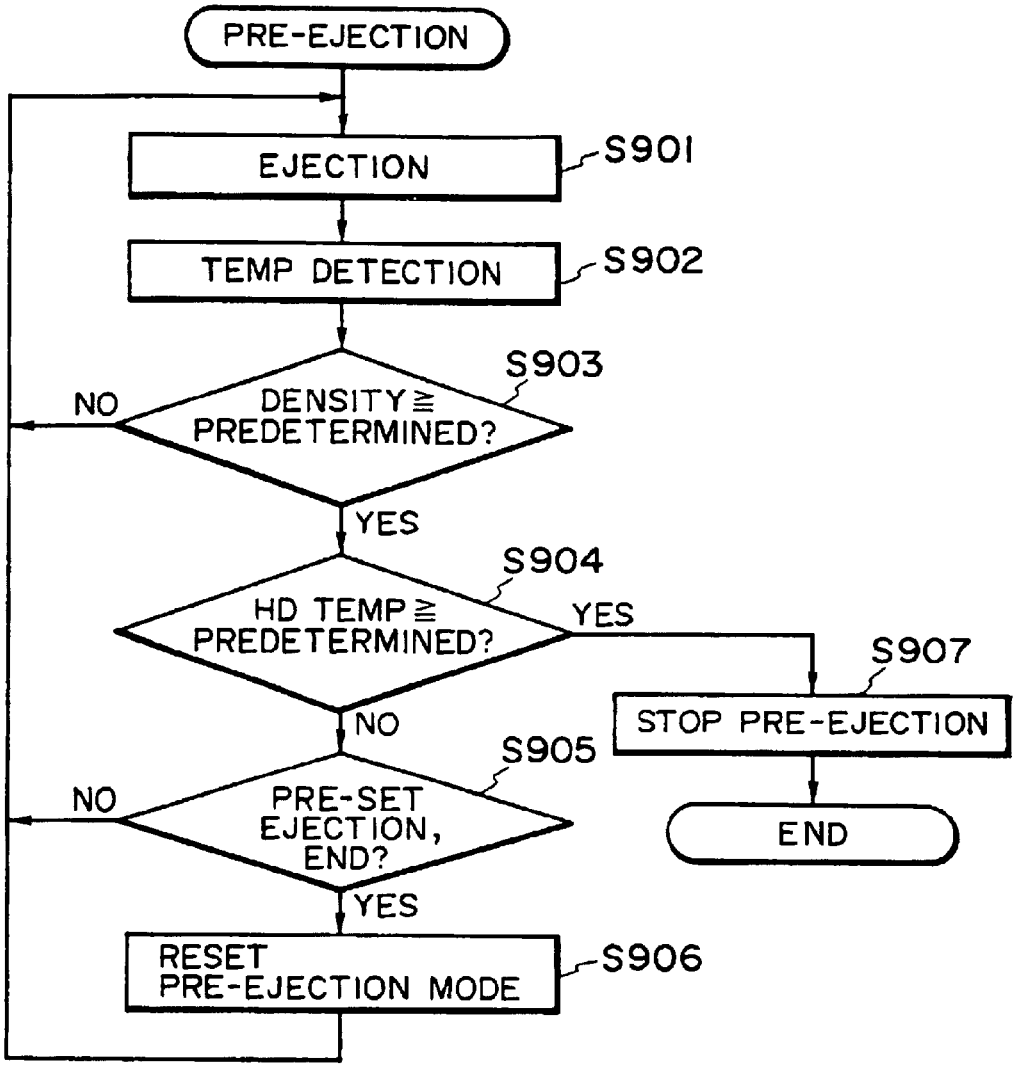
FIG. 34 is a flow chart of preliminary sequence.

FIG. 34 is a flow chart of the preliminary ejection sequence in the mixed liquid detection.

As shown in this Figure, when it is discriminated that the ejection liquid deposited on the glass plate 91 at step S903 is not less than the predetermined density, the discrimination is made as to whether the head temperature is not less than predetermined temperature or not at step S904. This is made, since even if the mixed liquid is removed, the dynamic viscosity may be high. So, the dynamic viscosity is checked using the head temperature. When the density is not less than a predetermined value, and the head temperature is not less than a predetermined temperature, it is considered that the mixture and the viscosity increase has been obviated, so that the preliminary ejection is stopped.

According to this example, the preliminary ejection can be further reduced.

(Third Embodiment)

Figure 35:
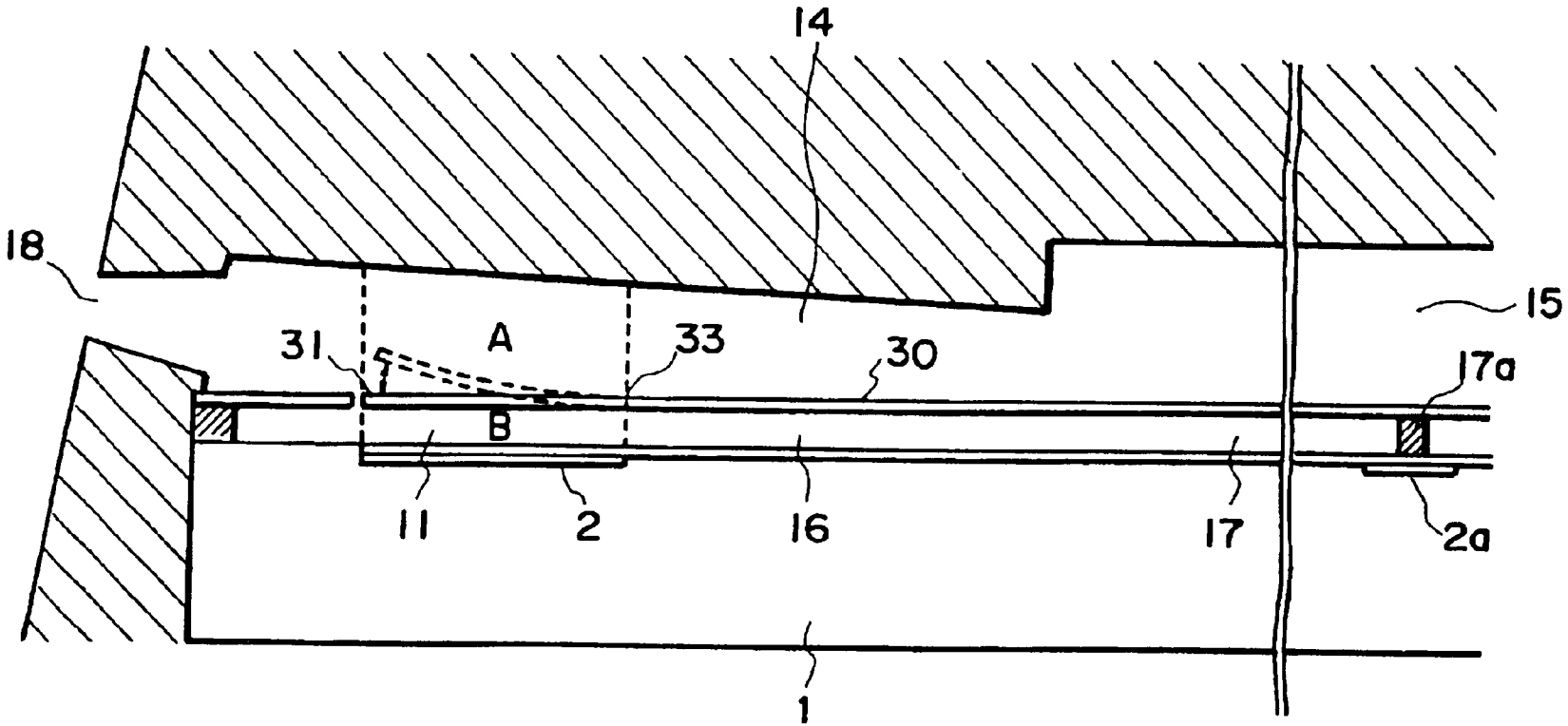
FIG. 35 is a schematic view showing a liquid ejecting head according to a further embodiment of the present invention.

FIG. 35 is a schematic sectional view, in a flow path direction, of the liquid ejecting head according to an embodiment of the present invention.

FIG. 35 shows this embodiment, and is similar to FIG. 9 in the fundamental structure, but on the element substrate 1 constituting the bottom portion in the common liquid chamber 17, a heat generating element 2*a* as heating means is provided, and a columnar member 17*a* of thermally conductive material is planted in a bottom surface of the separation wall 30 and is extended so as to be in contact with the heat generating element 2*a*. The columnar member 17*a* functions to support the internal structure of the common liquid chamber 17 and to quickly transmit the heat from the heat generating element 2*a* to the separation wall 30 of thermally conductive material. Therefore, the heat of the heat generating element 2*a* heated to a predetermined temperature, functions to heat the bubble generation liquid in the second liquid flow path 16 and to heat the ejection liquid in the first liquid flow path 14 through the columnar member 17*a* and the separation wall 30. By this heating, the viscosity of the ejection liquid is lowered, the first ejection of the liquid ejecting head is improved in this example.

The description will be made as to a position of the heat generating element 2*a* as the heating means.

(Fourth Embodiment)

Figure 36:
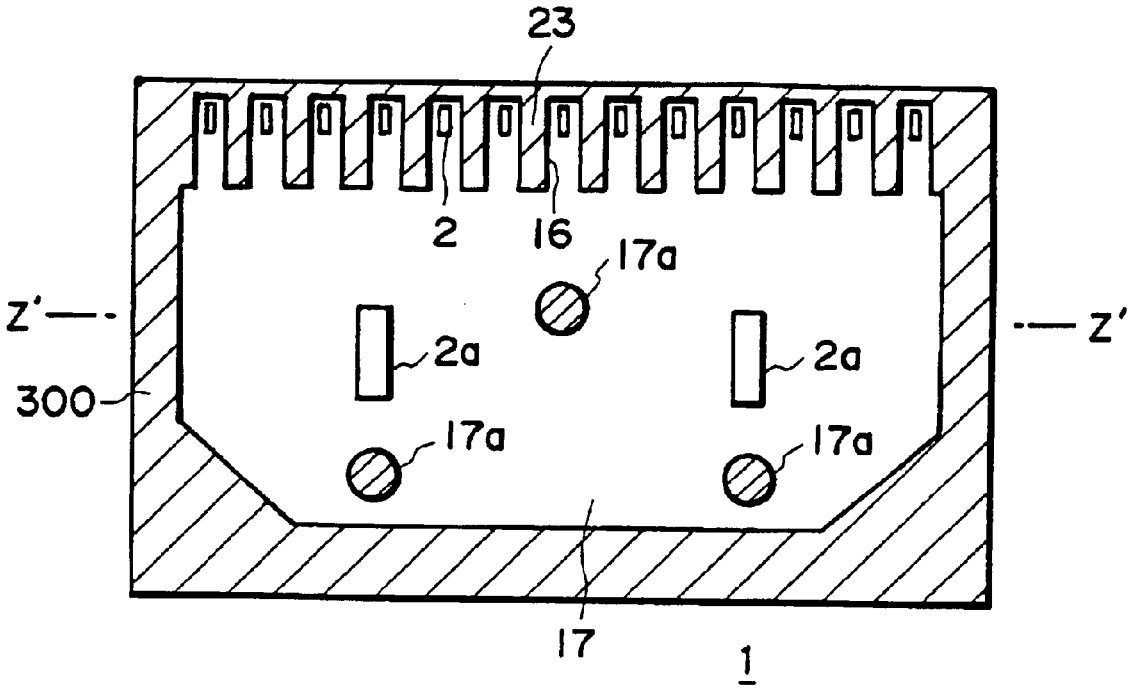
FIG. 36 illustrates arrangements of heating means on an element substrate of a liquid ejecting head according to an embodiment of the present invention, wherein (a) is top plan view, and (b) is a sectional view taken along a line z–z' line.
Figure 36:
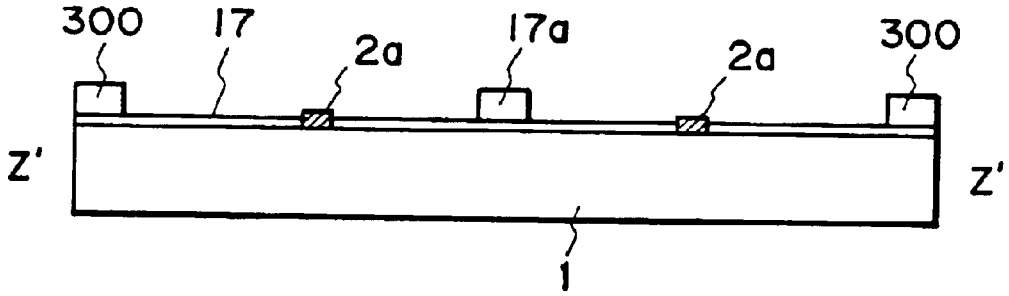

FIGS. 36, (*a*) and (*b*), shows arrangement of the heat generating element 2*a* as the heating means formed on the element substrate 1 in the liquid ejecting head of the present invention; and (*a*) is a top plan view taken along a line parallel with the surface of the element substrate 1 at a position in the second liquid flow path, and (*b*) is a sectional view taken along a line z–z' line in (*a*).

The second liquid flow path 16 is formed by the liquid flow wall 23, and the element substrate is provided with heat generating elements 2 corresponding to the second liquid flow path. The heat generating element 2*a* creates a bubble in the liquid in the second liquid flow path 16 by the heat generated thereby. The element substrate, at the position corresponding to the common liquid chamber 17 for supplying the liquid to each second liquid flow path 16, is provision with heating means 2*a* for heating the bubble generation liquid in the common liquid chamber and for heating the liquid (ejection liquid) in the first liquid flow path through the separation wall disposed on the common liquid chamber. The heating means 2*a* and the heat generating element 2 are connected with wiring for supplying electric signals thereto.

The common liquid chamber is provided with a columnar member 17 for supporting the separation wall.

In this example, the wall constituting the second liquid flow path and the columnar member, are simultaneously formed by patterning a DRY FILM of photosensitive resin material.

The material of the columnar member, may be polysulfone, polyethylene or anther resin material, or gold, nickel, silicon or another metal, or glass.

For the simplification of the manufacturing step, the material is preferably the same as that of the separation wall.

When the columnar member or the liquid flow passage wall constituting the second liquid flow path, are formed with the material having low thermal conductivity such as resin material, it is preferably separated from the heat generating element 2*a* by not less than 0.1 mm since then the effect of convection of the liquid is added, so that the heat can be more effectively transferred. In order to feed to the second liquid flow path the liquid uniformly and sufficiently heated in the liquid chamber, the heat generating element 2*a* is preferably disposed adjacent the liquid chamber separated from the trailing edge of the common liquid chamber of the liquid flow path by not less than 0.5 mm.

A liquid ejecting head provided with the element substrate 1 of the structure shown in FIGS. 36, (*a*) and (*b*), was manufactured. The ink having the viscosity 100 cP was used as the ejection liquid. An aqueous solution of ethanol 20% was used as the bubble generation liquid. The heating means 2*a* was heated to 45° C. Then, the heat was transferred mainly through the bubble generation liquid and the separation wall so that the viscosity of the ejection liquid was decreased to 50 cF, and the first ejection at the record start was improved with the stabilized feathering in the recording material.

(Fifth Embodiment)

Figure 37:
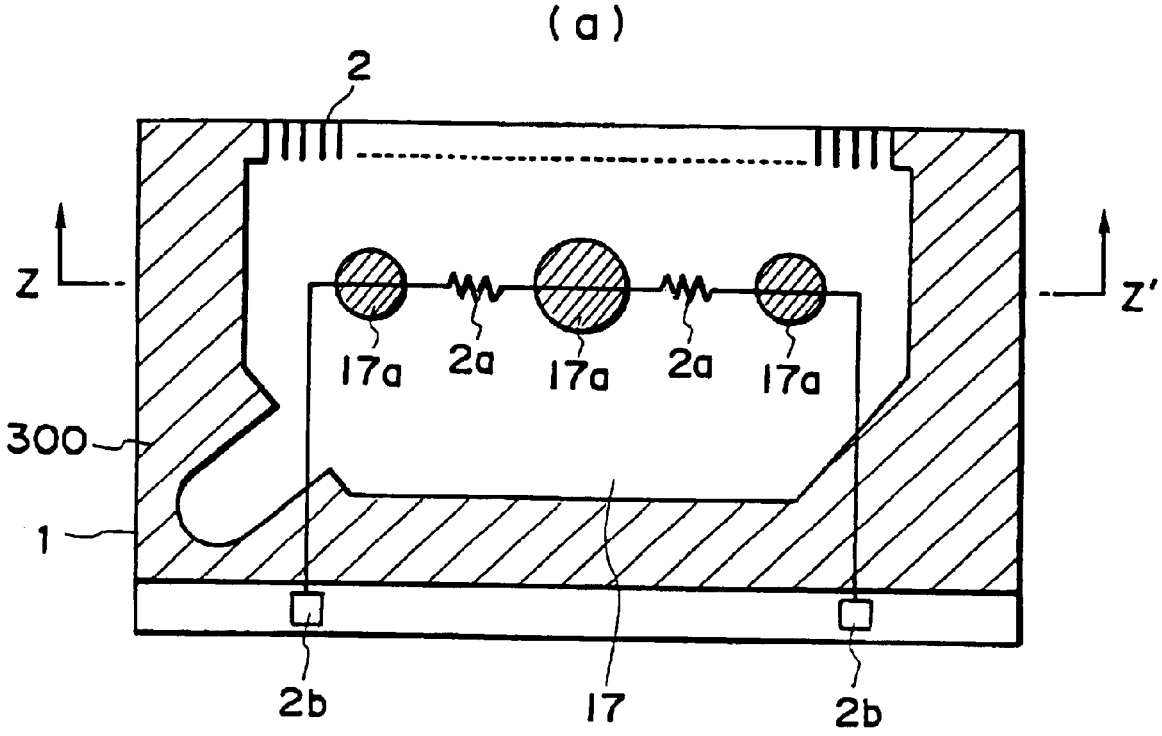
FIG. 37 illustrates arrangements of heating means on an element substrate of a liquid ejecting head according to an embodiment of the present invention, wherein (a) is top plan view, and (b) is a sectional view taken along a line z–z' line.
Figure 37:
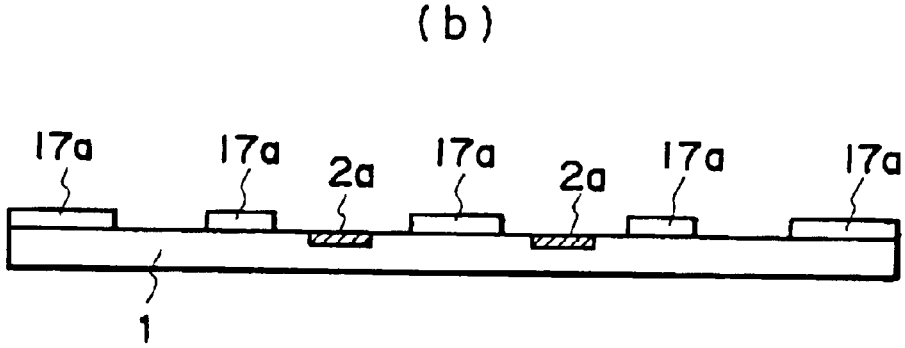

FIGS. 37, (*a*) and (*b*) shows a structure of heating means 2*a* formed on the element substrate 1 in a liquid ejecting head according to an embodiment of the present invention, wherein (*a*) is a top plan view, and (*b*) is a sectional view taken along z–z' line in (*a*). Each element of this embodiment is the same as in the previous embodiment. However, in this example, the columnar member 17*a* is formed precisely through electro-forming method, from nickel having a thermal conductivity of 90.5 w/m, k, for example, together with the separation wall. In this example, the columnar member 17*a* is of high thermal conductivity material, and therefore, the heat generated by the heating means is more easily transferred to the first liquid flow path, so that the ejection liquid in the first liquid flow path is more efficiently heated. The material of the columnar member may be any if the thermal conductivity thereof is high, for example, it may be gold, silicon, nickel, tungsten or another metal material.

By the integral formation of the columnar member and the separation wall, the efficiency of the heat conduction is further increased.

A liquid ejecting head provided with the element substrate 1 of the structure shown in FIGS. 37, (*a*) and (*b*), was manufactured. The ink having the viscosity 100 cP was used as the ejection liquid. An aqueous solution of ethanol 20% was used as the bubble generation liquid. The heating means 2*a* was heated to 45° C. Then, the heat was transferred mainly through the bubble generation liquid and the separation wall so that the viscosity of the ejection liquid was decreased to 50 cP, and the first ejection at the record start was improved with the stabilized feathering in the recording material.

(Sixth Embodiment)

Figure 38:
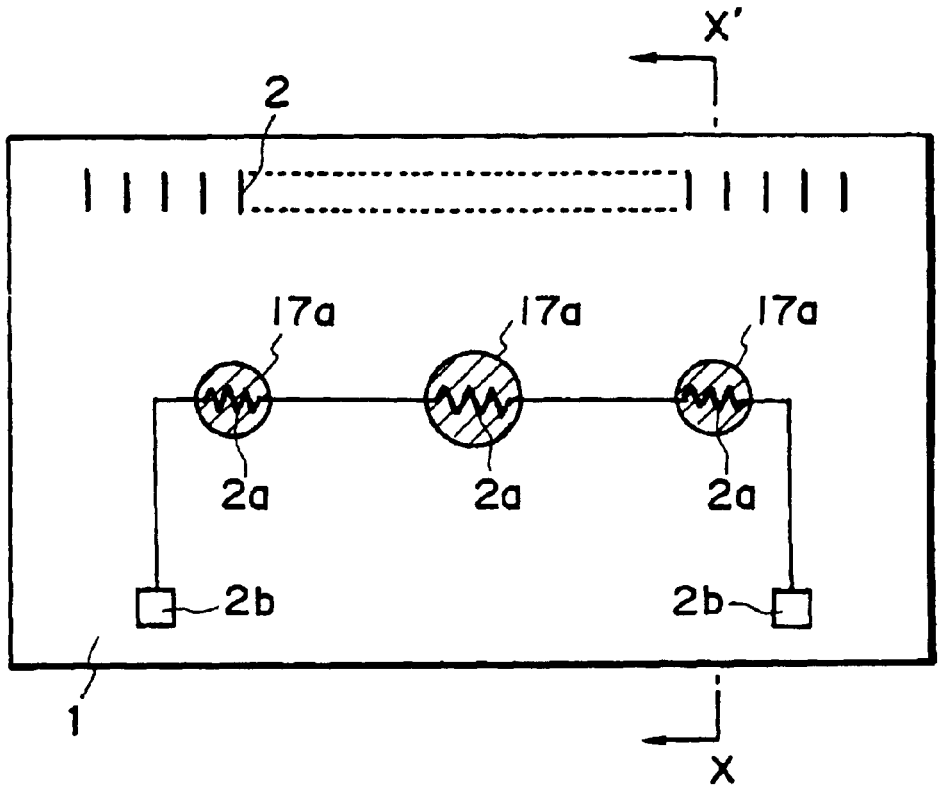
FIG. 38 illustrates arrangements of heating means on an element substrate of a liquid ejecting head according to an embodiment of the present invention, wherein (a) is top plan view, and (b) is a sectional view taken along a line z–z' line.
Figure 38:
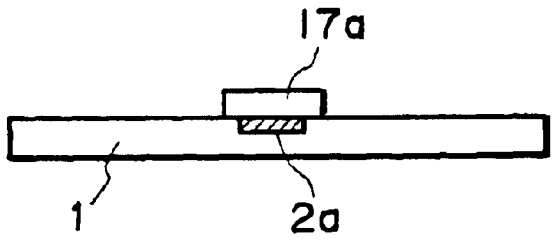

FIGS. 38, (*a*) and (*b*) shows a structure of heater 2*a* formed as the heating means on the element substrate 1 in a liquid ejecting head according to an embodiment of the present invention, wherein (*a*) is a top plan view, and (*b*) is a sectional view taken along z–z' line in (*a*). In this example, the structures are similar to those of the foregoing embodiment, and the detailed description thereof is omitted for simplicity. In this example, the heat generating elements 2*a* are provided at three positions, and they are energized through contacts 2*c* to be heated to a predetermined temperature. As shown in FIG. 38, (*a*), an end of a columnar member 17*a* is positioned and contacted to the position R right above the heat generating elements 2*a*. The heat generating element may be the heat generating resistance layer alone and may be the one including the heat generating resistance layer and a protection layer thereon. In the latter case, the end of the columnar member is contacted to the protection layer of the heat generating element.

The columnar member in this embodiment is formed through the electro-forming method from the same metal as the separation wall, nickel, for example, similarly to the previous embodiment. The material of the columnar member may be any if thermal conductivity thereof is high, as in the previous embodiment.

By the formation of the columnar member on the heating means as in this example, the heat generated by the heating means is efficiently transmitted to the first liquid flow path through the columnar member, and the liquid in the first liquid flow path can be efficiently heated.

In this example, it has been confirmed that by raising the temperature of the heat generating element 2*a* as the heating means to 25–60° C., the heat is efficiently transmitted to the liquid in the first liquid flow path 14 through the columnar member 17*a*. A liquid ejecting head provided with the element substrate 1 of the structure shown in FIGS. 38, (*a*) and (*b*), was manufactured. The ink having the viscosity 100 cP was used as the ejection liquid. An aqueous solution of ethanol 10% was used as the bubble generation liquid. The heating means 2*a* was heated to 50° C. Then, the heat was transferred mainly through the bubble generation liquid and the separation wall so that the viscosity of the ejection liquid was decreased to 40 cP, and the first ejection at the record start was improved with the stabilized feathering in the recording material.

In the foregoing embodiments, the structure below the separation wall, namely, the second liquid flow path and the second common liquid chamber portion in fluid communication with it, is taken.

The first liquid flow path and the first common liquid chamber in fluid communication with it, are formed by coupling a separation wall 30 and a top plate having an orifice plate having the ejection outlets 18, a grooved top plate having grooves for constituting liquid flow paths 14 and a recess for constituting a first common liquid chamber 15 commonly in fluid communication with the liquid flow paths 14 and for supplying the first liquid into the liquid flow paths.

(Seventh Embodiment)

Figure 39:
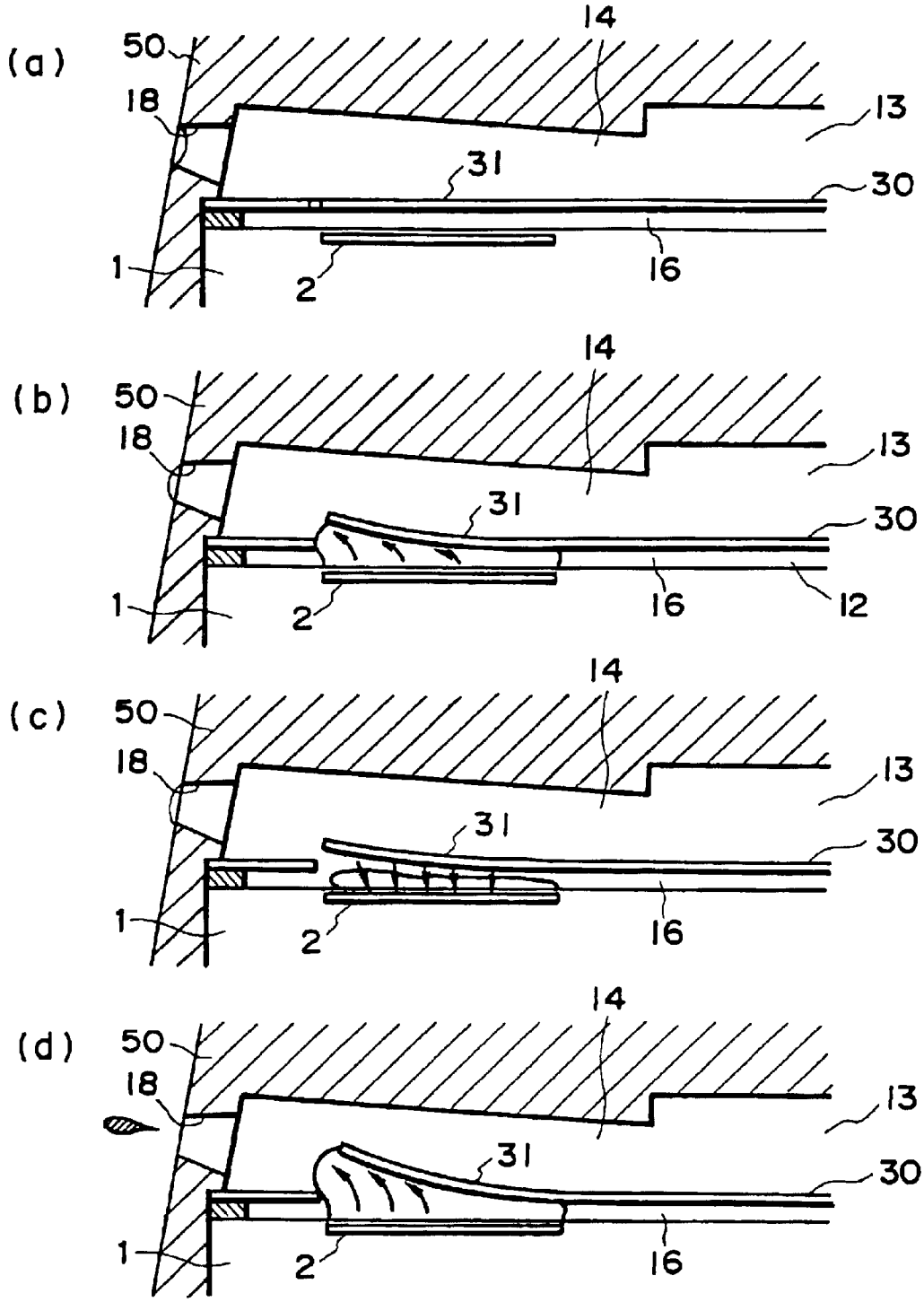
FIG. 39, consisting of FIGS. 39(*a*)–39(*d*), are sectional views of a liquid flow path of a head using a driving method according to a seventh embodiment of the present invention.

FIGS. 39, (*a*) and (*b*) illustrate driving process for a liquid ejecting head according to an embodiment of the present invention, wherein the liquid ejecting head has the same structure as with the liquid ejecting head shown in FIG. 9.

Figure 40:
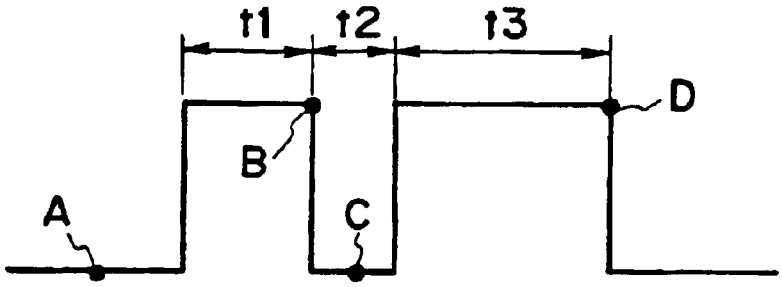
FIG. 40 shows pulses for driving, according to an embodiment of the present invention.

In this ejection head, the movable member 31 is driven by driving the heat generating element 2, and by the resultant displacement of the movable member 31, the ejection liquid is ejected. The heat generation sequence for the heat generating element includes a feature. FIG. 40 shows driving pulses for the heat generating element 2 in this embodiment, and each position A, B, C, D of the pulse corresponds to timings (*a*), (*b*), (*c*), (*d*) in FIG. 39, respectively.

When the liquid ejecting head is to be driven, the heat generating element 2 is supplied with a voltage having a pulse width t1, and then, it rests for time t2. Thereafter, the voltage of the pulse width t3 is applied to eject the liquid. In FIG. 39, (*a*) shows a state wherein the liquid is not yet formed into a bubble by thermal energy from the heat generating element. In (*b*), first bubble generation occurs, and the bubble generation at this time is not enough to eject the liquid, but is enough only to displace the movable member 31 to a small extent. This is accomplished by using small pulse width or low voltage or by using a h at generating element having a size smaller than that for ejecting the liquid in the same nozzle. In (*c*), the collapse of bubble occurs during the rest period, wherein the movable member 31 is still moving, that is, it has not yet reached the initial state. In (*d*), the second bubble generation occurs. The second bubble generation is produced by a voltage having a pulse width t3 which is larger than that in the first pulse and therefore supplying larger bubble generation power. So, the movable member 31 displaces to a larger extent than in (*b*) so that the liquid is ejected in the form of a droplet onto an unshown recording material.

Figure 41:
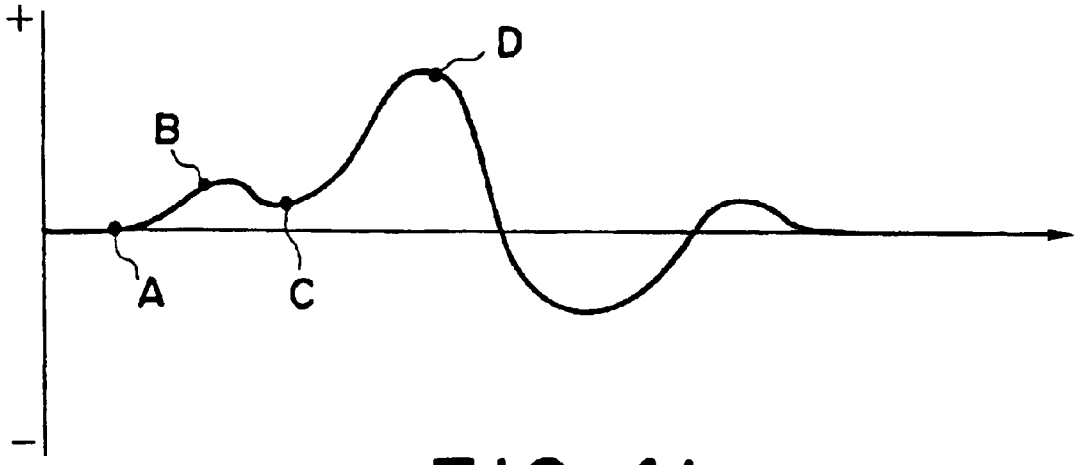
FIG. 41 is a graph showing displacement of a meniscus with time at the ejection outlet position.

FIG. 41 is a graph showing vibrations of a meniscus of the liquid at the ejection outlet 3 at the points of time A–D shown in FIG. 40. At A, no change of the meniscus occurs; at B, the meniscus projects (+ direction); at C, it tends to retract, but is still projected to a small extent. With this state, the bubble generation with pulse width t3 occurs, and therefore, the meniscus is projected at all times upon an ejecting bubble generation.

Therefore, in this embodiment, the movable member is once displaced, by which the displacement of the movable member and the state of the meniscus are constant when the ejecting bubble generation occurs, so that the ejection amount is stabilized. In addition, by once displacing the movable member into the first liquid flow path by the first bubble generation, the bubble generation power upon the second bubble generation may be smaller, and most of the power is directed toward the ejection outlet, so that the ejection amount is larger than when the liquid is ejected with a single pulse. When the ejection amount is desired to be smaller to form a smaller dot, the ejection may be caused when the meniscus is retracted.

When the non-ejection period is long, this operation may be carried out at the initial stage, by which the ambience of the liquid fluid around the movable member, is such that the movable member is easily displaced, and simultaneously therewith, the fixing and viscosity increase of the liquid adjacent the meniscus portion are eased, and therefore, the initial ejection stability and the first ejection occurrence are improved.

Figure 42:
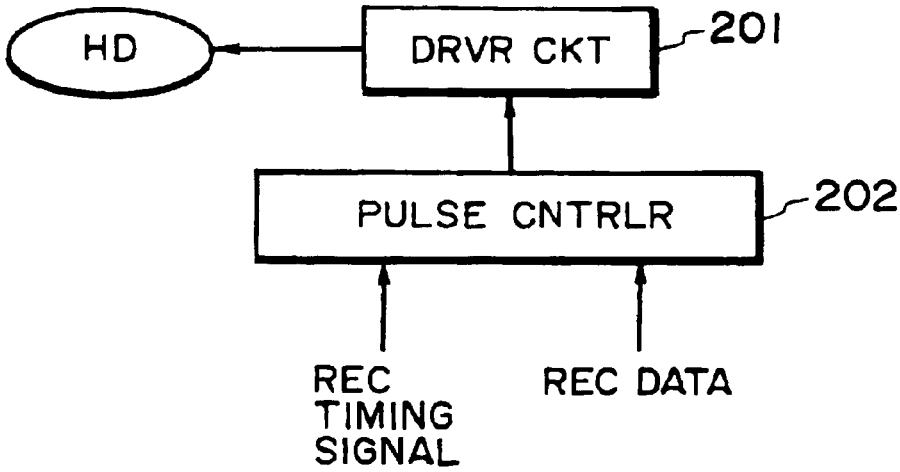
FIG. 42 is a schematic view showing a fundamental structure for driving the head.

FIG. 42 is a schematic view showing a fundamental structure of a liquid ejecting apparatus for implementing the driving method for the liquid ejecting head according to this embodiment. The liquid ejecting apparatus comprises a liquid ejecting head 200, a driving circuit 201 for supplying driving pulses to the heat generating elements of the liquid ejecting head 200, and a pulse control circuit 202 for supplying control signals for controlling the driving pulses to the driving circuit 201. A recording timing signal and a recording data are supplied to the pulse control circuit portion 202, and the control signal is produced on the basis of the data. In this device, the driving circuit portion 201 and the pulse control circuit portion 202 constitute a driving pulse control means.

Figure 43:
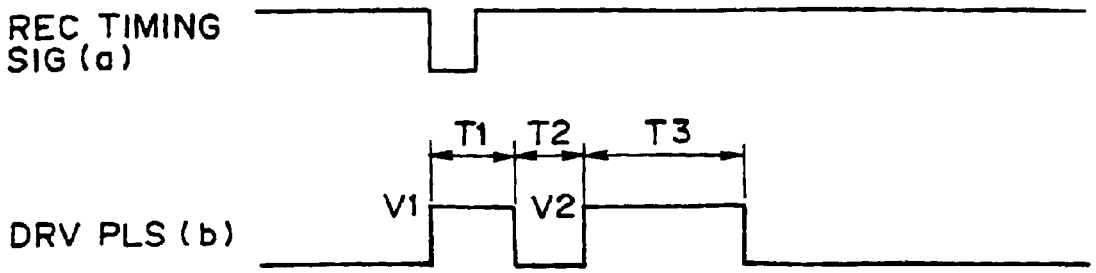
FIG. 43 illustrates control of driving pulses.

Referring to FIG. 43, the description will be made as to control of driving pulse sin this apparatus. The recording timing signal (*a*) and the recording data (*b*) are supplied to the pulse control circuit portion 202. A rectangular first pulse having a pulse width T2 and a voltage V1 is applied (driving pulse (*b*)) by the recording timing signal (*a*) is applied to the heat generating element of the liquid ejecting head 200 through the driving circuit portion 201. Subsequently, a rectangular second pulse having a width T3 and a voltage V2 is applied to the heat generating element after 0 voltage T2 time (rest period T2) elapses. Here, the voltage levels of the first pulse and the second pulse, are the same. That is, V1=V2 second pulse The width of the second pulse is longer than the first pulse, that is, T1<T3.

(Eighth Embodiment)

Figure 44:
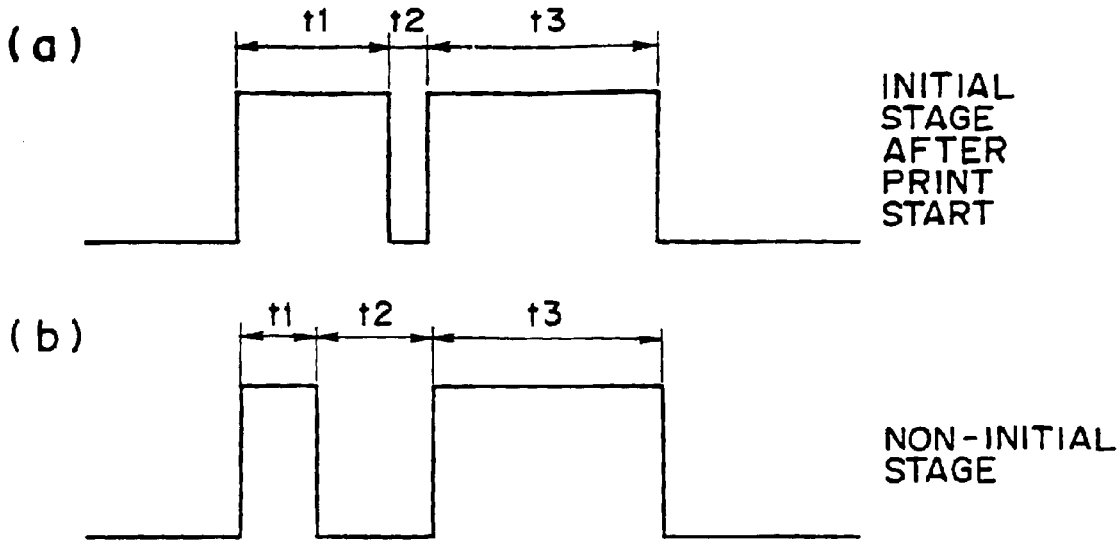
FIG. 44, consisting of FIGS. 44(*a*) and 44(*b*), illustrates driving pulses of an eighth embodiment according to the present invention.

FIG. 44 shows a driving pulse for implementing the driving method of this embodiment. FIG. 44, (*a*) shows a driving pulse used in the initial stage after the print start, and (*b*) shows a driving pulse at the other time. When liquid having low thixotropic property such as high viscosity liquid, is to be ejected, the voltage width t1 is made larger, and the width t2 of the rest period is made smaller, in the initial stage at which the ejection is difficult. When the viscosity is lower in the period other than the initial state, the pulse width t1 is decreased, and the rest width t2 is increased to eject the liquid. By this, the ejection amount is made constant even when the high viscosity liquid is to be ejected. The ejection property upon the record start is improved, and the ejection is stabilized as a whole. The initial stage of the print start means the period between when the liquid flow does not occur and when the liquid flow occurs. It includes the initial printing period after the main switch is actuated or the record start for a new page, or the like.

Figure 45:
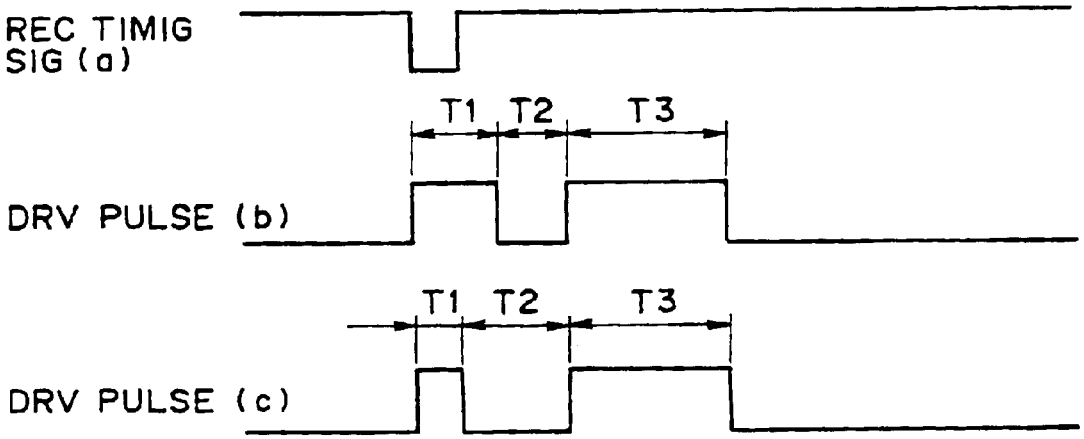
FIG. 45 illustrates a control of driving pulses according to an eighth embodiment of the present invention.

Referring to FIG. 45, the description will be made as to the control of the driving pulse in this example. The viscosity of high viscosity liquid is dependent on the temperature, and therefore, the temperature in the head is detected by a temperature sensor, and the data are supplied to a pulse control circuit portion 202 as recording data. In this example, when the temperature in the head is not more than 40° C. (including the initial state), the driving pulse shown in (*b*) is applied, and when it is not less than 40° C., the driving pulse shown in (*c*) is applied.

(Ninth Embodiment)

Figure 46:
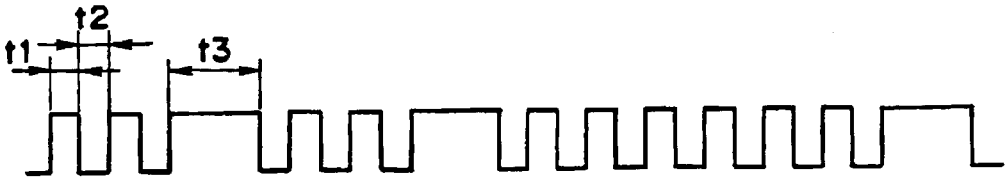
FIG. 46 illustrates driving pulses of a ninth embodiment according to the present invention.

FIG. 46 is a graph showing driving pulses for implementing the driving method of this example. A voltage having a pulse width t1 is applied, and the voltage application is rested for time t2, and is repeated. At this time, the liquid is not ejected. When the liquid is to be ejected, a voltage having a pulse width t3 which is larger than pulse width t1 is applied.

Figure 47:
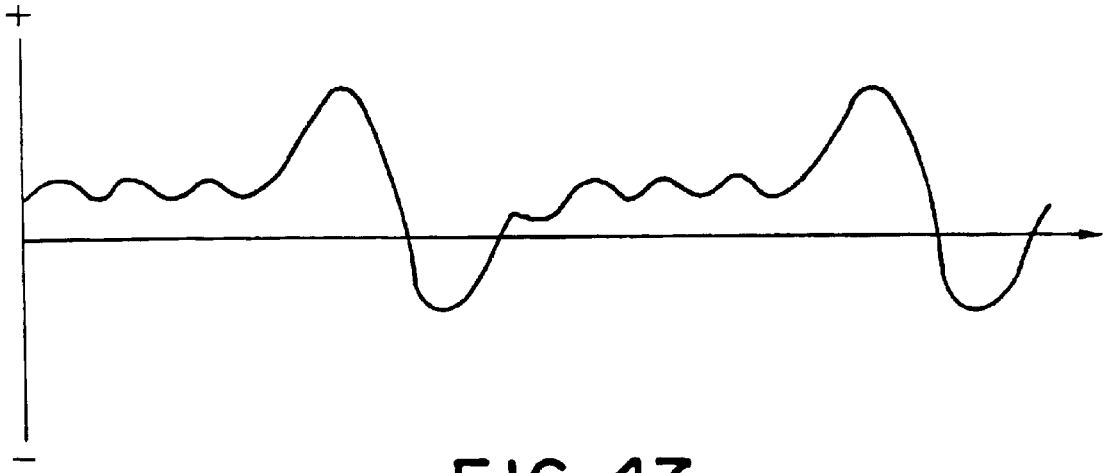
FIG. 47 is a graph showing displacement of a meniscus with time at the ejection outlet position.
Figure 48:
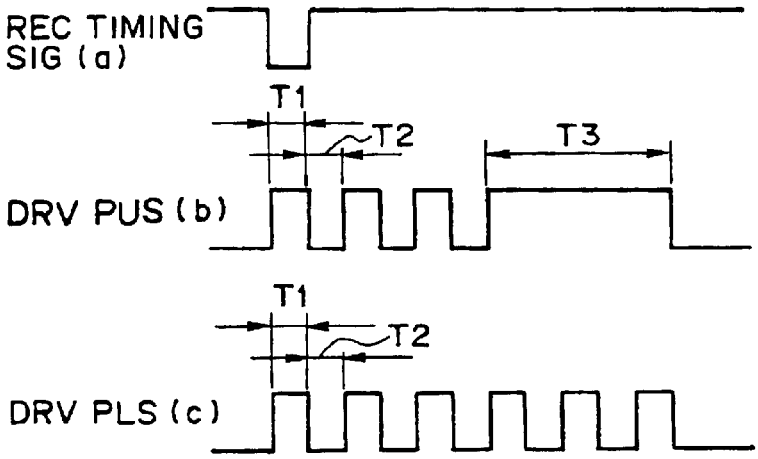
FIG. 48 illustrates a control of driving pulses according to a ninth embodiment of the present invention.

FIG. 47 is a graph showing meniscus vibration in this embodiment. When the bubble generation for the liquid ejection is effected, it is projected at all times. By this, the ejection is stabilized, and since the movable member 31 is vibrated, the meniscus vibration of the liquid flow path 14 can be reduced. Particularly, when the period of the vibration of the movable member is shorter than the period of the vibration of the meniscus, the peak is dispersed, so that the effect of the reduction of the meniscus displacement is greater.

Figure 57:
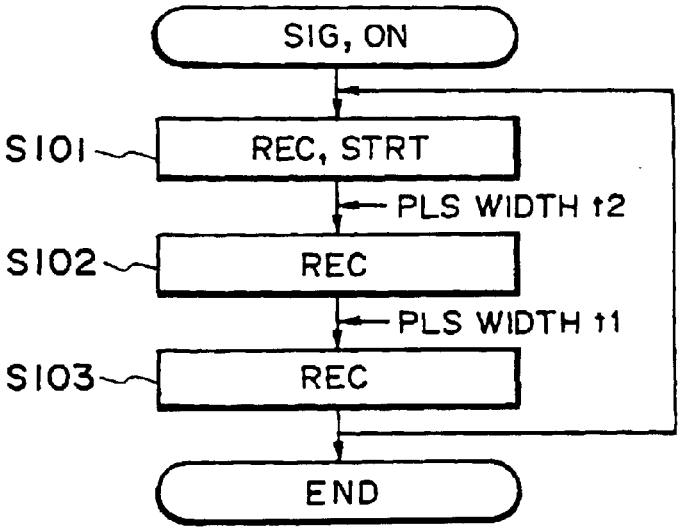
FIG. 57 is a flow chart showing steps of an initial ejection stabilization process according to 11th embodiment of the present invention.

In the control of the driving pulse in this embodiment, as shown in FIG. 57, when the liquid is to be ejected in response to the recording data, the driving pulse (*b*) is applied, and when the liquid is not ejected, the driving pulse (*c*) is applied.

(Tenth Embodiment)

Figure 49:
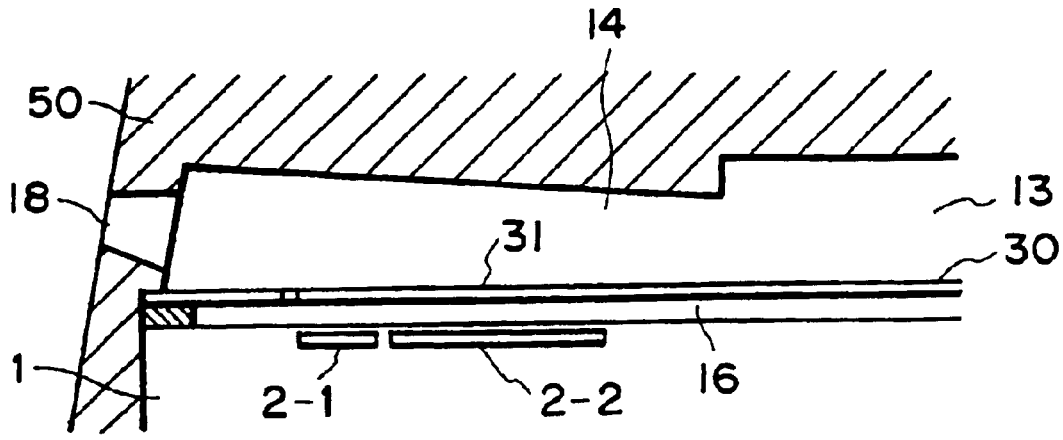
FIG. 49 is a sectional view of a liquid ejecting head suitable for a driving method for a liquid ejecting head according to a tenth embodiment of the present invention.
Figure 50:
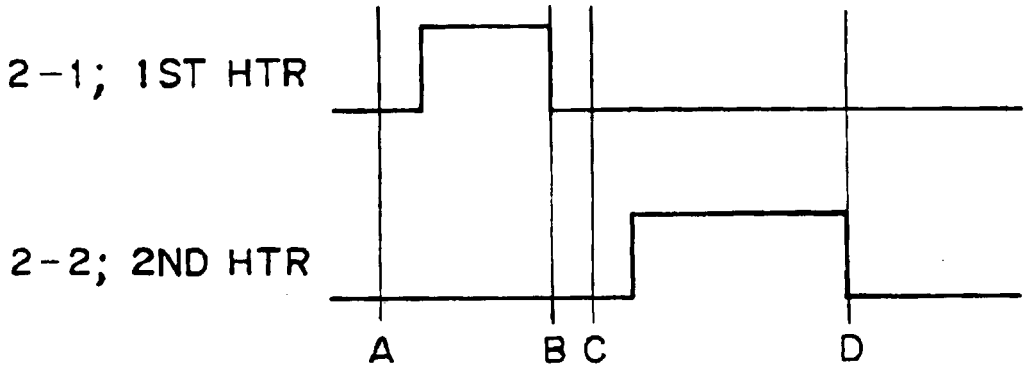
FIG. 50 shows pulses for driving a heat generating element.
Figure 51:
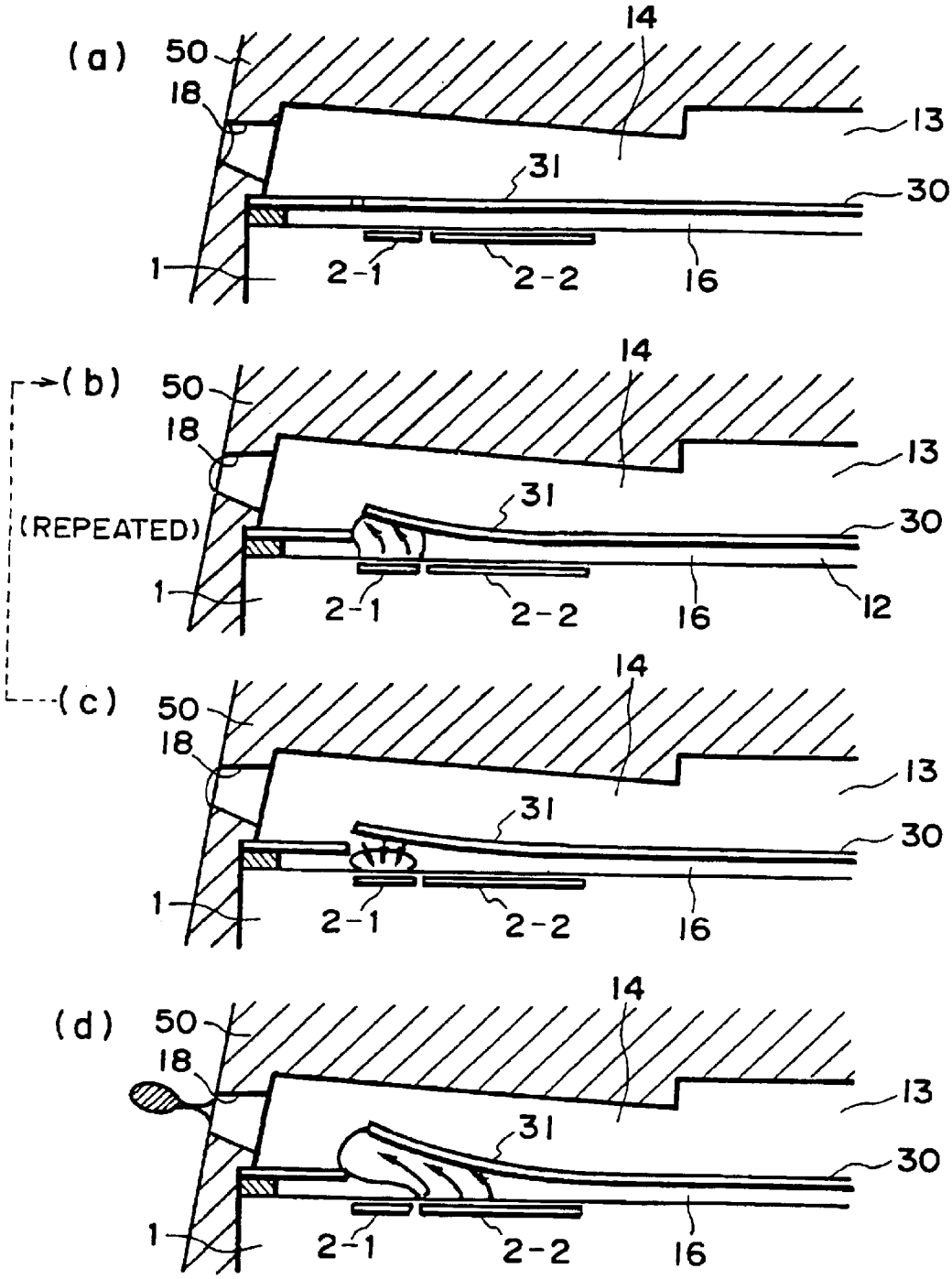
FIG. 51, consisting of FIGS. 51(*a*)–51(*d*), illustrates the tenth embodiment, and more particularly is a sectional view of a liquid flow path of a head using a driving method of the present invention.

FIG. 49 is a sectional view of a liquid ejecting head suitable for the driving method for the liquid ejecting head of this example. The liquid ejecting head is similar to that shown in FIG. 9 and FIG. 39, but the heat generating element 2 is constituted by a first heat generating element 2-1 and a second heat generating element 2—2 which have different heat generation areas, and the structures are the same as in FIG. 1 and FIG. 39 in the other respects. The heat generating element 2-1 and the heat generating element 2—2 can be driven independently from each other. FIG. 50 shows driving pulses for implementing the driving method of this embodiment, using the heat generating elements 2-1, 5-2. FIGS. 51, (*a*), (*b*), (*c*), (*d*) shows the states in the liquid ejecting head at the timings A–D of the driving pulses shown in FIG. 50. FIG. 51, (*a*) shows the state wherein the heat generating elements 2-1, 5-2 have not been actuated. (*b*) shows the state wherein the first heat generating element 2-1 is actuated. The bubble generation at this time is not enough to eject the liquid, and is only enough to displace the movable member 31 to a small extent. (*c*) shows the state wherein the collapse of bubble occurs in the rest period, and the movable member 31 is still displacing. (*d*) shows the state wherein the second heat generating element 2—2 is actuated. The bubble generation power for the second heat generating element 2—2 is larger than the bubble generation power for the first heat generating element 2-1, and therefore, the movable member 31 displaces to a greater extent than at B, and the liquid ejects at this time.

The meniscus at the ejection outlet 18 for the ejection liquid, vibrates in the similar manner to seventh embodiment shown in FIG. 41. By once displacing the movable member 31, the bubble generation for the ejection occurs with the constant displacement of the movable member 31 and the constant state of the meniscus, so that the ejection amount is stabilized. In addition, most of the bubble generation power for the second heat generating element 2—2 is directed toward the ejection outlet, and therefore, the ejection amount is increased when the liquid is ejected by a single pulse of a single heat generating element.

Figure 52:
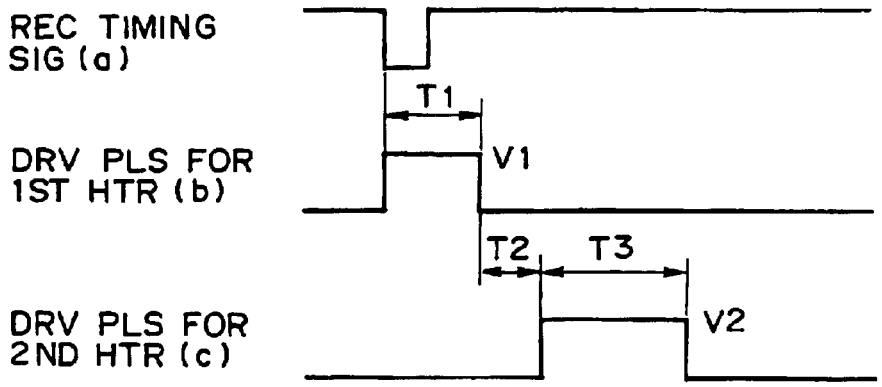
FIG. 52 illustrates control of driving pulses.

The control of the driving pulse in this example is as shown in FIG. 52. The first heat generating element 2-1 is first supplied with a rectangular pulse having a width T1 and a voltage V1 (driving pulse for the first heat generating element 2-1) in response to the recording timing signal (*a*). Subsequently, after the rest period T2, the second heat generating element 2—2 is supplied with a rectangular configuration pulse having a width T2 and a voltage V2 (driving pulse (*c*) for the second heat generating element 2—2). At this time, V1=V2, and T1<T3, are satisfied.

In the liquid ejecting head, used in this example, the portion of the separation wall 30 between the first liquid flow path 14 and the second liquid flow path 16 and the portion of the separation wall 30 between the adjacent nozzles, are integrally formed of nickel having a thickness of 5 micron through electro-forming, and by coupling with the substrate 1, the second liquid flow path 16 for the bubble generation liquid is formed. The nozzle separation wall and the liquid separation wall may be formed separated and then connected with each other to form the bubble generation liquid flow path 16.

FIG. 52 is a block diagram showing a structure for driving the liquid ejecting head in the above-described liquid ejecting apparatus.

As shown in the Figure, the head driver 102 drive the heat generating elements of the ejection head 60 on the basis of the ejection control signals and the ejection datas transferred from the CPU101, by which the liquid ejection is carried out through the above-described principle of the ejection. The head driver 102 is supplied with pulse data for the driving pulse to be applied to the heat generating element by the pulse generator 105, by which the driving pulse waveform is changed for the initial ejection stabilization which will be described hereinafter.

Figure 53:
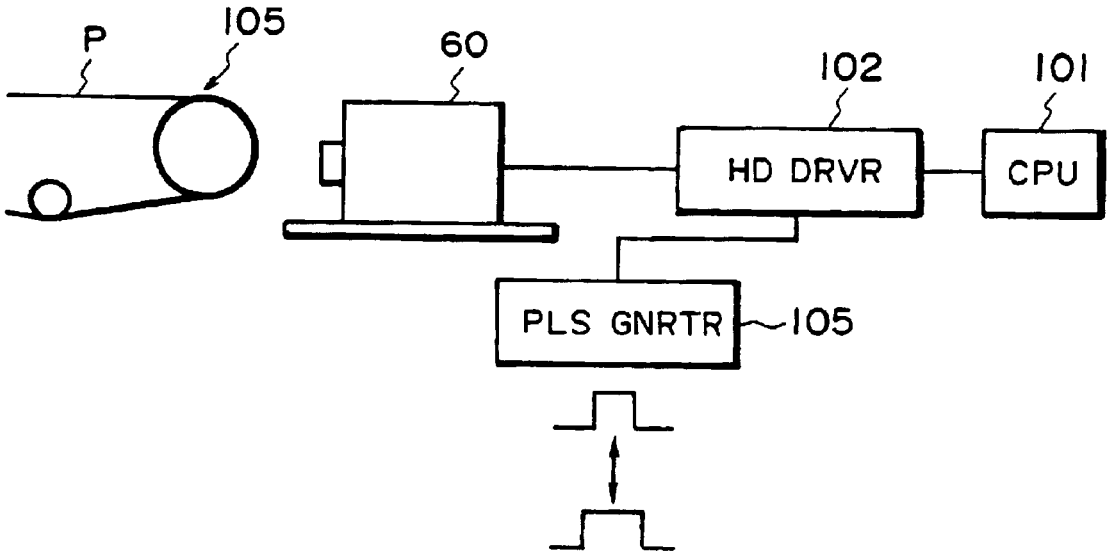
FIG. 53 is a schematic view of a driving structure of a liquid ejecting apparatus according to an embodiment of the present invention.

Designated by 105 in FIG. 53 is a feeding system for recording materials P in the above-described liquid ejecting apparatus (FIG. 20).

Figure 54:
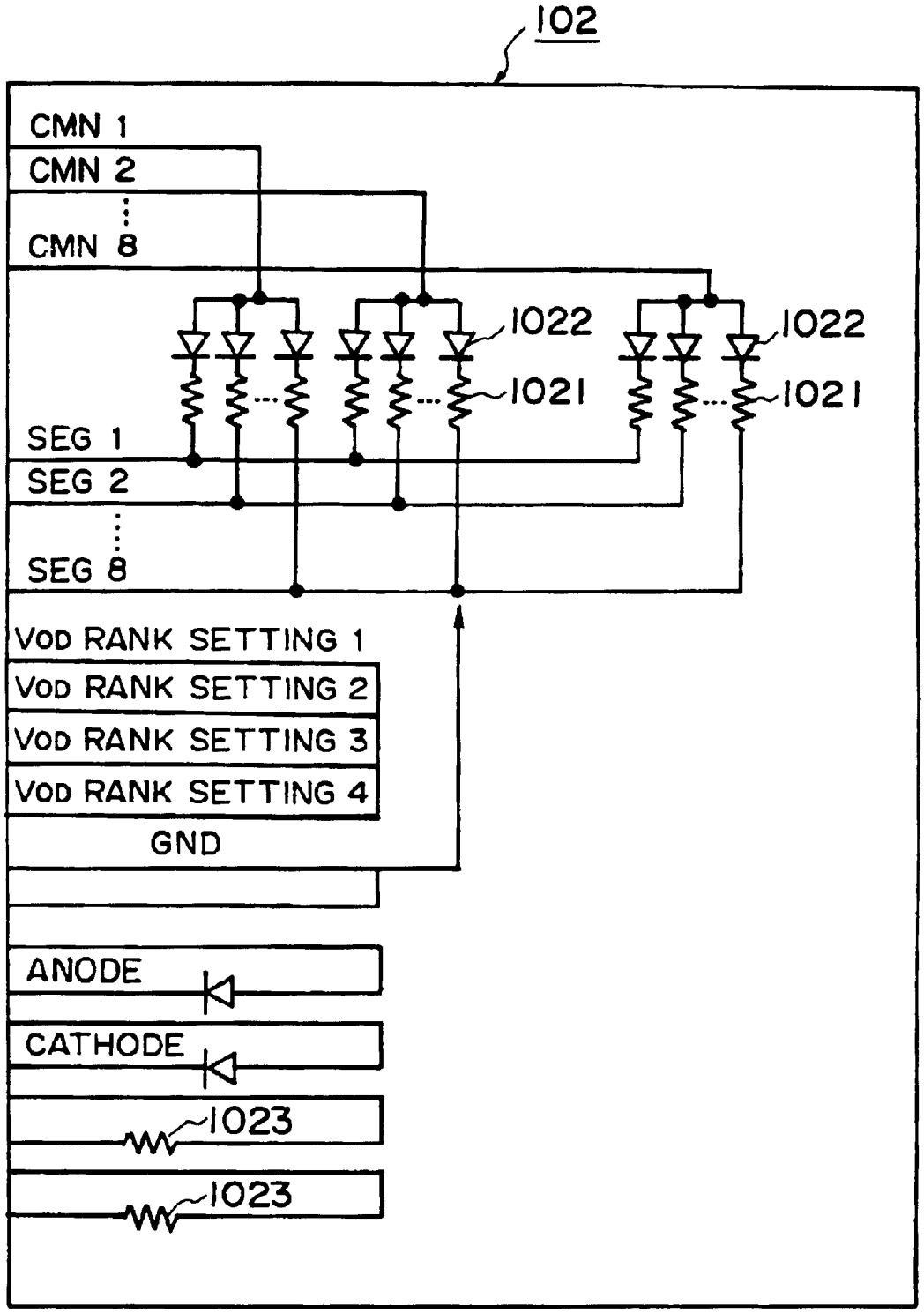
FIG. 54 shows an equivalent circuit of an element substrate of a liquid ejecting head.

FIG. 54 shows a substrate structure of the above-described liquid ejecting head 60. The position of the elements are different from the actual machine for the purpose of better understanding of the embodiment.

In FIG. 54, 64 heaters 1021 as heat generating elements are provided corresponding to the ejection outlets of the ejection head 60. The 64 heaters 1021 are grouped into 8 blocks each including 8 heaters, and the time sheared driving is effected for the groups. 8 diode arrays 1022 and heaters 1021 correspond to 8 common electrodes, and different segment electrodes are connected to 8 heaters in each block. The head substrate is provided with a temperature keeping heater 1023 for heating the ejection liquid, as will be described hereinafter.

Figure 55:
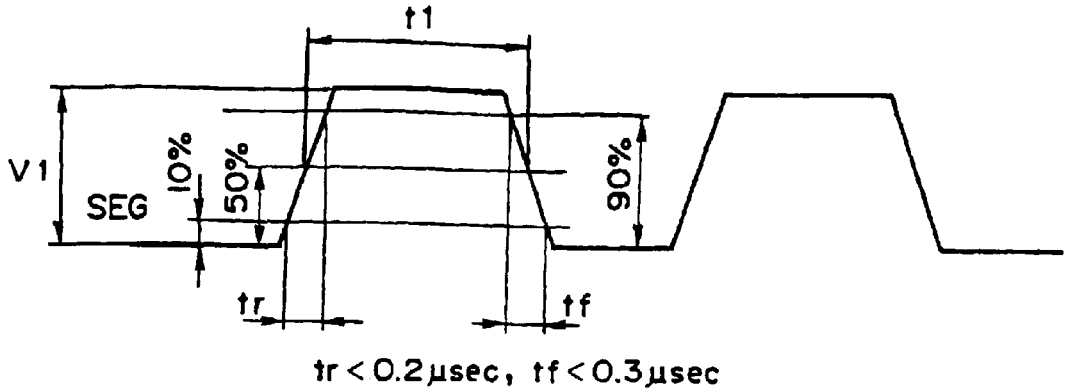
FIG. 55 is a waveform graph showing driving pulses.
Figure 56:
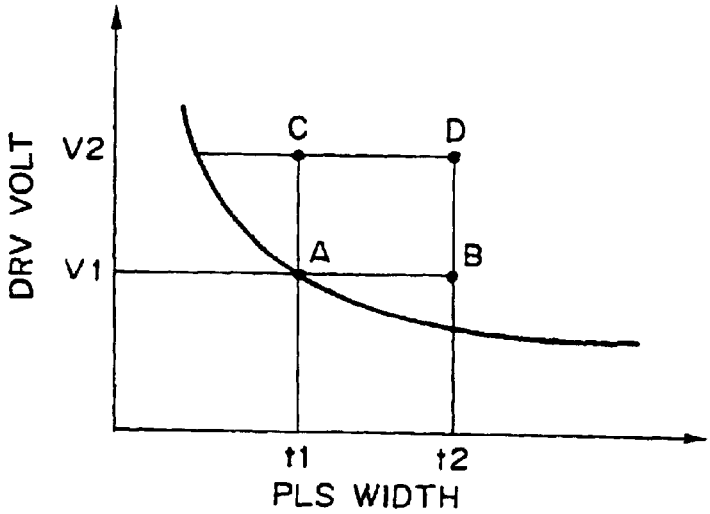
FIG. 56 shows a relation between a driving voltage and a pulse width of the driving pulse.

FIG. 55 shows an usual waveform of the voltage pulse applied to the heater 1021, and FIG. 56 show a proper relation between the pulse width and voltage of such a voltage pulse. As will be understood from FIG. 56, the voltage can be decreased with increase of the pulse width.

The description will be made as to some embodiments of the ejection stabilization process based on the fundamental structure described above.

(11th Embodiment)

In the normal recording operation, the pulse application period (pulse width) is set to t1, and the voltage is set to V1 (point A in FIG. 56) in accordance with the pulse application period, and thereafter, the driving pulses having the thus set pulse width and the voltage are applied in accordance with the ejection signal.

However, with this said pulse application method, the initial ejection property may vary for a certain period from the record start when high viscosity liquid is used as the ejection liquid or when the rest period is long, and therefore, the ejection liquid may be solidified adjacent to the ejection outlet, or the viscosity thereof may be increased. This is because the liquid flow is not stabilized at this stage. Therefore, the feathering on the adjacent is not uniform.

Figure 58:
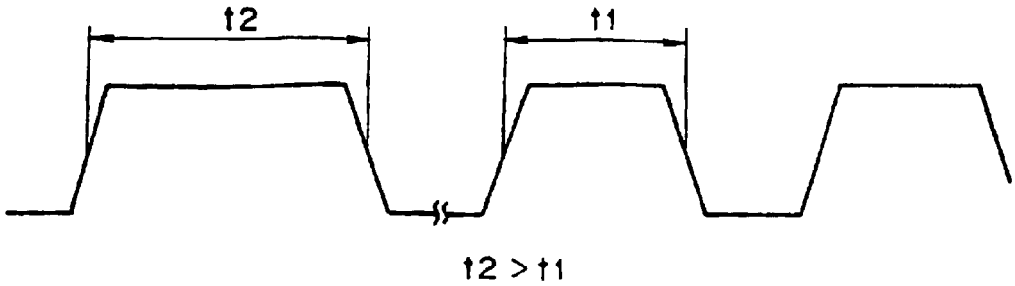
FIG. 58 is a waveform graph showing driving pulses.

In embodiment, the process shown in FIG. 57 is carried out. During a predetermined time from the record start (step S101), the pulse width of the driving pulse is $t_2$ which is larger than normal pulse width $t_1$, and after that (step S102), the normal pulse width $t_1$ is used for the recording (FIG. 58, point B in FIG. 56). By this, thermal energy amount generated by the heat generating element is increased to increase the generated bubble pressure of the bubble generation liquid, by which the start up period of the ejection property is decreased, so that the feathering on the recording material is quickly stabilized to permit satisfactory ejection from the initial stage.

Figure 59:
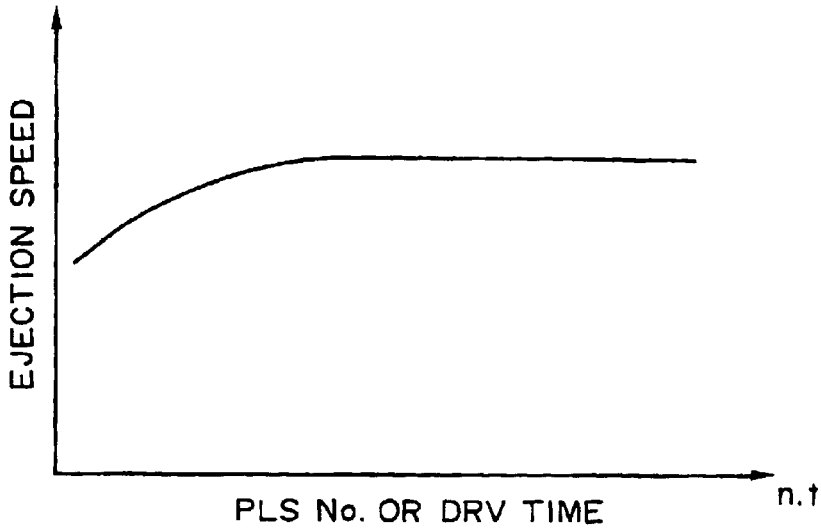
FIG. 59 shows a relation between a driving time of a driving pulse and an ejection speed.

FIG. 59 illustrates the principle of this process, and shows a relation between the application period and the ejection speed when normal applied pulses are used.

As shown in this Figure, the ejection speed is lower in the initial stage of the ejection and varies, but after pulses are applied for a certain period (the period required for the stabilization of the motion of the liquid and the operation of the movable member from the drive start), the ejection speed reaches a predetermined level, and the ejection is stabilized. Therefore, the pulses having the predetermined pulse width are applied for a period sufficient for the stabilization of the ejection, and after the ejection is stabilized, the pulses of normal pulse width are applied.

In this example, "(upon) the record start or ejection start" means the time immediately after non-signal indicative of non-ejection, and may be defined as the time of the non-signal. Thus, what is meant by "(upon) the record start or election start" in this example, is different depending on the cause of the decrease of the ejection property. For example, in the case of decrease of the ejection property mainly caused by the solidification or viscosity increase, the top of the page to be recorded can be defined as the "(upon) the record start" if the ejection liquid has a relatively high recovery property, and the pulse width in the period of predetermined length therefrom is changed.

In the case of high viscosity liquid used as the ejection liquid, the top of a line of recording may be defined as "(upon) the record start or ejection start" if the property of the liquid exhibits the reproducibility for each line of recording.

When the liquid has a further high viscosity, the pulse width is further increased upon the record start, so that the temperature of the liquid is raised to lower the viscosity, by which the initial ejection property is improved to provide satisfactory image quality.

(12th Embodiment)

In the driving pulse conditions similar to those of the 11th embodiment, a larger driving voltage is used for a predetermined time from the record start or until a predetermined number of pulses are applied, by which the generated bubble pressure is increased to improve the initial ejection property.

Figure 60:
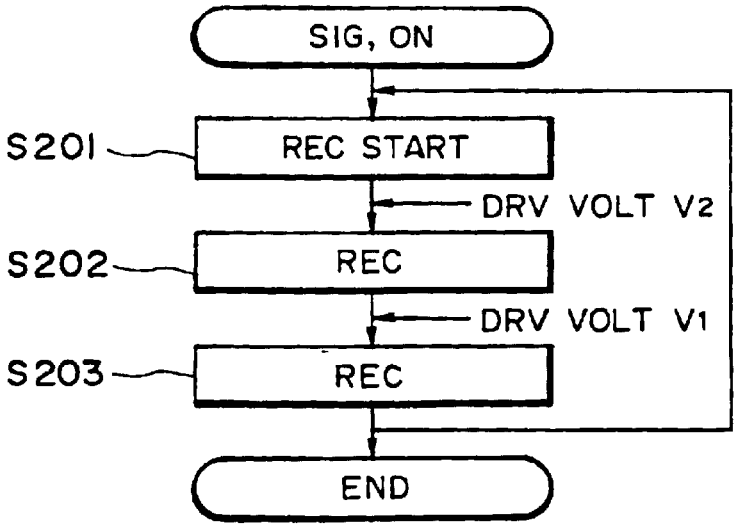
FIG. 60 is a flow chart showing steps of an initial ejection stabilization process according to 12th embodiment of the present invention.
Figure 61:
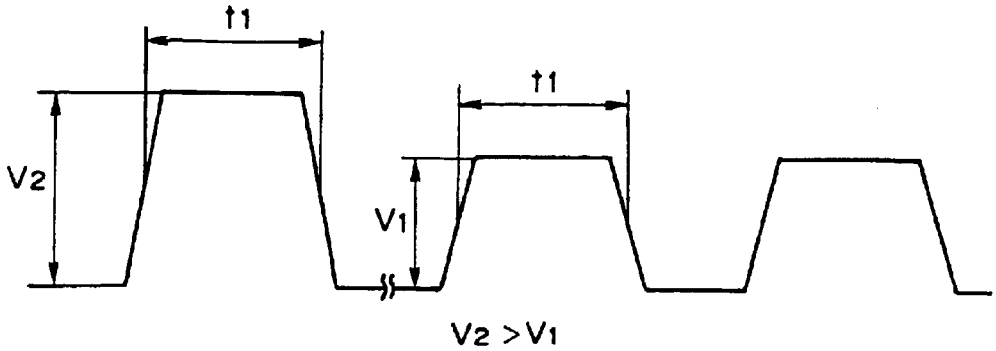
FIG. 61 is a waveform graph showing driving pulses.

As shown in FIG. 60, a voltage $V_2$ which is higher than the normal voltage $V_1$ is applied for a predetermined time from the record start (point C in FIG. 56), and thereafter (after the ejection performance such as the ejection speed is stabilized), normal voltage $V_1$ pulses are applied (FIG. 61).

With this, the deterioration in the initial ejection property can be suppressed, as in the 11th embodiment. When a further higher viscosity liquid is used, the applied voltage upon the record start is increased, so that the temperature of the liquid is increased to lower the viscosity, thus improving the initial ejection property to provide satisfactory image quality.

(13th Embodiment)

Figure 62:
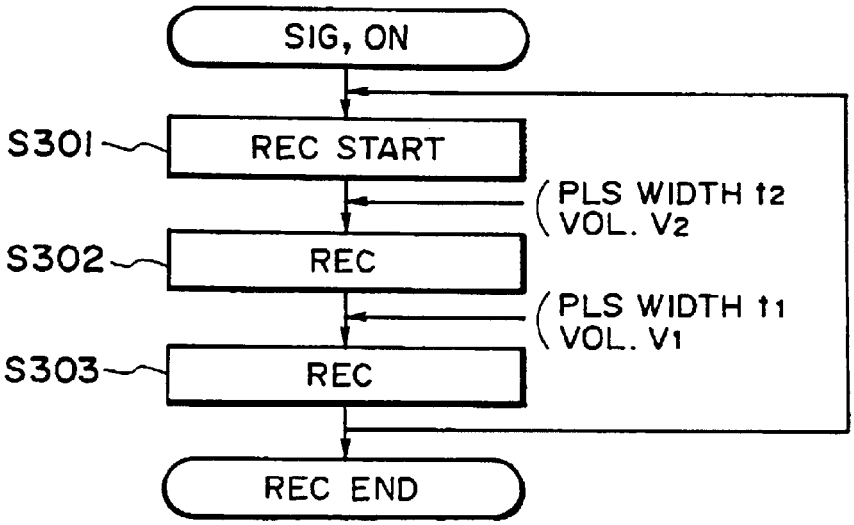
FIG. 62 is a flow chart showing steps of an initial ejection stabilization process according to 13th embodiment of the present invention.

In this example, the application and the pulse width of the driving voltage are made higher for a predetermined time from the record start as shown in FIG. 62 in the driving pulses conditions similar to those in the foregoing embodiments, so that the generated bubble pressure is increased to improve the initial ejection property.

Figure 63:
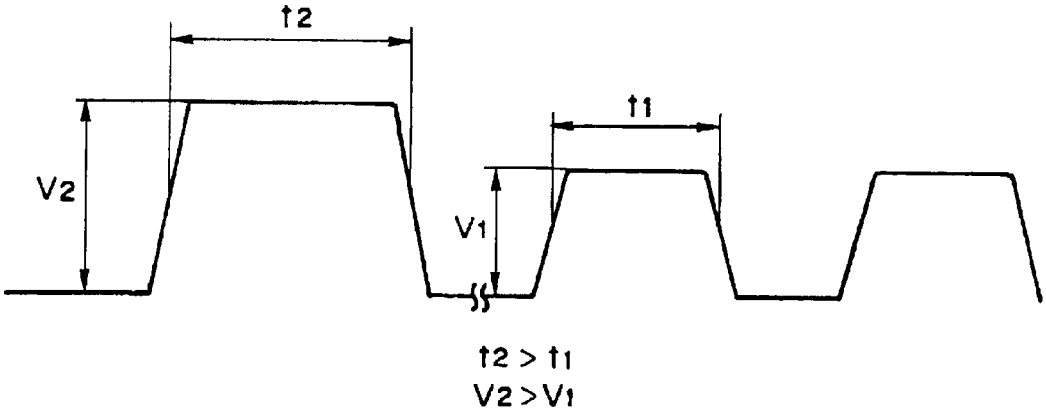
FIG. 63 is a waveform graph showing driving pulses.

Normally, as shown in FIG. 55, the recording is effected with the constant driving voltage $V_1$ and the constant pulse width $t_1$. In this example, as shown in FIG. 63, for the predetermined time from record start, the driving voltage $V_2$ ($V_2>V_1$) is applied with the width Of $t_2$ ($t_2>Vt_1$), (point D in FIG. 56). After the stabilization of the ejection, normal voltage $V_1$ and normal pulse width $t_1$ are applied for the recording.

(14th Embodiment)

Figure 64:
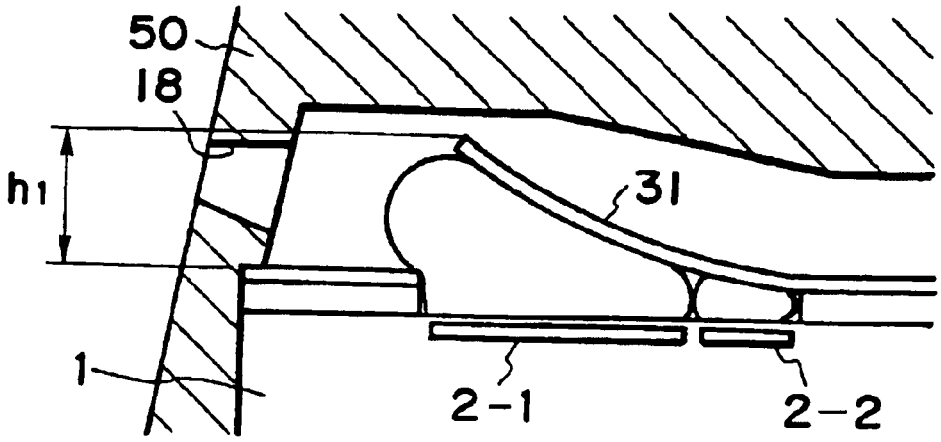
FIG. 64, consisting of FIGS. 64(*a*) and 64(*b*), is a sectional view showing a structure of a liquid ejecting head according to a $14^{th}$ embodiment of the present invention.
Figure 64:
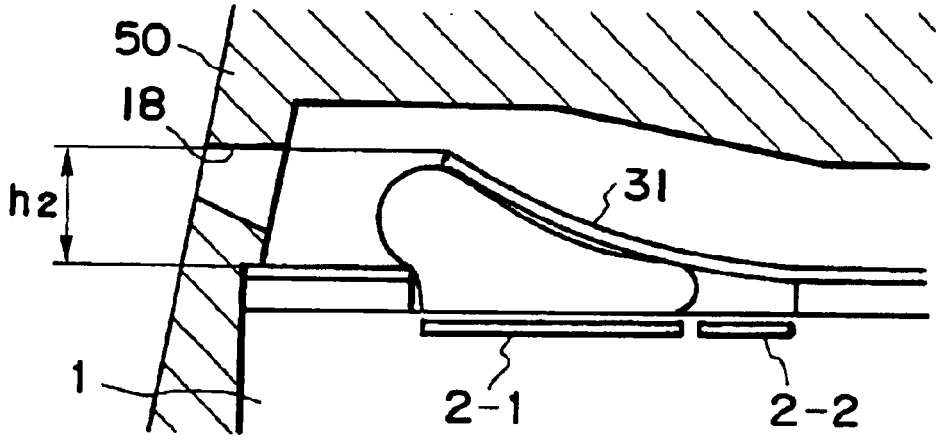

In this example, two heat generating elements are provided for one movable member, and this structure is utilized for the ejection stabilization, FIGS. 64, (*a*) and (*b*) shows the structure.

In FIG. 64, (*a*), the two heat generating elements 2A and 2B, are driven, and by the bubble generation thereby, the movable member 6 is displaced to eject the liquid. In FIG. 64, (*b*), the movable member 6 is displaced by the bubble generation by one heat generating element 2A.

Figure 65:
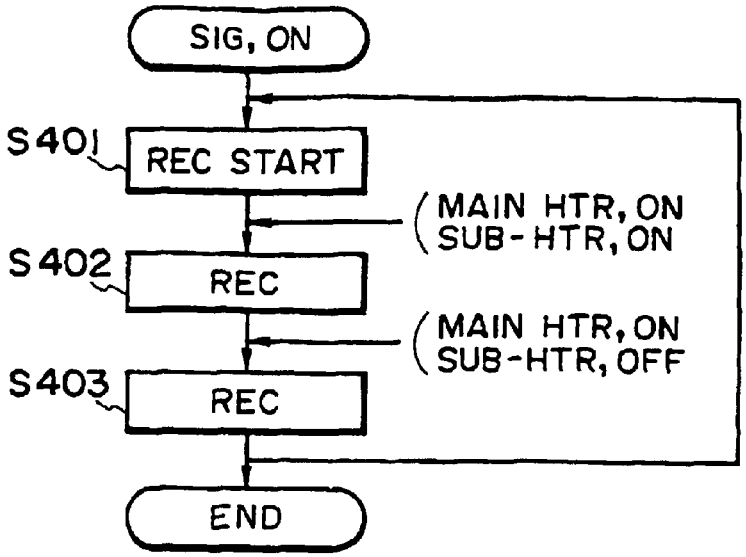
FIG. 65 is a flow chart showing steps of an initial ejection stabilization process according to 14th embodiment of the present invention.

When two heat generating elements are driven, the total generated bubble pressure is higher so that the movable member 6 is displacement to a greater extent. Therefore, as shown in FIG. 65, when the election is not stable upon record start, the two heat generating elements are driven to stabilize the ejection by the higher generated bubble pressure, and after the stabilization of the ejection, only the main heat generating element 2A is driven to eject the liquid, as shown in FIG. 64, (*b*).

Similarly to the foregoing embodiment, the initial ejection property is improved to provide the satisfactory images.

The description will be made as to a further embodiment for the control for the ejection performance improvement of the ejection head.

Figure 66:
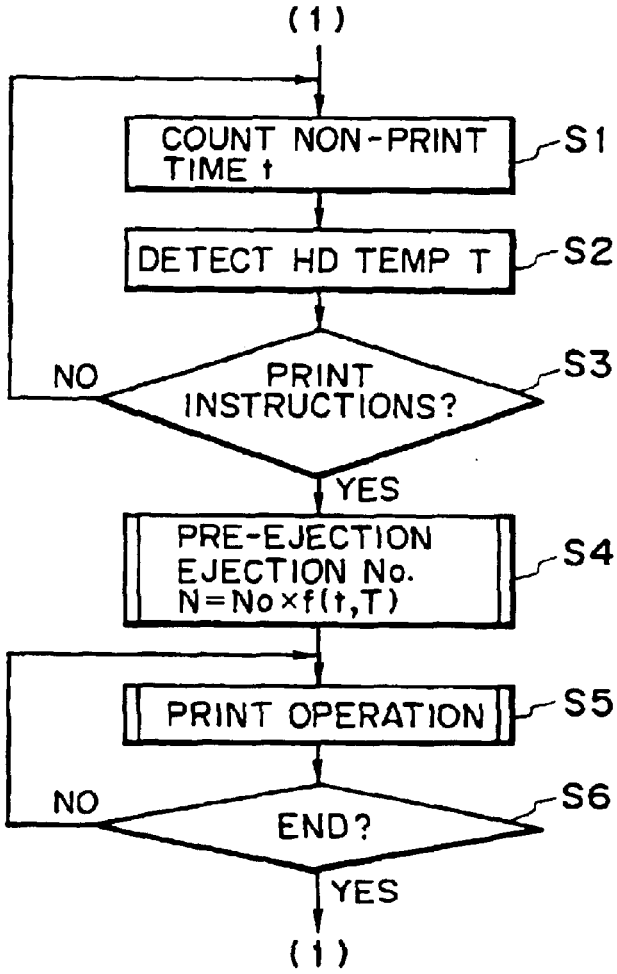
FIG. 66 is a flow chart showing process steps for preliminary ejecting operation upon print start.

FIG. 66 is a flow chart showing the process steps relating to the preliminary ejecting operation mainly upon the print start, and FIG. 67 schematically shows the content of the table used with the process.

As shown in FIG. 66, in this example, when the completion of the printing is discriminated (step S6), the non-printing time t thereafter is counted (step S1), and the head temperature. T is detected (step S2). When the printing instructions is detected (step S3), the preliminary ejection is carried out with the number of ejections in accordance with the non-printing time t and the head temperature T detected. By such preliminary ejections, the viscosity-increased ink and the mixed ink in the head can be satisfactorily discharged similarly to the foregoing embodiments.

The number N of ejections in th preliminary ejection, is determined by $N=N_0 \times f$ (t, T). Here, $N_0$ is the number of ejections with which the viscosity-increased liquid and the mixture liquid can be satisfactorily discharged when the non-printing time is less than 12 hours, and the head temperature is not less than 10° C. and less than 20° C., for example. The f (t, T) is an operator for determinating the coefficient determined by the non-printing time t and the head temperature T, and is determined by referring to the processing table on the basis of the time t and the temperature T.

FIG. 67 schematically shows the content of the table storing the values determined by the processing f (t, T). With the decrease of the head temperature T or with the increase of the non-printing time t, the decreases of the ejection performance or the feathering of the liquid on the recording material is larger due to the temperature dependence property of the viscosity and due to the viscosity-increased by evaporation of the water. To compensate for this, as shown in this Figure, the coefficient f (t, T) is increased therewith, that is, the number of ejections in the preliminary ejection is increased. The content of the table shown in this Figure, is for the purpose of better understanding of the invention, and may be changed properly by one skilled in the art. Finer control or non-linear control is possible by the processing.

Figure 68:
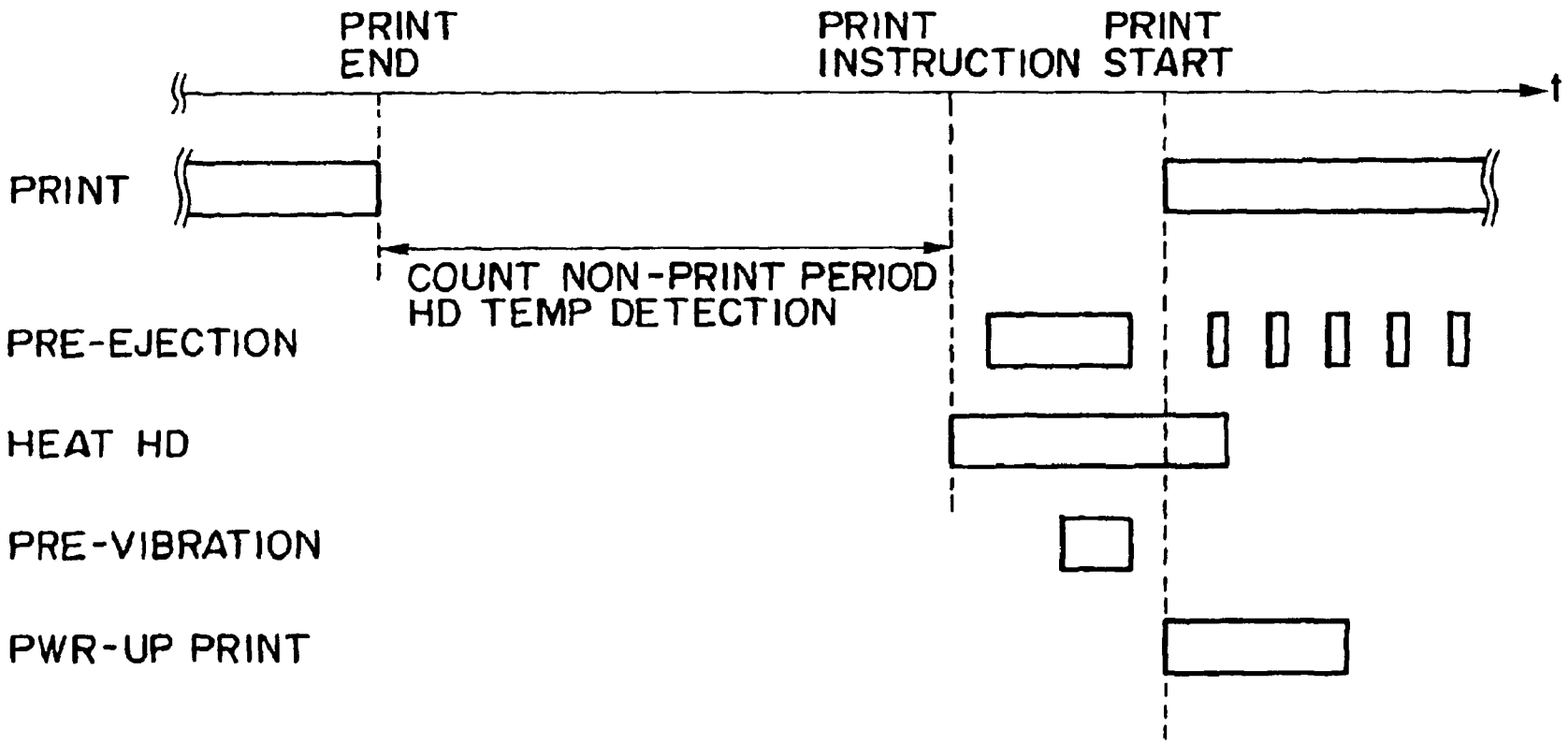
FIG. 68 is a timing chart of each operation shown in FIG. 66.

FIG. 68 is a timing chart for operations for improving the ejection state upon the print start inclusion the preliminary ejection. Each operation shown in this Figure, is similar to the operations described in the foregoing embodiments. In this embodiment, in addition to the preliminary ejecting operation upon the print start, the head heating using the heater formed on the head substrate, the vibration of the valve formed in the partition by supplying the energy not enough to eject the liquid to the heater, and the power up printing with which the energy supplied to the ejection heater immediately after the print start is increased, are carried out in combination, so that the ejection performance is improved. More particularly, the viscosity-increased ink discharge and the mixed liquid discharge by the preliminary ejecting operation, the improvement in the ejection responsivity by the head heating, the increase of the ejection amount and the ejection stabilization by the preliminary valve driving, and the stabilization of the initial printing by the power up printing, are accomplished.

As described in the foregoing, in this embodiment, the state of the ink or the like in the head is superposedly improved by the driving structure of the head per se, so that the stabilization of the initial ejection performance is improved.

Particularly, by combining these sequential operations, the stability improvement of the ejection performance and the stabilization effect for the feathering of the liquid on the recording material, are synergetically provided, and therefore, the property at the initial recording stage after the rest period is recovered, and in addition, even better property is accomplished to provide very high reliability and image quality.

In the foregoing embodiments, the the operation before the ejection start, that is, in the rest period, has been described, the operation may be carried out during the ejecting operations to provide the effects.

As described in the foregoing, according to the present invention, a large part of the pressure by generation of the bubble resulting from the heat generation of the heat generating element is efficiently transmitted directly to the ejection outlet side by the movable member, and therefore, the liquid can be ejected with high ejection energy use efficiency and with high ejection pressure.

Particularly, according to an aspect of the present invention, the heating means for adjusting the temperatures of the bubble generation liquid and the ejection liquid at a liquid chamber position in fluid communication with the second liquid flow path containing the bubble generation liquid, by which the bubble generation liquid can be controlled to a predetermined temperature. The heat is efficiently transmitted to the ejection liquid through the separation wall, so that the viscosity decrease of the liquid and the proper initial ejection can be accomplished. In addition, in the case that the ejection liquid is heated through the bubble generation liquid, the bubble generation power of the bubble generation liquid can be enhanced.

Further, according to an aspect of the present invention, there is provided a thermally conductive columnar member in contact with said heating means, the member is usable as a heat transfer member for the ejection liquid, and therefore, the heat transfer from the heating means is improved.

According to an aspect of the present invention, the bubble generating energy is increased during a period until the ejection property such as the ejection speed at the initial ejection is ejection propertied, so that the ejection speed can be increased against the resistance by the movable member or by the ejection liquid. As a results, the satisfactory recording is accomplished from the record start.

Furthermore, according to an aspect of the present invention, the increase of the liquid ejection amount and the stabilization of the liquid ejection amount can be simultaneously assured. In addition, the ejection property upon the record start can be improved. The improvement in the ejection property is particularly remarkable when the ejection liquid has a high viscosity. Further, the meniscus vibration at the ejection outlet for the ejection liquid can be suppressed, so that high frequency recording is accomplished.

As regards the mixture of the ejection liquid and bubble generation liquid occurred in the ejection head, according to an aspect of the present invention, the so-called preliminary ejection not effecting recording, is carried out on the basis of the information relating to the viscosity such as the dynamic viscosity which is an index of the mixture or on the basis of mixture information directly indicative of the degree of the mixture, so that the mixed liquid can be discharged together with viscosity-increased ejection liquid. As a result, satisfactory recording is accomplished with proper density at all times.

Using these features in combination, the ejection performance can be stably enhanced, and in addition, the properties of the liquid per se, such as density or feathering property, are improved, so that the image quality is improved.

What is claimed is:

1. A liquid ejecting apparatus for ejecting liquid using a bubble, comprising:

a recording head comprising:

a plurality of ejection outlets for ejecting the liquid;

a plurality of heat generating elements, provided for each of said ejection outlets, for generating heat to form a bubble, each of said heat generating elements having an area;

a bubble generating region where the bubbles are generated in the liquid by activation of said heat generating elements; and a movable member, provided for each of said ejection outlets, which is disposed faced to said bubble generating region and which has a fulcrum and a free end located downstream of the fulcrum relative to a direction of flow of the liquid, each of said movable members being displaceable between a first position and a second position farther from the bubble generating region than the first position, wherein a portion of each of said movable members facing center points of the areas of corresponding heat generating elements is displaceable; and control means for controlling said heat generating elements in such a manner as to generate heat to displace said movable members without ejecting the ink, and to generate heat again before said movable members have returned to their original positions.

2. A liquid ejecting apparatus according to claim 1, wherein said control means causes vibration of said movable members by applying energy to bubble generation means, which energy is lower than that for ejecting the liquid.

3. A liquid ejecting apparatus according to claim 2, wherein, for each movable member, one of said plurality of heat generating elements corresponding thereto, which generates a bubble insufficient to eject the liquid, causes the vibration of said movable member.

* * * * *

UNITED STATES PATENT AND TRADEMARK OFFICE

CERTIFICATE OF CORRECTION

PATENT NO. : 6,851,779 B2
APPLICATION NO. : 10/656379
DATED : February 8, 2005
INVENTOR(S) : Takeshi Okazaki et al.

It is certified that error appears in the above-identified patent and that said Letters Patent is hereby corrected as shown below:

Title Page
At (57) ABSTRACT
Line 1, “Liquid” should read --liquid--.
Line 5, “faced to” should read --facing--.

IN THE DRAWINGS
Sheet 23, Fig. 28, “ELAPES :” should read --ELAPSE:--.
Sheet 25, Fig. 32, “PERIOD.” should read --PERIOD--.
Sheet 25, Fig. 32, “LIQUID.” should read --LIQUID--.
Sheet 25, Fig. 32, “PRE-SET EJECTION,” should read --PRE-SET EJECTION--.
Sheet 35, Fig. 47, “PUS” should read --PLS--.

COLUMN 1
Line 46, “With such” should read --Such--.

COLUMN 3
Line 2, “Liquid” should read --liquid--.
Line 3, “using” should read --¶using--.
Line 5, “faced to” should read --facing--.
Line 28, “faced to” should read --facing--.
Line 49, “liquid:” should read --liquid;--.
Line 51, “liquid:” should read --liquid;--.
Line 52, “faced to” should read --facing--.

COLUMN 4
Line 4, “liquid:” should read --liquid;--.
Line 6, “liquid:” should read --liquid;--.
Line 7, “faced to” should read --facing--.
Line 29, “faced to” should read --facing--.
Line 51, “faced to” should read --facing--.

COLUMN 5
Line 7, “faced to” should read --facing--.
Line 19, “and” should be deleted.
Line 24, “head.” should read --head;--.
Line 26, “liquid.” should read --liquid;--.
Line 39, “function” should read --functions--.

UNITED STATES PATENT AND TRADEMARK OFFICE

CERTIFICATE OF CORRECTION

PATENT NO. : 6,851,779 B2
APPLICATION NO. : 10/656379
DATED : February 8, 2005
INVENTOR(S) : Takeshi Okazaki et al.

It is certified that error appears in the above-identified patent and that said Letters Patent is hereby corrected as shown below:

COLUMN 9
Line 13, “is” should read --are--.
Line 17, “faced to” should read --facing--.
Line 31, “is faced to” should read --faces--.
Line 55, “FIG. 2, (*b*)” should read --FIGS. 2, (*b*)--.
Line 63, “faced to” should read --facing--.

COLUMN 10
Line 14, “the” (first occurrence) should read --the pressure produced by the bubble 40--.
Line 20, “this” should read --This--, and “contributable” should read --contributes--.
Line 52, “acts” should read --act--.
Line 61, “of” (second occurrence) should be deleted.

COLUMN 13
Line 43, “b” should read --by--.

COLUMN 14
Line 13, “faced to” should read --facing--.
Line 55, “above described” should read --above-described--.

COLUMN 15
Line 2, “it” should read --they--.
Line 3, “opens” should read --open--.

COLUMN 17
Line 15, “liquid” should read --liquid is--.
Line 54, “moves” should read --move--.

COLUMN 19
Line 17, “of easiness” should read --ease--.
Line 22, “th” should read --the--.
Line 24, “was” should read --were--.

COLUMN 20
Line 46, “liquid” should read --liquids--.
Line 49, “oxid” should read --oxide--.

UNITED STATES PATENT AND TRADEMARK OFFICE

CERTIFICATE OF CORRECTION

PATENT NO. : 6,851,779 B2
APPLICATION NO. : 10/656379
DATED : February 8, 2005
INVENTOR(S) : Takeshi Okazaki et al.

It is certified that error appears in the above-identified patent and that said Letters Patent is hereby corrected as shown below:

COLUMN 21
Line 6, “driving” should read --driving of--.
Line 7, “int grally” should read --integrally--.
Line 29, “chamber,” should read --chambers,--.
Line 30, “reduces” should read --reduced--.

COLUMN 23
Line 32, “includes:” should read --include:--.
Line 34, “methylen” should read --methylene--.
Line 44, “does” should be deleted.
Line 50, “is” should read --are--.

COLUMN 25
Line 30, “passage” should read --passages--.
Line 34, “in” should read --In--.
Line 48, “the” should read --The--.
Line 52, “the” should read --The--.
Line 65, “shaft 185” should read --shaft 85--.

COLUMN 27
Line 4, “(Sk).” should read --(Bk).--.
Line 5, “1202” should read --202--.
Line 11, “1204*a*” should read --204*a*--, and “1204*b*” should read --204*b*--.
Line 12, “1204*c*” should read --204*c*--, “1204*d*” should read --204*d*--, and “1204*e*” should read --204*e*--.
Line 20, “58” should read --21--.
Line 34, “1251” should read --251--.
Line 35, “1252” should read --252--.
Line 38, “1251” should read --251--, and “1252” should read --252--.
Line 51, “the use is made with” should read --use is made of an--.
Line 64, “h at” should read --heat--.

COLUMN 28
Line 6, “describe,” should read --described,--.
Line 9, “schematic a” should be deleted.
Line 55, “a” (first occurrence) should read --are--.
Line 56, “a” should be deleted.
Line 65, “growths.” should read --grows.--.
Line 67, “th” should read --the--.

UNITED STATES PATENT AND TRADEMARK OFFICE

CERTIFICATE OF CORRECTION

PATENT NO. : 6,851,779 B2
APPLICATION NO. : 10/656379
DATED : February 8, 2005
INVENTOR(S) : Takeshi Okazaki et al.

It is certified that error appears in the above-identified patent and that said Letters Patent is hereby corrected as shown below:

COLUMN 30
Line 58, “sequence” should read --sequence of--.

COLUMN 31
Line 2, “th” should read --the--.
Line 12, “elapses” should read --elapse--.
Line 59, “may” should be deleted.
Line 61, “is” should read --be--.

COLUMN 32
Line 27, “ink dry” should read --dry ink--.
Line 33, “ink dry,” should read --dry ink,--.
Line 58, “numbers” should read --numbers of--.

COLUMN 34
Line 24, “µscc.” should read --µsec.--.
Line 31, “µscc,” should read --µsec.--.
Line 34, “µscc.” should read --µsec.--.
Line 37, “election” should read --ejection--.
Line 46, “elections” should read --ejections--.
Line 48, “it” should read --if--.

COLUMN 35
Line 10, “th” should read --the--.
Line 11, “(step” should read --(steps--.
Line 46, “has” should read --have--.

COLUMN 36
Line 9, “shows” should read --show--.
Line 24, “provision” should read --provided--.
Line 43, “are” should read --is--.
Line 66, “shows” should read --show--.

COLUMN 37
Line 31, “shows” should read --show--.

COLUMN 38
Line 44, “h at” should read --heat--.

UNITED STATES PATENT AND TRADEMARK OFFICE

CERTIFICATE OF CORRECTION

PATENT NO. : 6,851,779 B2
APPLICATION NO. : 10/656379
DATED : February 8, 2005
INVENTOR(S) : Takeshi Okazaki et al.

It is certified that error appears in the above-identified patent and that said Letters Patent is hereby corrected as shown below:

COLUMN 39
Line 33, “pulse sin” should read --pulses in--.

COLUMN 40
Line 44, “(*c*),” should read --(*c*), and--, and “shows” should read --show--.

COLUMN 41
Line 28, “drive” should read --drives--.
Line 48, “sheared” should read --shared--.
Line 55, “an” should read --a--.
Line 56, “show” should read --shows--.

COLUMN 42
Line 9, “adjacent” should read --adjacent recording material--.
Line 39, “election” should read --ejection--.

COLUMN 43
Line 12, “pulses” should read --pulse--.
Line 19, “Of” should read --of--.
Line 26, “shows” should read --show--.
Line 35, “displacement” should read --displaced--.
Line 36, “election” should read --ejection--.
Line 54, “temperature.” should read --temperature--.
Line 55, “is” (first occurrence) should read --are--.
Line 61, “th” should read --the--.
Line 67, “determinating” should read --determining--.

COLUMN 44
Line 11, “viscosity-increased” should read --viscosity increase caused--.
Line 20, “inclusion” should read --including--.
Line 51, “the” (second occurrence) should read --while--.

UNITED STATES PATENT AND TRADEMARK OFFICE

CERTIFICATE OF CORRECTION

PATENT NO. : 6,851,779 B2
APPLICATION NO. : 10/656379
DATED : February 8, 2005
INVENTOR(S) : Takeshi Okazaki et al.

It is certified that error appears in the above-identified patent and that said Letters Patent is hereby corrected as shown below:

COLUMN 45
Line 18, "results," should read --result,--.
Line 31, "occurred" should read --occurring--.

Signed and Sealed this

Fifth Day of December, 2006

JON W. DUDAS
*Director of the United States Patent and Trademark Office*